US007591763B1

(12) United States Patent
Fucci

(10) Patent No.: US 7,591,763 B1
(45) Date of Patent: Sep. 22, 2009

(54) PORTABLE CONVERTIBLE MULTIFUNCTION EXERCISE APPARATUS AND METHOD

(75) Inventor: Joseph Anthony Fucci, Orlando, FL (US)

(73) Assignee: Gymflex Fitness, LLC, Wilmington, DE (US)

( * ) Notice: Subject to any disclaimer, the term of this patent is extended or adjusted under 35 U.S.C. 154(b) by 0 days.

(21) Appl. No.: 12/044,759

(22) Filed: Mar. 7, 2008

(51) Int. Cl.
*A63B 22/04* (2006.01)
*A63B 21/04* (2006.01)

(52) U.S. Cl. ..... 482/52; 482/121; 482/130; 482/142

(58) Field of Classification Search ..... 482/121–130, 482/133, 141–147, 910; D21/686, 690; 297/69, 354.11
See application file for complete search history.

(56) References Cited

U.S. PATENT DOCUMENTS 3,636,946 A * 1/1972 Hardy ..... 601/28
3,885,789 A * 5/1975 Deluty et al. ..... 482/120
3,995,853 A * 12/1976 Deluty ..... 482/116
4,114,875 A * 9/1978 Deluty ..... 482/120
4,132,405 A * 1/1979 Asher ..... 482/147
4,257,591 A * 3/1981 Evans, Sr. ..... 482/91
4,478,413 A * 10/1984 Siwula ..... 482/127
4,598,908 A * 7/1986 Morgan ..... 482/138
4,770,414 A * 9/1988 Fredrickson et al. ..... 482/148
4,826,158 A * 5/1989 Fields, Jr. ..... 482/142
5,076,579 A * 12/1991 Rickey ..... 482/142
5,112,287 A * 5/1992 Brewer ..... 482/130
5,149,314 A * 9/1992 Ciolino et al. ..... 482/111
5,158,512 A 10/1992 Irwin et al.
5,190,512 A * 3/1993 Curran ..... 482/124
5,232,426 A 8/1993 Van Straaten
5,261,864 A 11/1993 Fitzpatrick
5,524,893 A * 6/1996 McGinnis et al. ..... 473/229
5,529,562 A * 6/1996 Glaser ..... 482/146
5,540,642 A 7/1996 Sprague
5,542,898 A 8/1996 Wilkinson
5,645,511 A * 7/1997 Le Roux et al. ..... 482/52
5,683,331 A * 11/1997 Dalebout ..... 482/52
5,697,870 A * 12/1997 Osborn ..... 482/52
5,728,034 A * 3/1998 Lamothe ..... 482/131
6,042,523 A * 3/2000 Graham ..... 482/121
6,063,013 A * 5/2000 Vathappallil ..... 482/121
6,120,423 A * 9/2000 Mackey et al. ..... 482/121
6,129,650 A * 10/2000 Wedge, Jr. ..... 482/139
6,220,994 B1 4/2001 Rich (Continued)

*Primary Examiner*—Loan H Thanh
*Assistant Examiner*—Daniel F Roland
(74) *Attorney, Agent, or Firm*—Brian S. Steinberger; Law Offices of Brian S. Steinberger, P.A.

(57) ABSTRACT

Portable, convertible and multifunction exercise apparatus, devices, systems and methods of using that allows individuals to accomplish their fitness, health conditioning, weight loss and rehabilitation goals with a single platform having selectively length adjustable resistance bands. Rotatable spring biased wheels can lock the bands to different lengths, where the longer the length the less resistance, and the shorter the length the more the resistance. The platform can transform from a stepper into a bench to an incline seat with foldable legs. Contained within the platform storage unit are several bars handles and leg attachments. An exercise bar having a rotatable midportion can have handle grip ends removably attachable to the bands and/or the bar so that a variety of additional exercises can be performed allowing the user to exercise all muscle groups for a total body workout.

15 Claims, 47 Drawing Sheets

U.S. PATENT DOCUMENTS

| | | | | |
|---|---|---|---|---|
| 6,245,001 | B1 * | 6/2001 | Siaperas | 482/142 |
| 6,299,569 | B1 * | 10/2001 | Rich | 482/123 |
| 6,558,301 | B1 | 5/2003 | Jackson | |
| 6,634,998 | B2 | 10/2003 | Siaperas | |
| 6,805,409 | B2 * | 10/2004 | Parker | 297/377 |
| 6,908,417 | B2 * | 6/2005 | Jackson | 482/52 |
| 7,044,901 | B2 | 5/2006 | Weir | |
| 7,074,131 | B1 * | 7/2006 | Renaud | 473/219 |
| 7,137,936 | B1 * | 11/2006 | Shaw et al. | 482/127 |
| 7,217,228 | B2 | 5/2007 | Marquez | |
| 7,226,401 | B2 * | 6/2007 | Van Stratten et al. | 482/112 |
| 7,322,907 | B2 * | 1/2008 | Bowser | 482/121 |
| 7,322,909 | B1 * | 1/2008 | Loccarini et al. | 482/129 |
| 7,335,145 | B2 * | 2/2008 | Webber | 482/142 |
| 7,377,886 | B2 * | 5/2008 | Wu | 482/126 |
| 7,410,450 | B1 * | 8/2008 | Paulding | 482/121 |
| 2002/0160891 | A1 * | 10/2002 | Gallagher | 482/123 |
| 2004/0002411 | A1 * | 1/2004 | Jackson | 482/121 |
| 2004/0038786 | A1 * | 2/2004 | Kuo et al. | 482/130 |
| 2005/0020418 | A1 * | 1/2005 | Lin | 482/142 |
| 2005/0032613 | A1 * | 2/2005 | Wehrell | 482/133 |
| 2005/0107226 | A1 * | 5/2005 | Monda | 482/121 |
| 2005/0148449 | A1 * | 7/2005 | Weir et al. | 482/142 |
| 2005/0164855 | A1 * | 7/2005 | Li et al. | 482/142 |
| 2005/0187080 | A1 * | 8/2005 | Bowser | 482/121 |
| 2006/0040808 | A1 | 2/2006 | Riazi | |
| 2006/0046914 | A1 * | 3/2006 | Endelman et al. | 482/142 |
| 2006/0100070 | A1 * | 5/2006 | Abdo | 482/121 |
| 2006/0122043 | A1 * | 6/2006 | Van Straaten | 482/121 |
| 2006/0128540 | A1 | 6/2006 | Engle | |
| 2006/0135329 | A1 * | 6/2006 | Owen | 482/123 |
| 2006/0142129 | A1 * | 6/2006 | Siaperas | 482/142 |
| 2007/0015644 | A1 * | 1/2007 | Aucamp | 482/130 |
| 2008/0051274 | A1 * | 2/2008 | Greene | 482/142 |
| 2008/0076650 | A1 * | 3/2008 | Lay | 482/141 |
| 2008/0119338 | A1 * | 5/2008 | Prsala | 482/142 |
| 2008/0300118 | A1 * | 12/2008 | Wehrell | 482/129 |

* cited by examiner 10
70
110
140
160
66
120
100
80
64
68
67
63
50
60
80
50
120
90
130
50
137
135
139
133
134
132
130
138

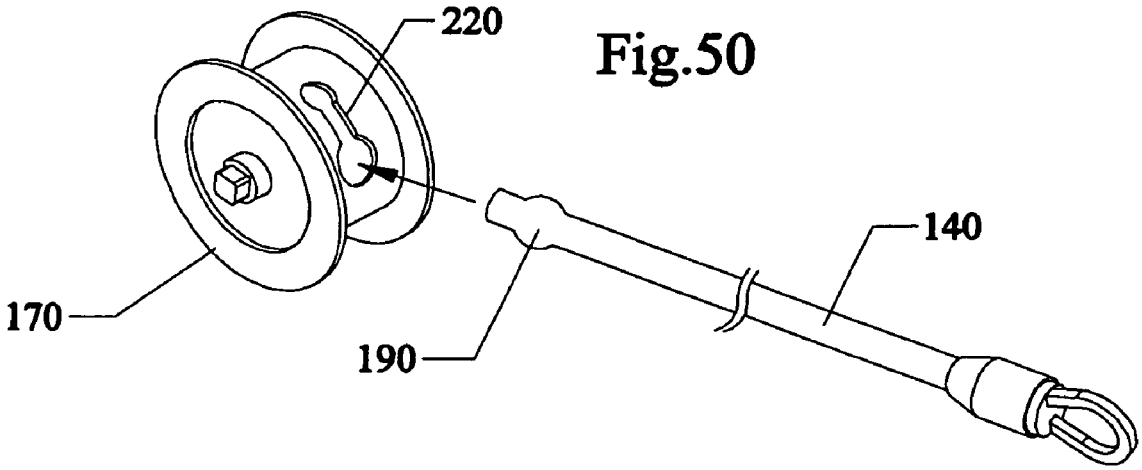
Fig.50
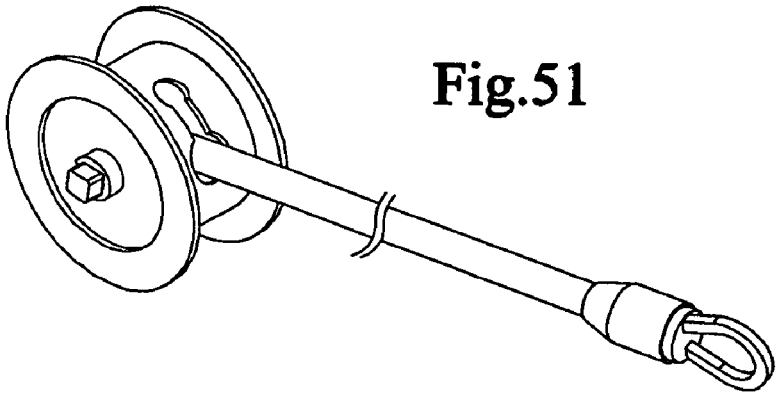
Fig.51
Fig.52
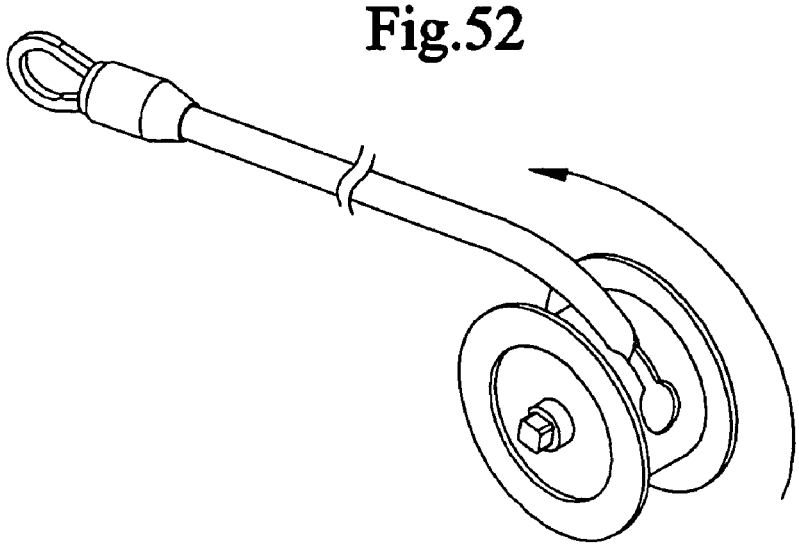

PORTABLE CONVERTIBLE MULTIFUNCTION EXERCISE APPARATUS AND METHOD

This invention relates to exercise equipment, in particular to devices, apparatus, systems and methods for a portable, convertible and multifunction exercise apparatus that allows individuals to accomplish their fitness, health conditioning, weight loss and rehabilitation goals with a single multipurpose device.

BACKGROUND AND PRIOR ART

To date there are many commercially successful exercise devices, apparatuses, and machines to allow individuals to attempt to accomplish their fitness, health, conditioning, weight loss and rehabilitation goals, that are particularly related to aerobic steppers, platforms, resistance band tubing, and multipurpose equipment. While these apparatuses are adequate for their intended use, used separately these devices have limitations, drawbacks and deficiencies in both the number of exercises that can be performed as well as the muscle groups that may be exercised. A discussion of these types of devices will now be described.

Resistance Exercise Bands

Stand-alone elastic resistance bands are currently in mass use in the fitness industry, and are inexpensive, widely known and are used for improved strength, speed, power, and rehabilitation. They are a medically preferred method of training because they avoid undue stress on the joints and connective tissues, the user is free to explore a full range of fluid movement and receive the benefits of positive and negative resistance. Resistance bands or tubing of prior art are currently used alone or attached to a certain anchor point. i.e.: door, platform or housing.

A main disadvantage of resistance bands or tubing of has been the adjustability factor. To change the resistance level the user must separately change the thickness, length and/or connectivity of the tubing, thus causing inconvenience to the user and restricting the diversity of exercises which may be accomplished due to the variables of height, or strength levels and/or length requirements due to the starting point of the exercise. Another disadvantage is the lifespan of such bands, which must be replaced over time.

Aerobic Steps, Platforms, Benches

These types of devices are generally adjustable in height and are mainly used for cardiovascular and lower extremity conditioning, mostly used in class settings. However, with these systems the participant must generally buy and use a separate set of resistance bands or weights to accomplish the necessary degree of intensity required for a limited muscular workout.

U.S. Pat. No. 5,158,512 to Irwin et al. describe an adjustable stepping apparatus marketed worldwide under the name "THE STEP" as an aerobic unit which is height adjustable, and is used mainly for a cardiovascular workout. This device has limited capabilities of varied exercises and does not teach for conversion into a chair or bench. The Irwin device has no teachings and descriptions for attaching resistance bands/tubes and/or weights to the unit. Such weights and/or resistance bands-tubes would not be adjustable and would have to be purchased separately, used separately and stored separately from the Irwin unit.

U.S. Pat. No. 7,044,901 to Weir describes a multi configurable exercise station marketed worldwide under the name (THE DECK). This unit converts from a step to a bench, then a chair, it teaches for storage space. However the Weir device does not teach or describe anyway of attaching fixed adjustable resistance elements such as bands/tubes directly to the unit. Such weights and/or resistance bands-tubes would have to be purchased and used separately from the Weir station.

Multipurpose Equipment

These types of machines and apparatus have generally combined several taught disciplines including steps, weights and/or bars, resistance bands, attachments and benches combined, and have tried to fit the bill of an all in one unit. However, the prior art falls short when it comes to portability, adjustability, functionality, manufacturing costs, space, storage and assembly requirements.

U.S. Pat. No. 6,634,998 to Siaperas describes a portable exercise platform with a boxlike body, with a storage container with a hinged lid cover that flips up to convert into an inclined position. However, Siaperas does not teach for unit to convert with legs into a bench position high enough off the ground so user may assume many standard bench exercises. Siaperas uses clip rings to attach different multi lengths of resistance elements, but does not teach for permanently attached, self contained selectively adjustable resistive elements. With the Siapieras unit a user must stop exercising and get off the unit, taking time to unclip and manually change the resistance by adding or subtracting different resistance bands of different lengths or strengths to the clip. Thus, the Siaperas device is not practical to be easily used.

U.S. Pat. No. 6,558,301 to Jackson describes a platform with a transportable box like body containing a lid for storage, with hook type members to attach resistive elements. However, similar to Siaperas unit, the Jackson device does not describe converting the unit into a bench, and does not describe any types of permanently attached, self contained, selectively adjustable resistance elements. Similar to Siaperas, this device also requires the user to stop exercising and get off the unit, which takes time to unclip and manually change the resistance by adding or subtracting different resistance bands of different lengths or strengths to the clip. Thus, the Jackson unit is also not practical to be easily used.

U.S. Patent Application Publication 2006/0128540 to Engle describes a multi function exercise platform marketed worldwide under the name (MY GYM). Engle shows a portable exercise platform with fixed attached resistance tubes of several different diameters to allow for adjustment of strength, with permanently attached bands contained within the platform housing.

However this apparatus is deficient in several manners. Engle does not allow for converting the platform to a bench or a chair, which limits the exercises that are capable of being preformed from other upright positions. This devices does not allow for self contained storage for bar & handle attachments. To change resistance in strength, the user also must stop the exercise, get off unit, open the attachment clips and add additional tubes of different diameters and strengths to the clip rings located on the outside of the body chamber.

Engle also does not allow for a selectable adjustment in length of the resistance tubes which is necessary for selectable range of resistance due to the height differences of the user and starting point required for some exercises, which restricts the exercises as well as the force needed to exert during the exercises. The resistance tubes permanently contained within the housing are not replaceable by the user once their lifespan has run out. Typical resistance tubes can have an average life span with normal use of about 1 year, due to conditions of being worn-out, overstressed, damaged, torn, dry, etc. Thus, once the lifespan of the tubes runs out, the Engle unit can become unsafe, useless and potentially dangerous to subsequent users.

Thus, the need exists for solutions to the above problems, deficiencies and shortcomings with the prior art.

SUMMARY OF THE INVENTION

A primary objective of the present invention is to provide a portable, convertible and multifunction exercise device, apparatus, system and method of use that combines the benefits of a stepper, bench, and resistance bands, into a multifunction gym, while overcoming the deficiencies and drawbacks of using each of these devices separately.

A secondary objective of the present invention is to provide a new and improved, uniquely engineered, versatile, low cost, portable, convertible and multifunction exercise device, apparatus, system and method of use that combines the benefits of a stepper, bench, resistance bands, into a multifunction gym.

A third objective of the present invention is to provide a portable, convertible and multifunction exercise device, apparatus, system and method of use, in a safe, sturdy, lightweight, portable, self contained unit capable of being used to perform a total body workout regime to encompass all muscle groups, arms, legs, shoulders, back, chest, hips, and abdominals.

A fourth objective of the present invention is to provide a portable, convertible and multifunction exercise device, apparatus, system and method of use for allowing a configurable, and transformable apparatus to convert from a step to a incline bench/chair which allows users to perform exercises in standing, sitting, kneeling, bending, squatting, or lying down, positions.

A fifth objective of the present invention is to provide a portable, convertible and multifunction exercise device, apparatus, system and method of use platform that can be used in conjunction with self contained resistance elements having selectable visibly marked variable increment levels of resistance.

A sixth objective of the present invention is to provide a portable, convertible and multifunction exercise device, apparatus, system and method of use that allows the user to selectively alter length of resistance elements, while in the operative position, without disembarking off the unit thus allowing the user rapid succession of exercise without any changeover of additional band lengths or strengths, thru a lockable plunger and reel system.

A seventh objective of the present invention is to provide a portable, convertible and multifunction exercise device, apparatus, system and method of use invention that has the versatility of multiple stations that can be used laterally or unilaterally, vertical or horizontal, dependent or codependent, and can be used by one or two persons at the same time, depending on the use of connective handles, bars, and attachments provided.

An eighth objective of the present invention is to provide a portable, convertible and multifunction exercise device, apparatus, system and method of use invention that can use accessory equipment such as but not limited to connective handles, bars, attachments, and the like, that can be conveniently stored within a storage compartment of unit itself.

A ninth objective of the present invention is to provide a portable, convertible and multifunction exercise device, apparatus, system and method of use invention that allows the user to replace resistance elements as required on an as needed basis, due to their limited lifespan. The lifespan of the resistance elements running out due to their being worn, torn, damaged, frazzled, frayed, dry, overstressed, or brittle, and the like.

A tenth objective of the present invention is to provide a portable, convertible and multifunction exercise device, apparatus, system and method of use invention that is collapsible for storage underneath a bed or closet or other convenient location.

An embodiment of the portable, convertible and multifunction exercise apparatus, can include a rectangular platform having a front end, a rear end, a left side and a right side, an elongated resistive band having a proximate end and an outer end, a length adjusting member for attaching the proximate end of the elongated resistive member to the rectangular platform, the length adjusting member for selectively controlling the length of at least one elongated resistive band.

The apparatus can have a pair of elongated resistive bands extending from one end or side of the platform. The apparatus can have a second pair of elongated resistive bands extending from an opposite end or opposite side of the platform.

The length adjusting member can be a rotatable wheel The length adjusting member can be a spring biased rotatable wheel which allows the proximate end of the elongated band to automatically be biased to roll up onto the wheel, so that pulling out the band pulls against a spring.

The apparatus can further include a pin or a spring loaded plunger for locking the wheel in a fixed position while the band has been pulled out to a desired and selected longitudinal length.

The wheel can also have a plurality of slots about a side wall of the wheel for allowing the pin or the protruding tip end of the plunger to be positioned therein locking the wheel in position.

The wheel can also have a keyhole slot having a large opening adjacent to a narrow opening, the large opening for allowing an enlarged portion on the proximate end of the band to be inserted and locked in place when being slid into the narrow opening, and the keyhole slot allowing for the band to be easily removed and replaced.

The apparatus can also have a central tubular member having a rotatable exterior surface portion, a left member having a left band attachment portion, the left member extending from a left end of the central tubular member, the left attachment portion being removable attachable to a left elongated resilient band that is also attached to a portion inside of the platform, a right member having a right band attachment portion, the right member extending from a right end of the central tubular member, the right attachment portion being removably attachable to a right elongated resilient band that is also attached to another portion inside of the platform, wherein the central tubular member being rotatable relative to the left member and the right member.

The apparatus can have an elongated member having extendable ends, wherein each of the extendable ends are connected to resistive bands that are connected to the platform.

The platform can also have at least one pair of foldable legs for converting the platform from a stepper to bench.

An interior storage compartment can be located on the platform for storing accessory items inside the platform.

The platform can also have a raisable lid which converts the platform to an inclined chair.

The platform can also have wheels for allowing the platform to be portable.

A method of using a portable, convertible and multifunction exercise apparatus for different exercises, can include the steps of providing a rectangular platform, providing an elongated resistive band with a proximate end, an outer end and a length therebetween, attaching the proximate end of the elongated resistive band to an inside portion of the platform, and selectively adjusting the length of the elongated resistive member for different exercises between a longer length having less resistance to a shorter length having more resistance.

The length adjusting can be accomplished by rolling and unrolling the proximate end of the band on a wheel, such as a spring biased wheel inside of the platform. The method can also include the step of locking the band at selected lengths while portions of the band are rolled about the wheel inside of the platform.

Further objects and advantages of this invention will be apparent from the following detailed description of the presently preferred embodiments which are illustrated schematically in the accompanying drawings.

BRIEF DESCRIPTION OF THE FIGURES

FIG. 45A is a top view of FIG. 45 along arrow 45Y with spring plunger locked in.

FIG. 50 is a perspective view of hub with resistance band to be installed.

FIG. 51 is another view of the hub of FIG. 50 with an installed resistance band.

FIG. 52 is still another view of the hub of FIGS. 50-51 with installed band.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of the components is described below.

Figure 1:
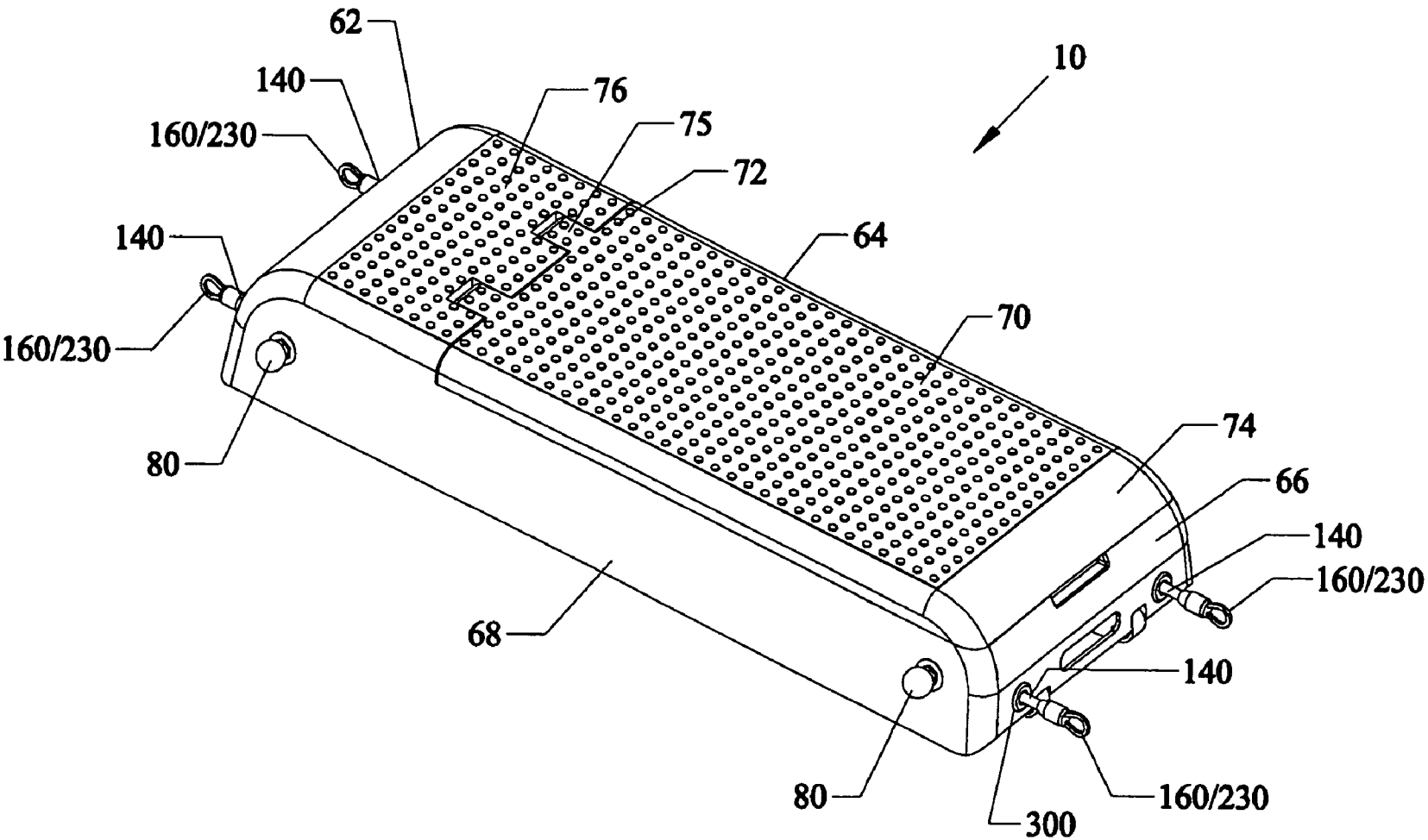
FIG. 1 is a top perspective view of the novel portable, convertible, multifunction exercise apparatus
Figure 2:
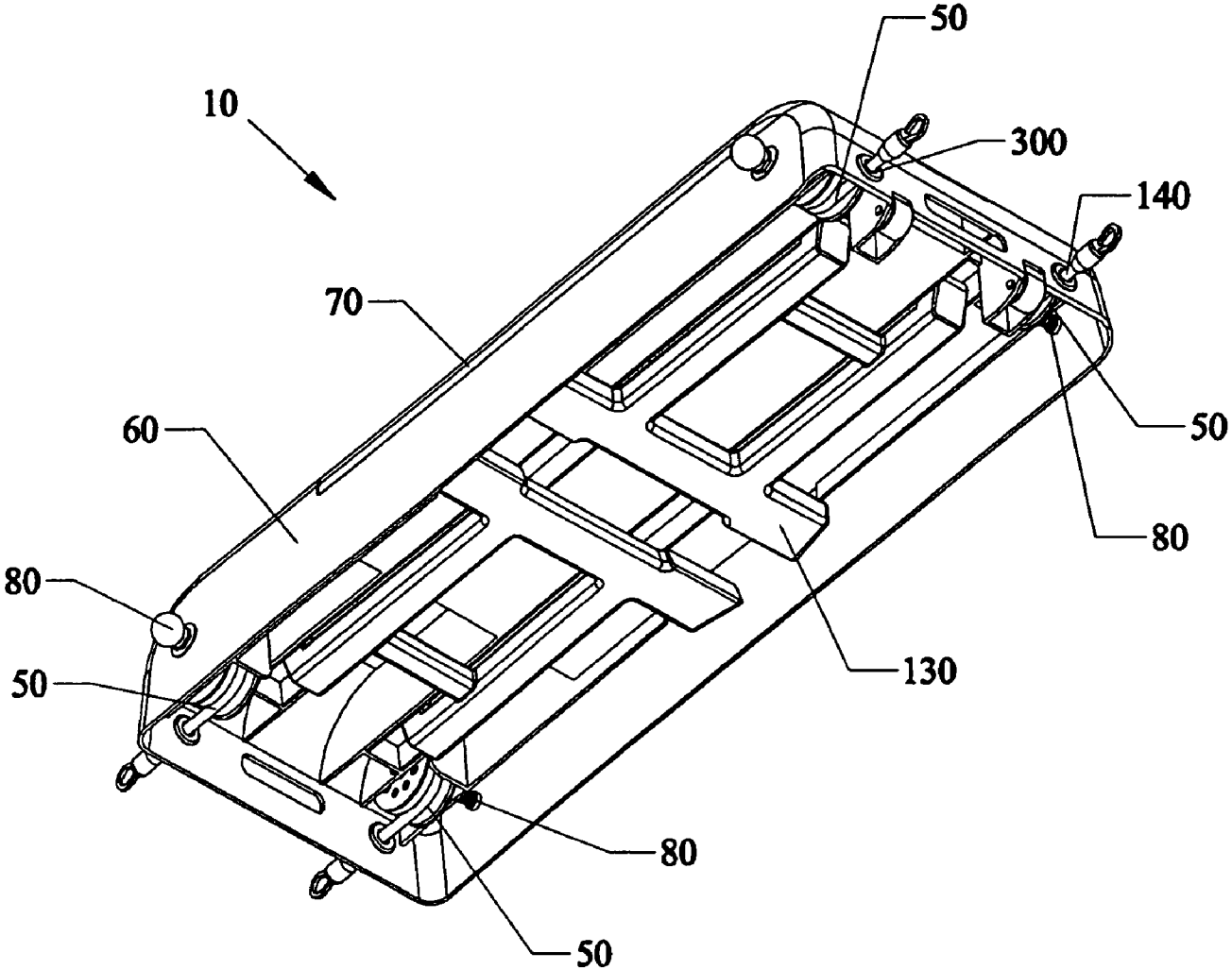
FIG. 2 is a bottom perspective view of the apparatus of FIG. 1.
Figure 3:
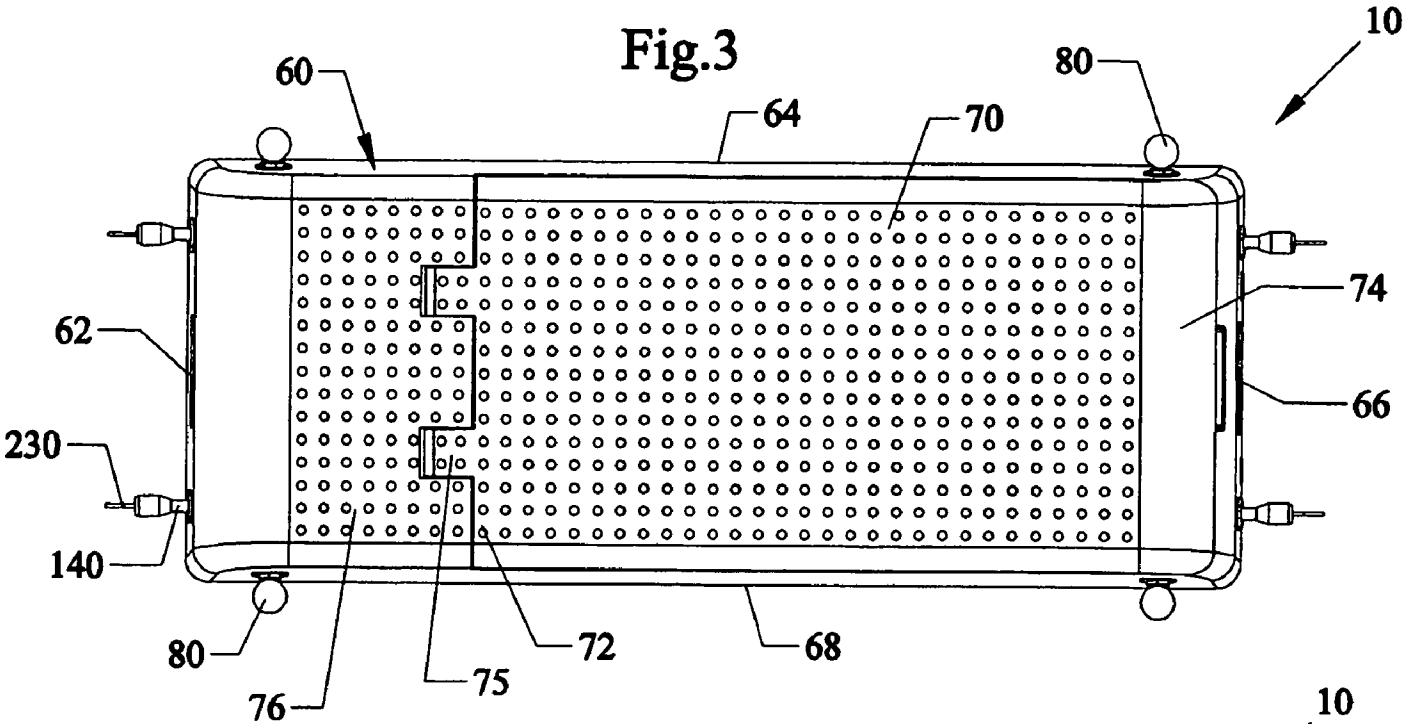
FIG. 3 is a top view of the apparatus of FIG. 1.
Figure 4:
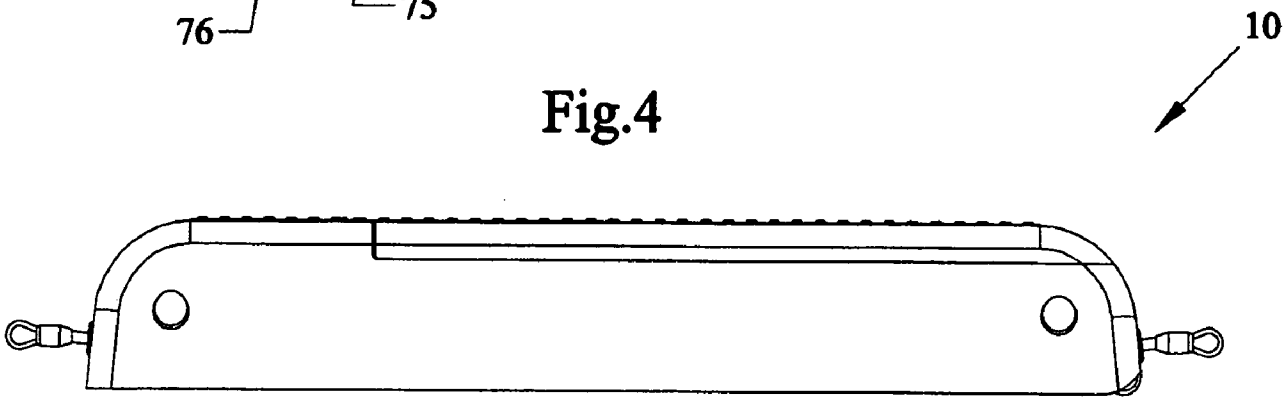
FIG. 4 is a front view of the apparatus of FIG. 1.
Figure 5:
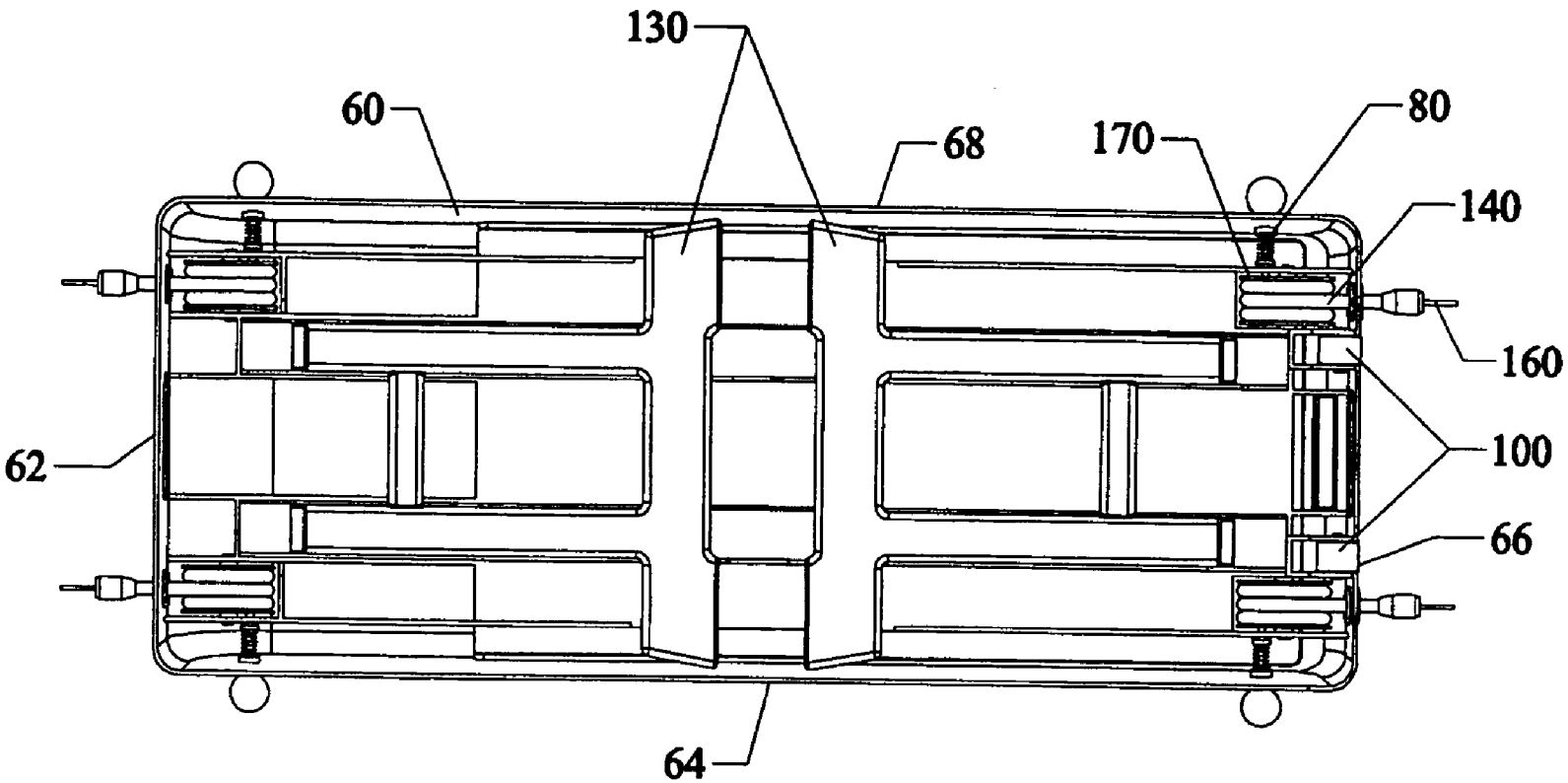
FIG. 5 is a bottom view of the apparatus of FIG. 1.
Figure 7:
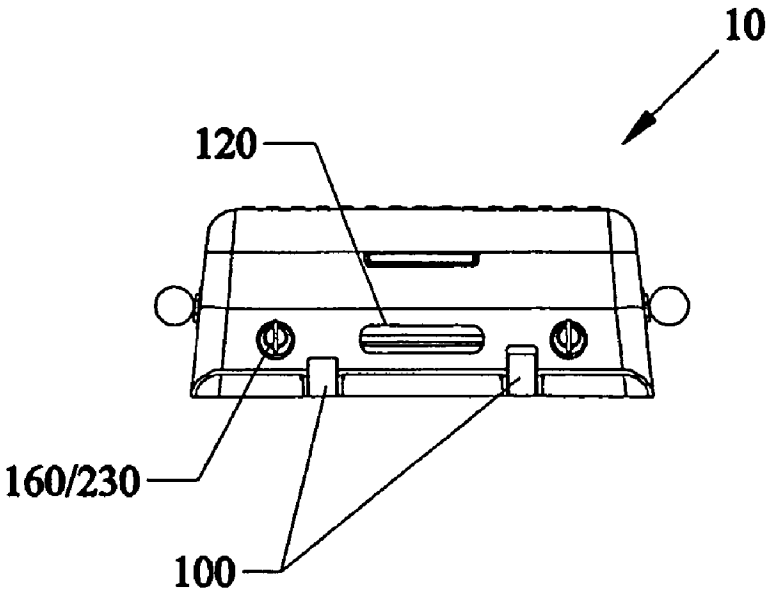
FIG. 7 is a right view of the apparatus of FIG. 1.
Figure 6:
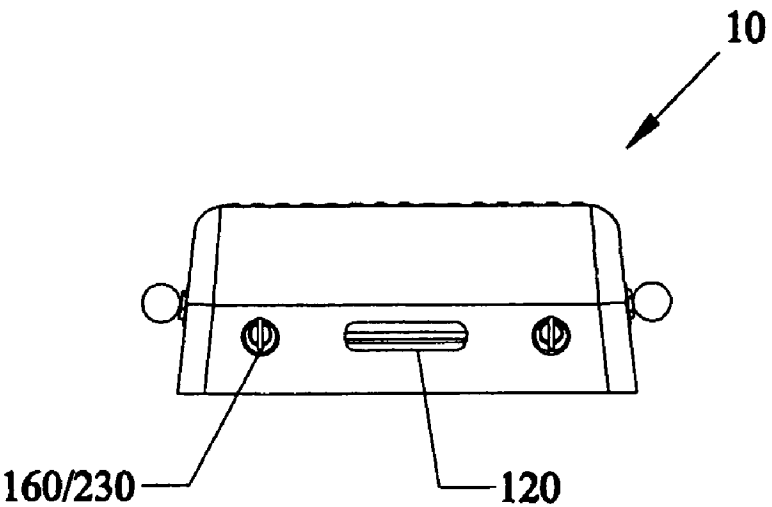
FIG. 6 is a left view of the apparatus of FIG. 1.

10. Platform
20. Bar Assembly
22. left exposed outer end
23. flat topped cylindrical opening
25. inner tube
28. right exposed outer end
29. flat topped cylindrical opening
30. Handle
32. Hollow pipe end
33. upper hole
38. capped end
34. gripping wrap tube
40. Strap
44. main horseshoe portion
45. hook and loop outer surface
46. one end 46
50. Tension Hub Assembly
60. Base
62. left end wall
63. rear end channel with inner ribs
64. rear wall
65. hole
66. right end wall
67. upper front end channel with inner ribs
68. front end wall
70. Backrest/Lid
72. base of backrest/lid
73. receiving groove
75. hinge for backrest/lid
74 upper end/right end of backrest/lid
76. nonmovable seat base
80. Spring Plunger
82. ball shaped handle
88. protruding tip
90. Stabilizer Beam
100. Roller wheels
110. Backrest Support Bar
112. T-shaped bottom
118. pivoting upper end
120. Lifting Handle
130. Dual Legs
132, 134 two vertical leg members
133, 135 L-shaped upper ends
136. lower cross-member
137, 139 pivot points
140. Resistance Bands
150. Strength Marking
160. Fastening Loop
170. Hub Housing
180. Axle
190. Retention Ball
200. Coil Spring
210. Spring Cover
220. Retention Slot
230. Fastening Hook
236. loop end
238. Attachment belt
240. Diameter adjusting strap (Velcro®)
245. hook and loop surface
250. Backrest Adjustment Slots
260. Extendable Bar Ends/Adjustable Extension Bar
263. length adjusting holes
266. outer end
267. depressible upwardly spring biased pin
270. Extension Bar Latch Button
272. Press portion with raised surface edging (overlies spring)
275. pivoting portion
278. latch portion with lower protruding pin
280. Free Rotating Grip Tube
290. Hub Lock Holes
300. Resistance Band Egress Hole.
310. Coil Spring retaining slot in Axle (#180)
320. Coil Spring retaining tab on Hub (#170)
330. Knuckle on Coil Spring for retention
340. Tab on Coil Spring for retention
350. Square Cutout in Base wall to retain Axle (#180).
352. base wall Platform with Legs Retracted FIG. 1 is a top perspective view of the novel portable, convertible, multifunction exercise apparatus platform 10 with dual legs 130 in closed position for a floor engaging platform position. FIG. 2 is a bottom perspective view of the apparatus 10 of FIG. 1. FIG. 3 is a top view of the apparatus 10 of FIG. 1. FIG. 4 is a front view of the apparatus 10 of FIG. 1. FIG. 5 is a bottom view of the apparatus 10 of FIG. 1. FIG. 6 is a left view of the apparatus 10 of FIG. 1. FIG. 7 is a right view of the apparatus 10 of FIG. 1.

Referring to FIGS. 1-7, the apparatus 10 can initially have a platform floor engaging position. The platform 10 can have a generally rectangular shape having a base 60 with short left and right left and right end walls 62, 66 and longer front and rear walls 64, 68, and a top surface having a nonmovable seat portion 76 and initially horizontal backrest 70, both of which can have raised dimples so as to form a nonslip surface for the user. Alternatively, a recessed area on the upper surface of the platform can include a pad formed from but not limited to rubber, elastomers, foam, plastic, and the like. The platform 10 can be molded into a single structured element of plastic or other materials.

Extending out from two egress holes 300 in the left end wall 62 can be elastic bands (elongated resistive bands) 140 each have an outer end attached to either a fastening loop 160 or a fastening hook 230. Likewise extending out from two egress holes 300 in the right end wall 66 can be additional elastic bands (elongated resistive bands) 140 each have an outer end attached to either a fastening loop 160 or a fastening hook 230. The platform 10 can have a total of four elastic bands (elongated resistive bands) that can be length adjustable relative to the base 60. More or less bands can be used as needed. For example, pairs of bands can be connected through different locations through other egress holes on sides as well as the ends of the platform 10.

Each of the four elastic bands can be adjusted in length individually by spring plunger(s) 80 by rotatable tension hub assembly (50) and hub 170, which will be described in greater detail in reference to FIGS. 42-52.

Two rollers (wheels) 100 can be rotatably attached beneath the left end wall 66 of the base 60 to allow the platform 10 to be portable and roll on floor/ground surfaces when the right end wall is raised and being dragged by lifting handle 120.

Raised Bench Position

Figure 8:
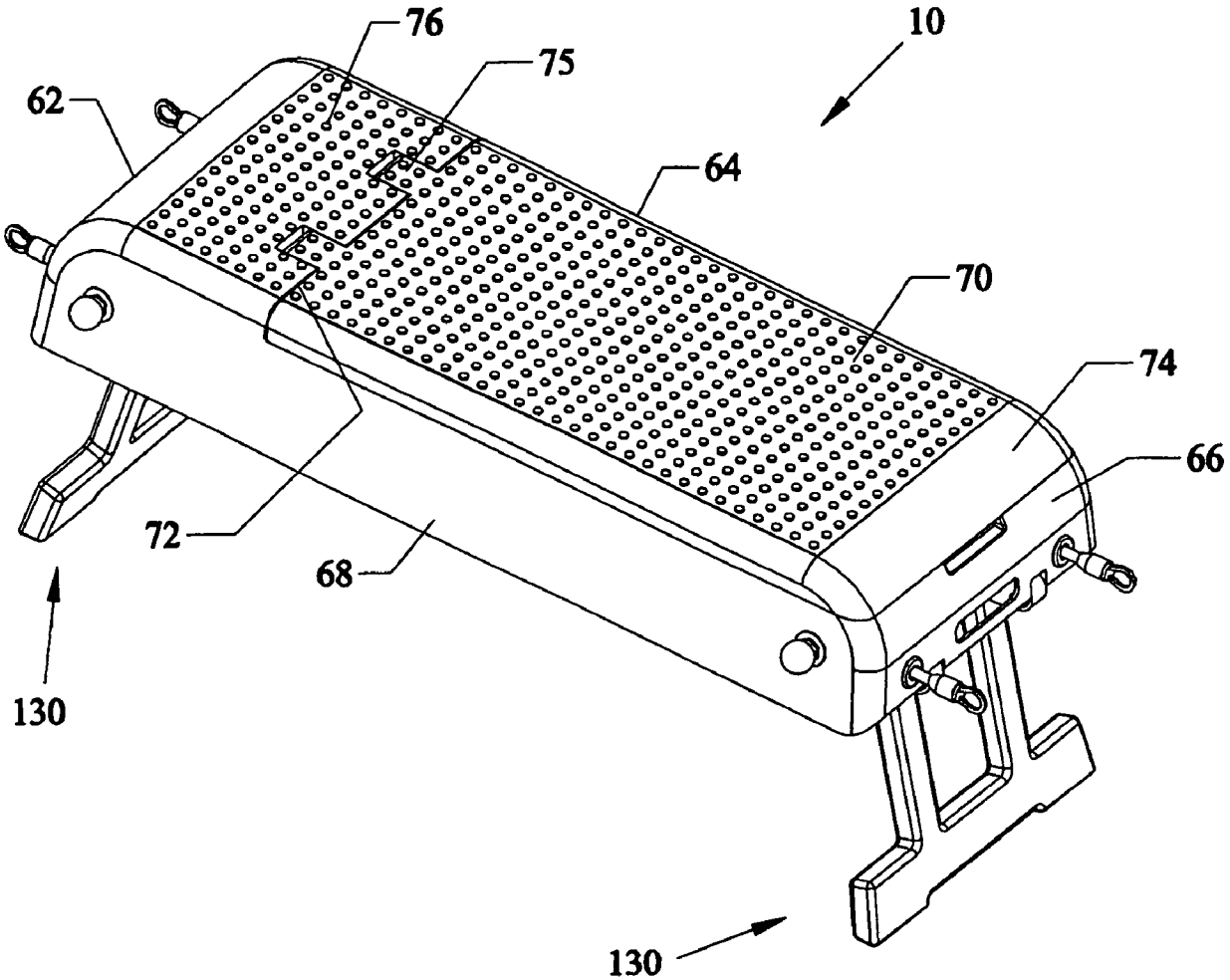
FIG. 8 is a top perspective view of the apparatus of FIG. 1 with legs opened to a bench position.
Figure 9:
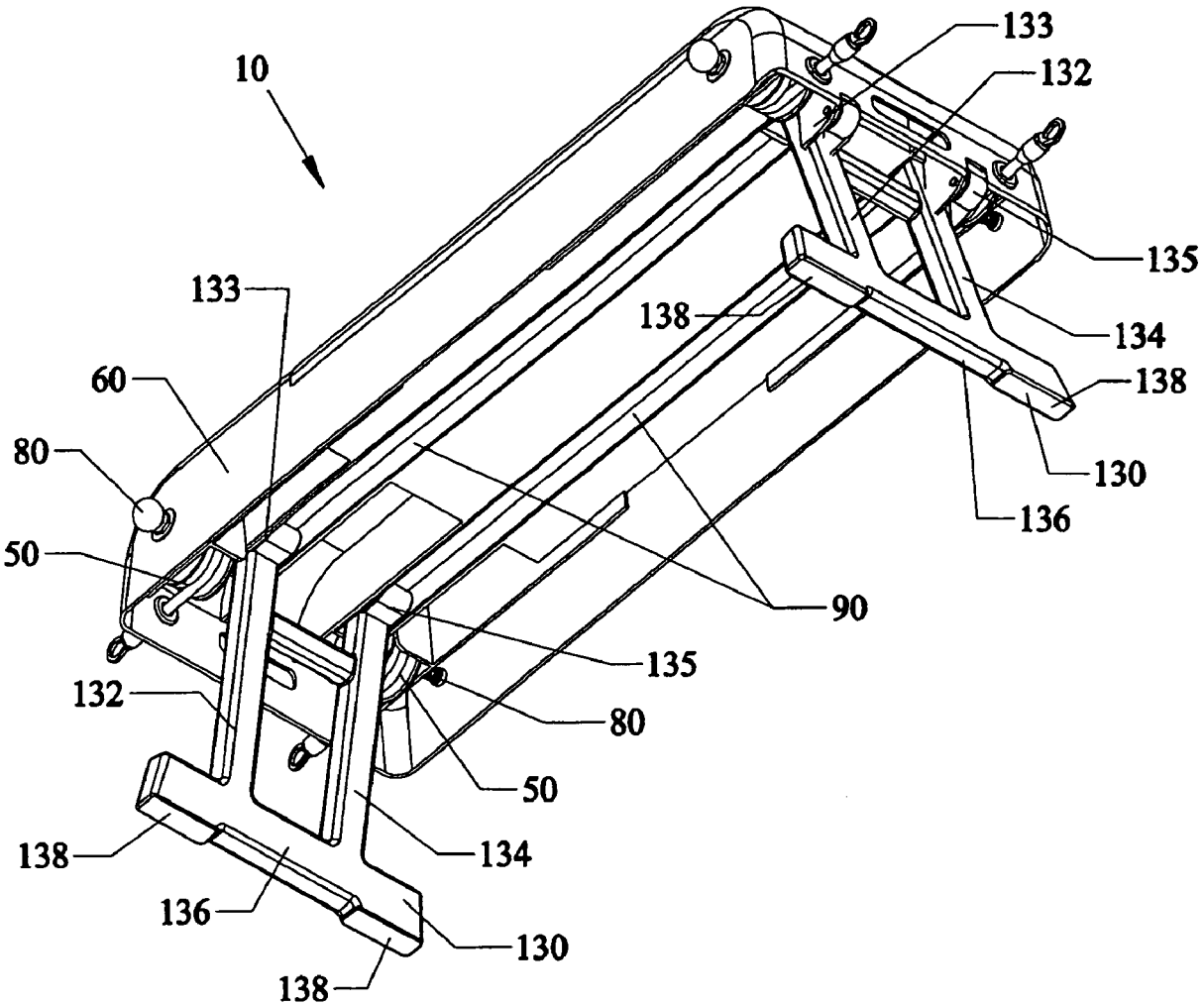
FIG. 9 is a bottom perspective view of the apparatus of FIG. 9 with legs open.
Figure 10:
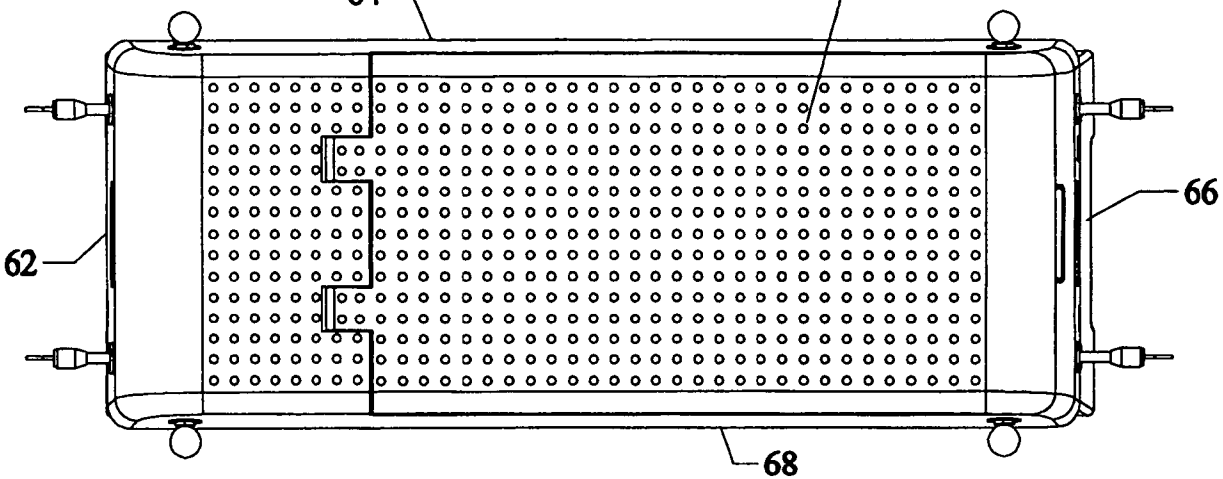
FIG. 10 is a top view of the apparatus of FIG. 9 with legs open.
Figure 11:
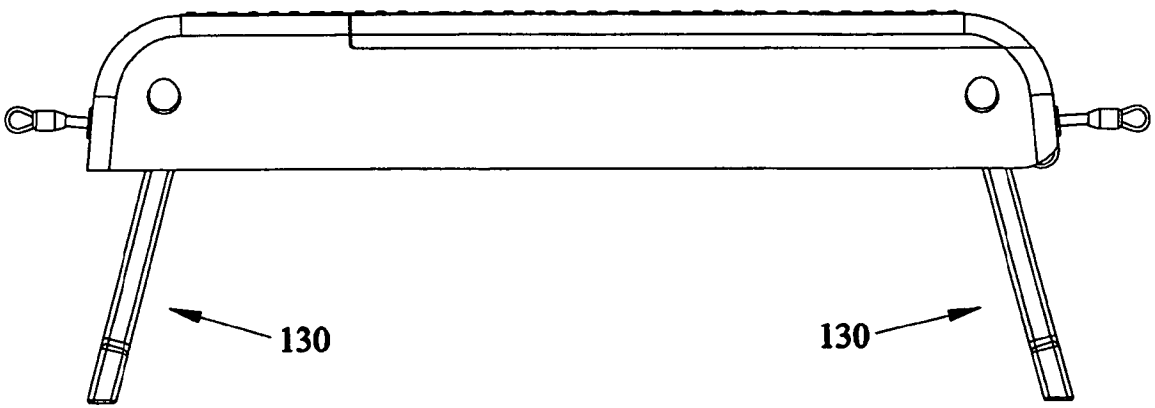
FIG. 11 is a front view of the apparatus of FIG. 9 with legs open.
Figure 12:
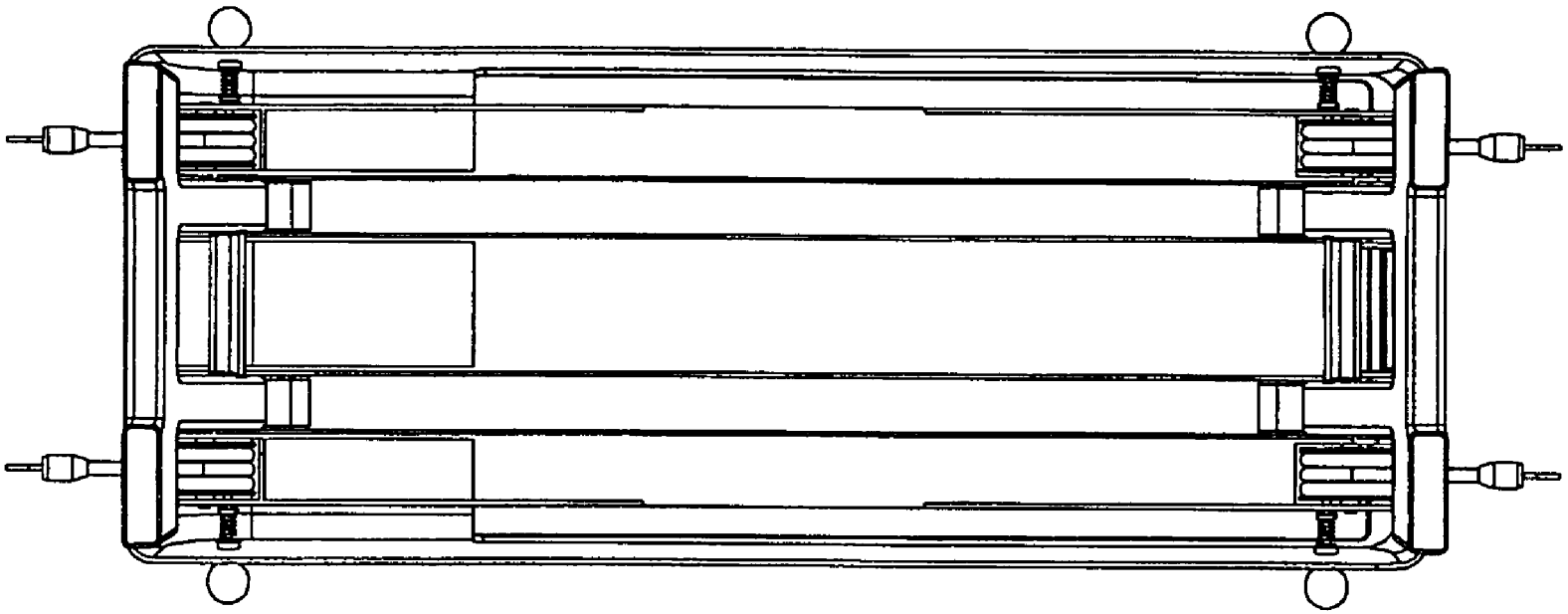
FIG. 12 is a bottom view of the apparatus of FIG. 9 with legs open.
Figure 14:
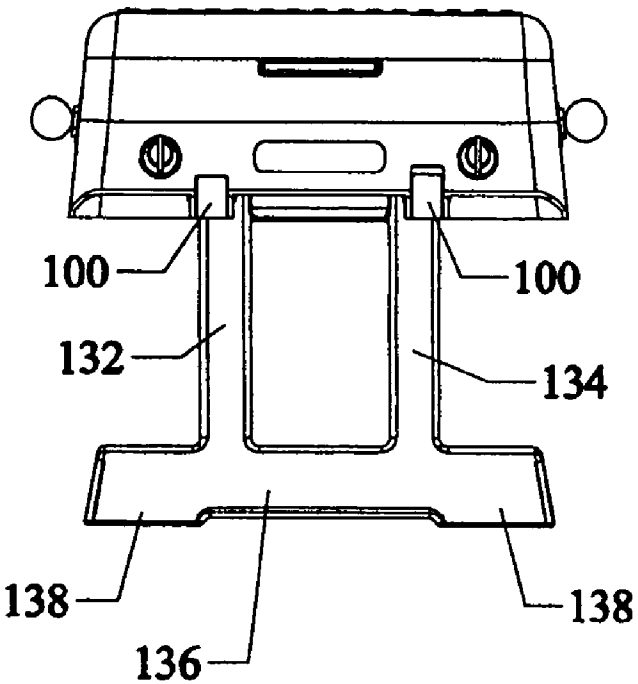
FIG. 14 is a right view of the apparatus of FIG. 9 with legs open.
Figure 13:
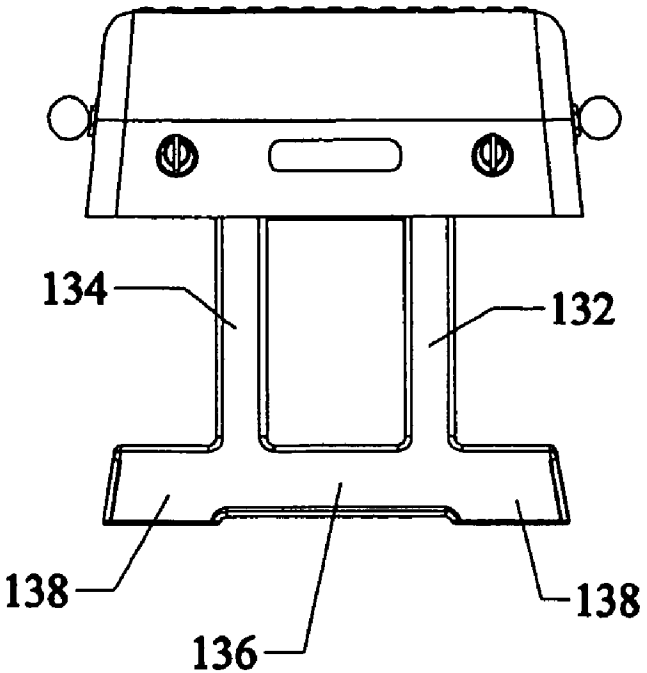
FIG. 13 is a left view of the apparatus of FIG. 9 with legs open.

FIG. 8 is a top perspective view of the apparatus 10 of FIG. 1 with dual legs 130 opened to a raised bench position. FIG. 9 is a bottom perspective view of the apparatus 10 of FIG. 9 with dual legs 130 open. FIG. 10 is a top view of the apparatus 10 of FIG. 9 with legs open. FIG. 11 is a front view of the apparatus 10 of FIG. 9 with legs 130 open. FIG. 12 is a bottom view of the apparatus 10 of FIG. 9 with legs 130 open. FIG. 13 is a left view of the apparatus 10 of FIG. 9 with legs 130 open. FIG. 14 is a right view of the apparatus 10 of FIG. 9 with legs open.

Referring to FIGS. 1-14, 22, and 23 each of the dual legs 130 has two vertical leg members 132, 134 with L-shaped upper ends 133, 135 that are pivotally attached by pivot points 137, 139 within stabilizer beams 90 underneath the base 60 of the apparatus 10. The vertical leg members 132, 134 have a lower cross-member base 136 with lower protruding portions 138 which when the legs 130 are folded down raise the cross-member base 136 above the floor surface. As shown in FIGS. 1-7, the dual legs 130 can be initially folded toward one another and can be fully enclosed within base walls 62, 64, 66, 68. In an open position (as shown in FIGS. 8-14) the dual legs 130 bow outward to form a stable support to allow the apparatus to be used as a bench for the exercises to be described below. In the open position, the L-shaped upper ends 133, 135 can have flat upper surfaces which acts as a knuckle-stop to abut against inner roof surfaces of stabilizer bars 90, providing a weight stabilized support for the platform 10.

Inclined Chair Position

Figure 15:
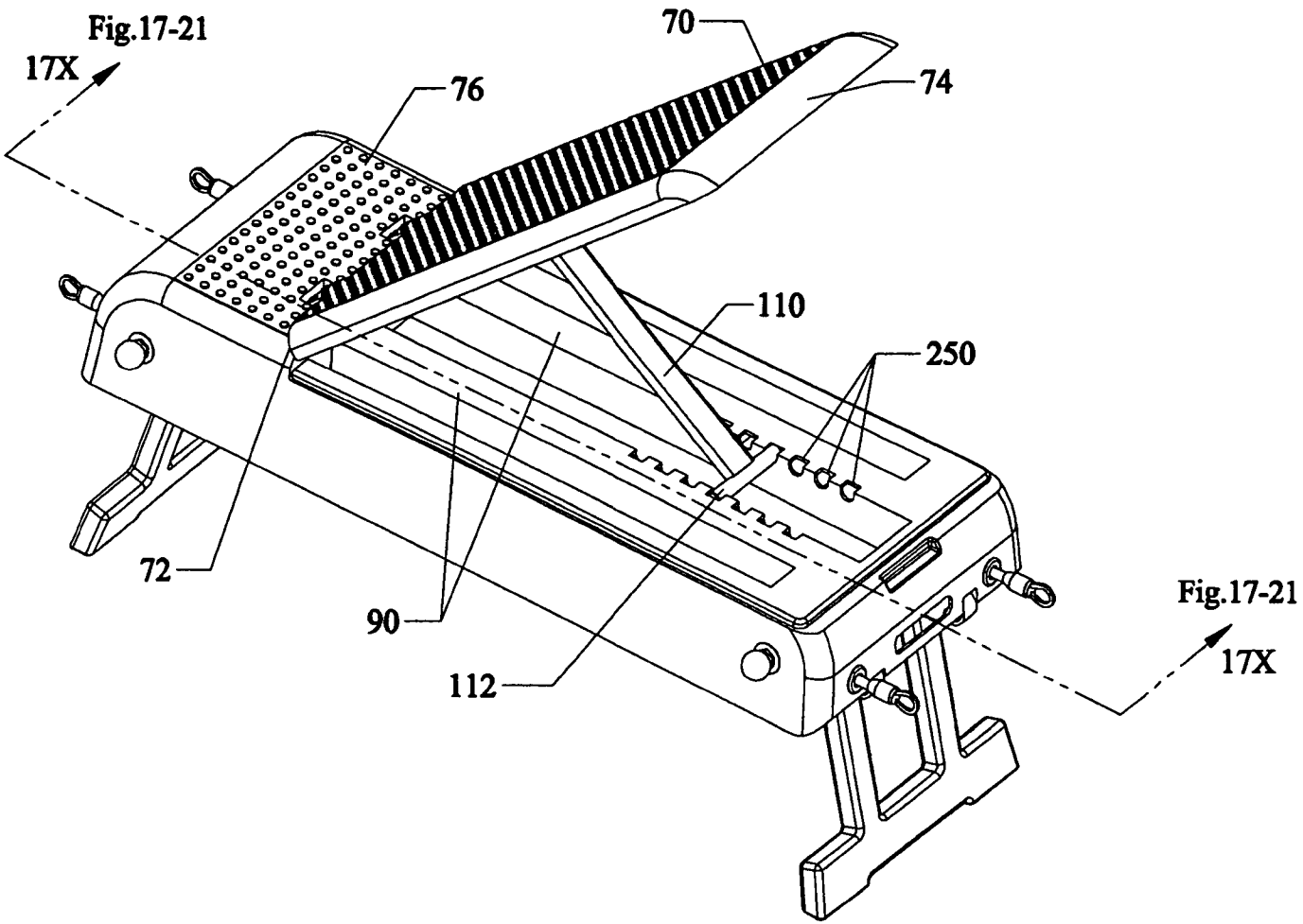
FIG. 15 is a top perspective view of the apparatus of FIG. 1 storage lid open to transform the bench to an inclined chair position with an inclined backrest.
Figure 16:
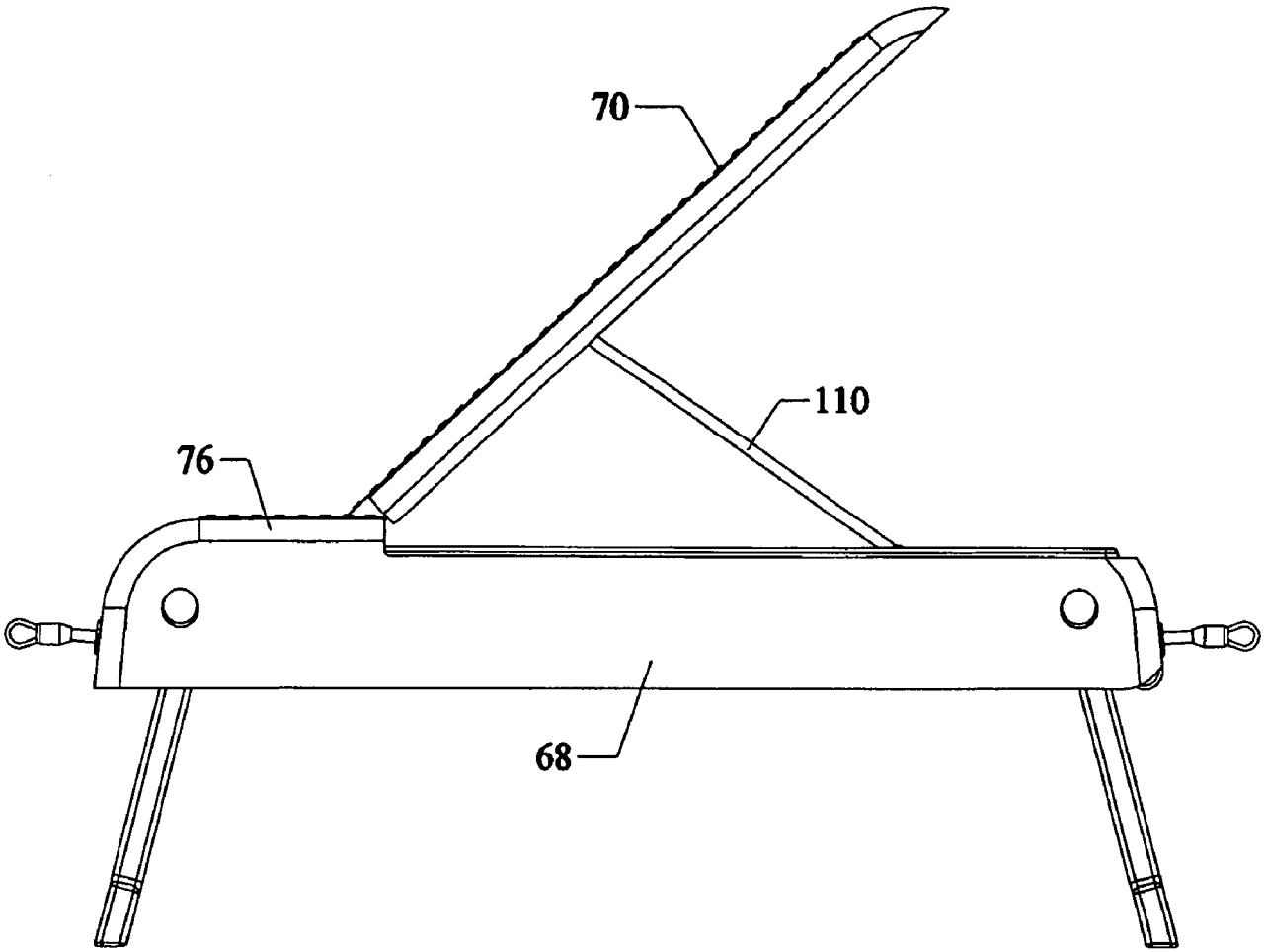
FIG. 16 is a side view of the apparatus of FIG. 15 with lid open to an inclined position.
Figure 17:
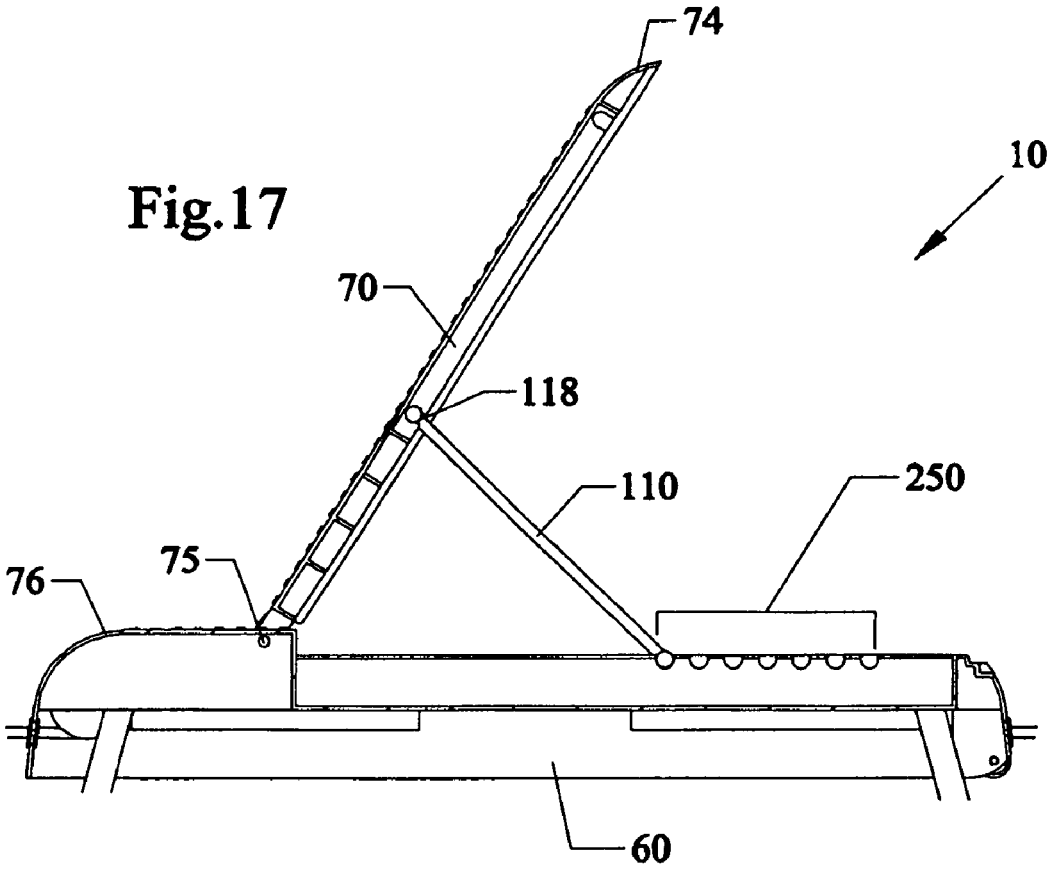
FIG. 17 is a cross-sectional view of the apparatus of FIG. 15 along arrows 17X in an up most inclined position.
Figure 18:
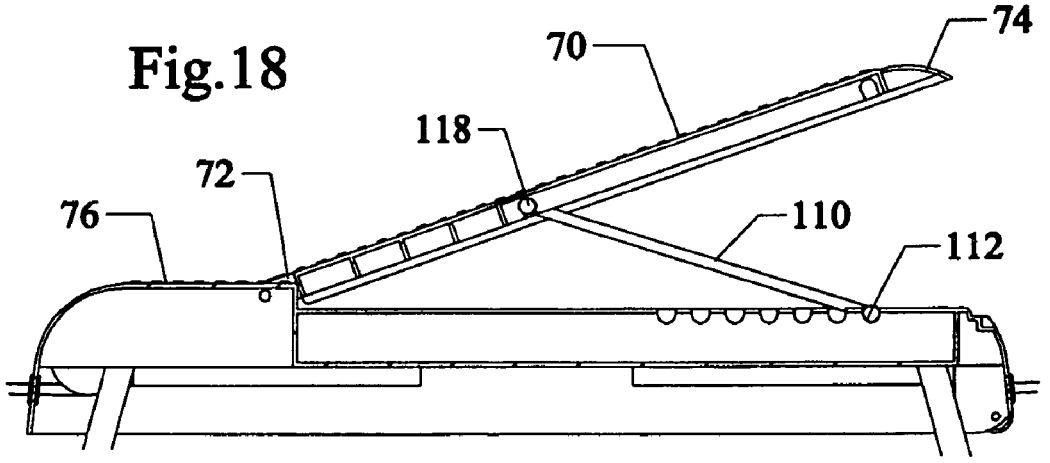
FIG. 18 is another view of FIG. 17 with backrest at an extended inclined position.
Figure 19:
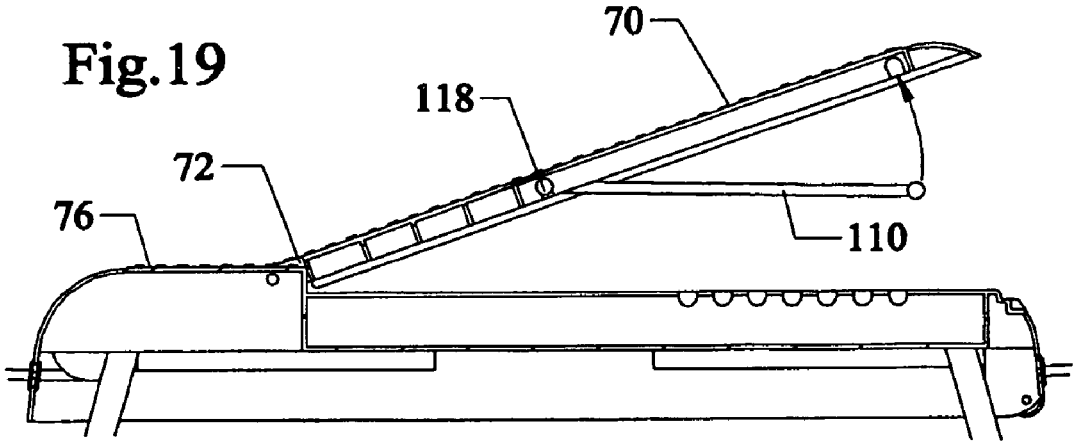
FIG. 19 is another view of FIG. 17 with backrest support bar rotating to storage position.
Figure 20:
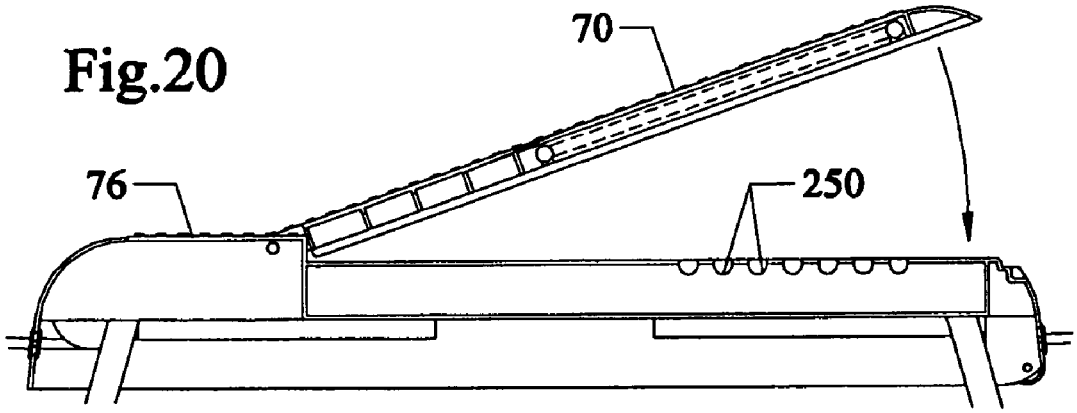
FIG. 20 is another view of FIG. 19 with backrest support bar in storage position.
Figure 21:
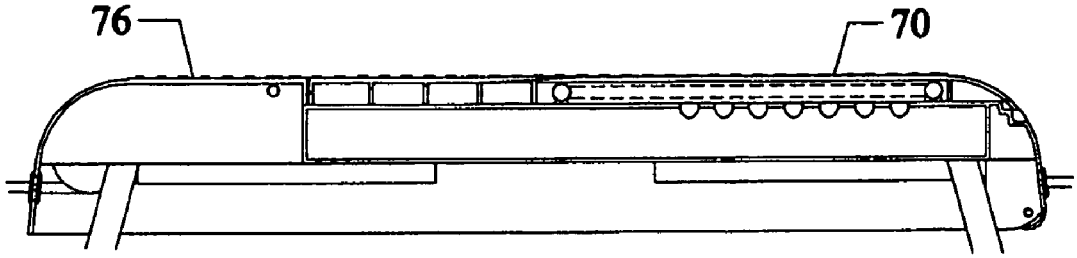
FIG. 21 is another view of FIG. 19 with lid in closed position on platform.

FIG. 15 is a top perspective view of the apparatus 10 of FIG. 1 storage lid 70 open to transform the bench (of FIGS. 8-14) to an inclined chair position with an inclined backrest 70. FIG. 16 is a side view of the apparatus 10 of FIG. 15 with lid 70 open to an inclined position. FIG. 17 is a cross-sectional view of the apparatus of FIG. 16 with up most inclined position. FIG. 18 is another view of FIG. 17 with backrest 70 at an extended inclined position. FIG. 19 is another view of FIG. 17 with backrest support bar 110 rotating to storage position. FIG. 20 is another view of FIG. 19 with backrest support bar 110 in storage position. FIG. 21 is another view of FIG. 19 with lid 70 in closed position on platform 10.

Referring to FIGS. 15-21, the backrest/lid 70 can rotate upward by hinge 75 relative to nonmovable seat base 76, and held in place at a selected inclined angle by backrest support bar 110. The upper end 118 of backrest support bar 110 can be pivotally attached to a midportion beneath the lid/backrest 70. The bottom portion can have a T-shape 112 that allows the backrest support bar 110 to be positioned in individual pairs of the backrest adjustment slots 250 to adjust the angle of incline of the lid/backrest 70. Moving the support bar 110 up against the lower surface face of the lid/backrest 70 into snappable U-shaped receiving groove 73, allows the lid/backrest to be turned back into a bench configuration as shown in FIG. 21.

Figure 22:
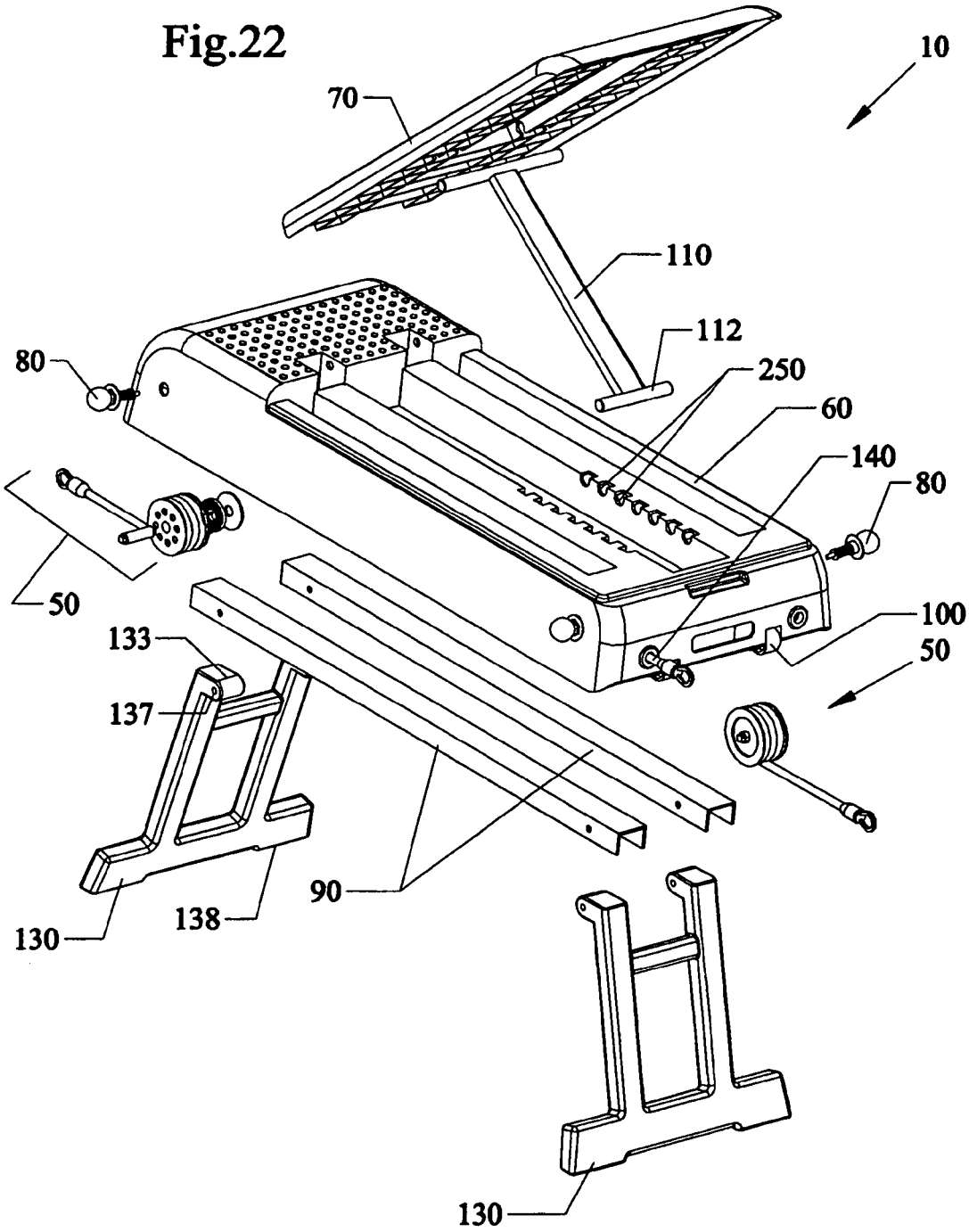
FIG. 22 is a top exploded view of the components of the apparatus of preceding figures.
Figure 23:
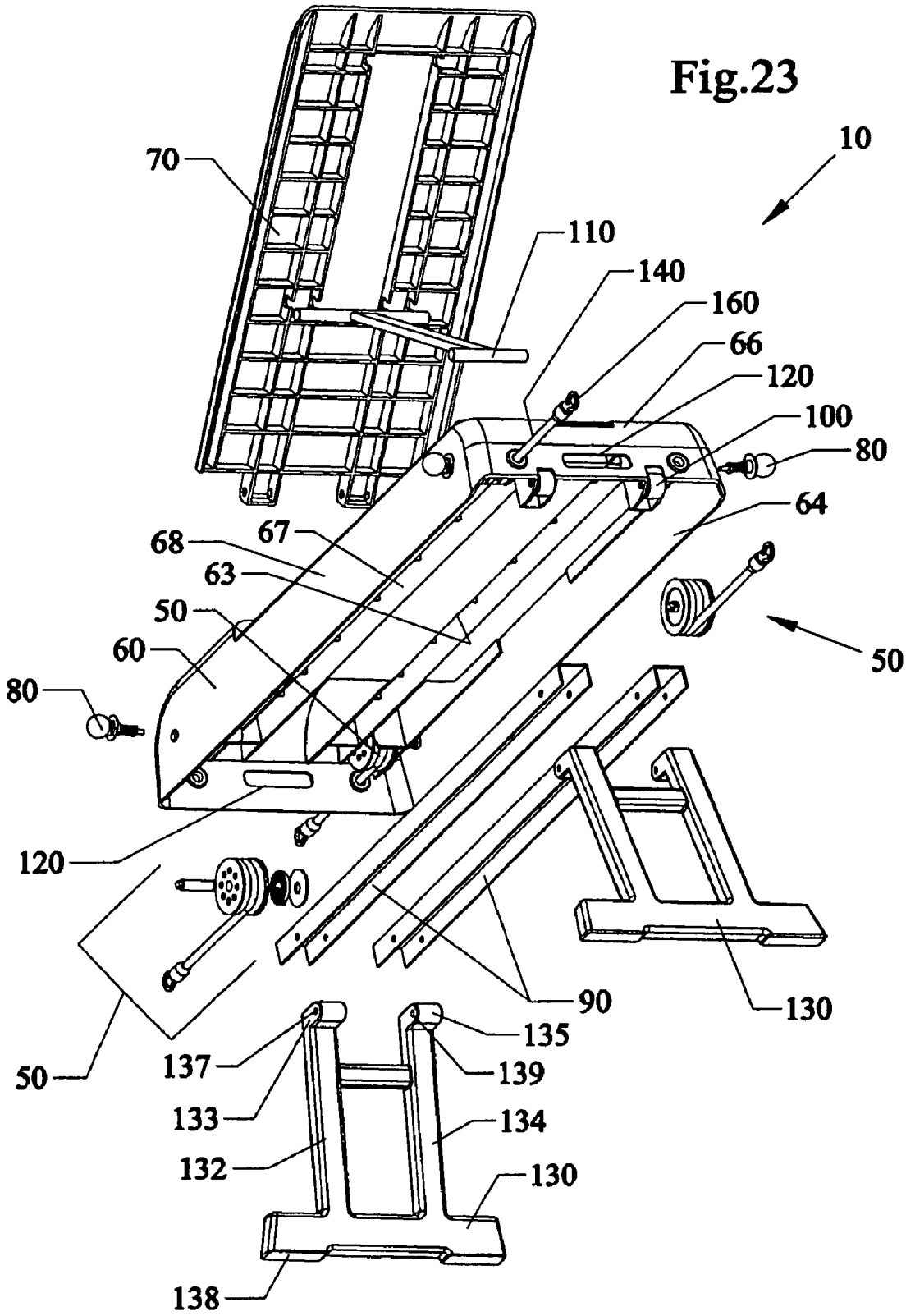
FIG. 23 is a bottom exploded view of the apparatus components of FIG. 22.

FIG. 22 is a top exploded view of the various components of the apparatus of the preceding figures. FIG. 23 is a bottom exploded view of the various apparatus components of FIG. 22. Stabilizer beams 90 attach to base 60 by snapably fitting into parallel channels 63, 67, each having inner rib tabs which allow for a tight fit. Channels 63, 67 are preferably molded into base 60 with the other components for the platform 10 being separately attachable to the base 60 as further described herein. Thus, all components other than the base 60 can be separately manufactured.

Bar Assembly

Figures 24, 25:
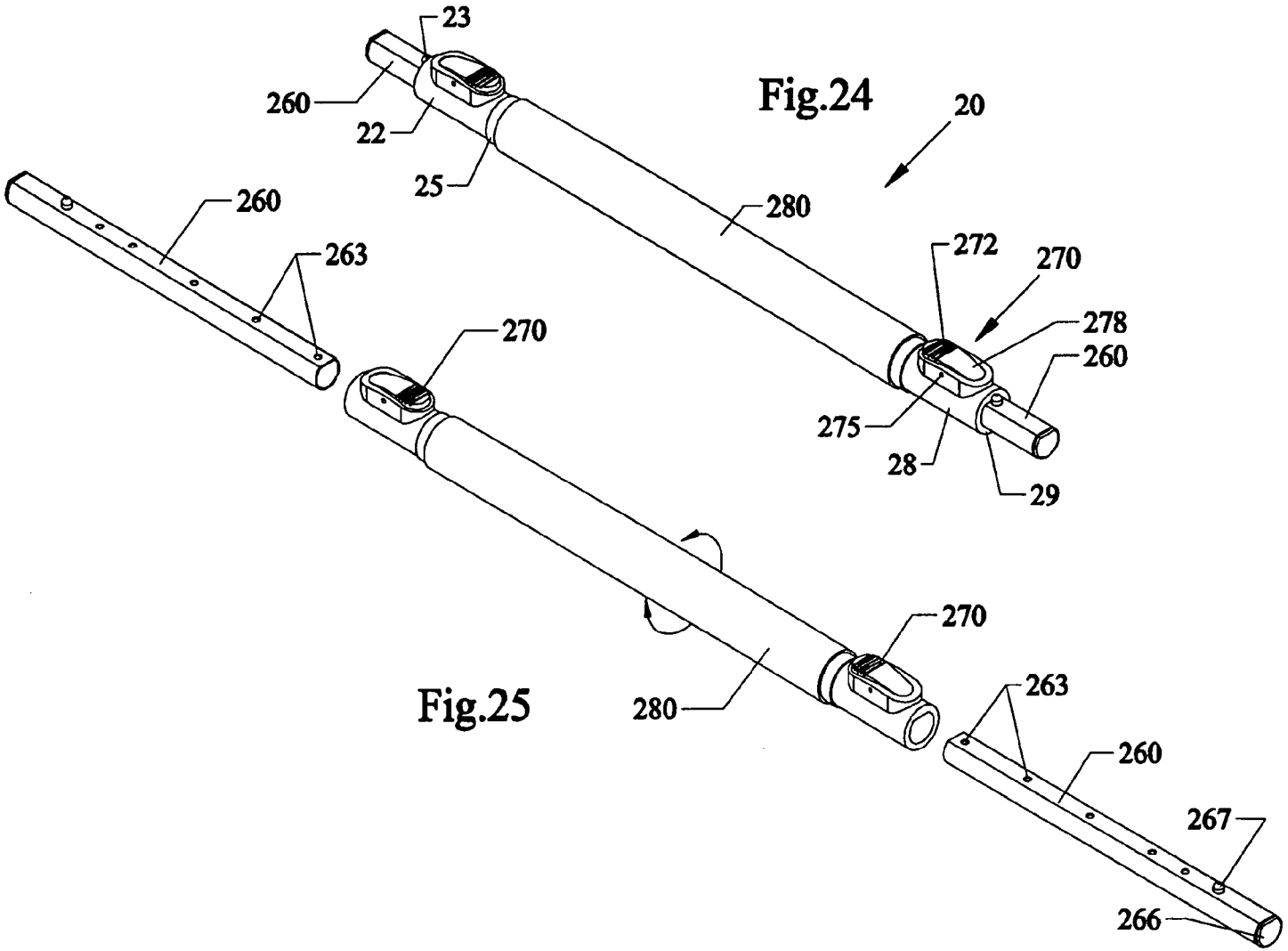
FIG. 24 is a perspective view of the accessory bar assembly with extendable ends that can be used with the apparatus of the preceding figures.
FIG. 25 is an exploded view of bar assembly of FIG. 24.
Figures 26, 27:
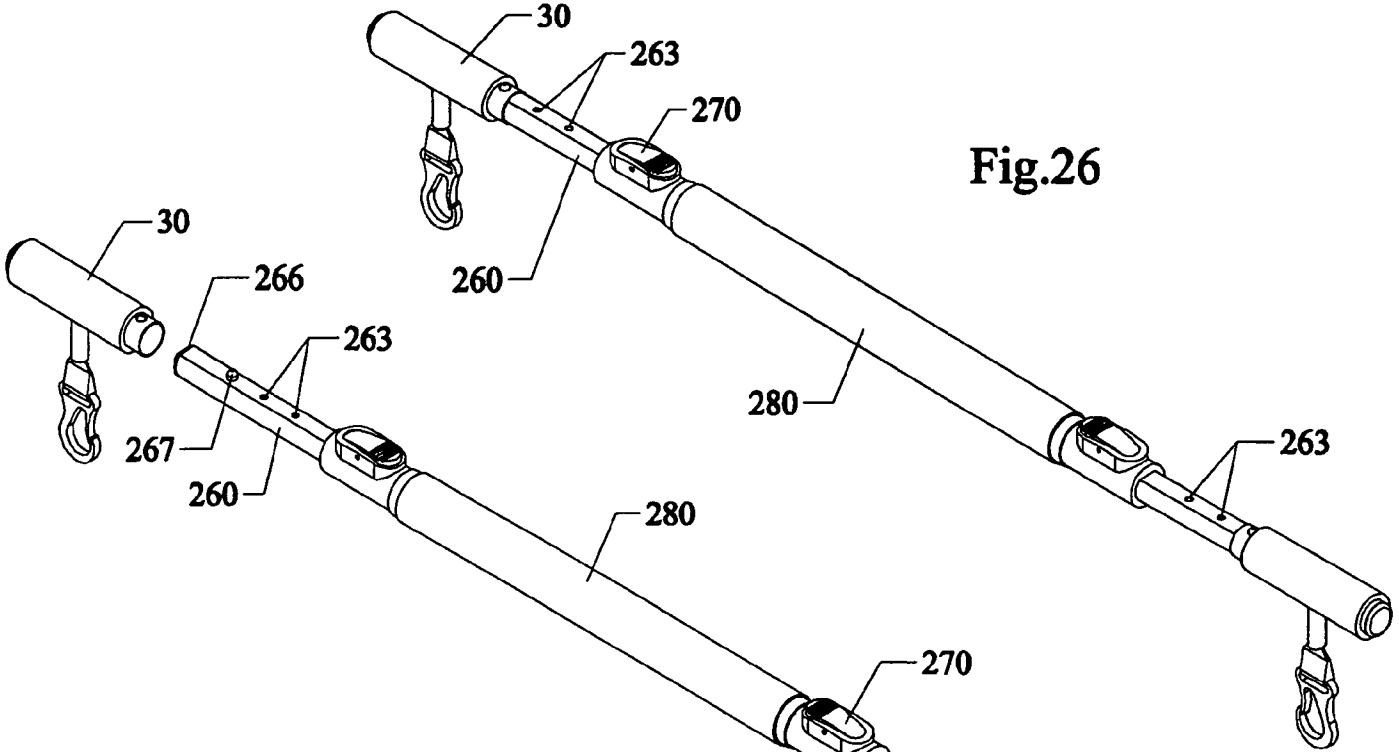
FIG. 26 is a perspective view of the bar assembly of FIG. 24 with attached grip handles.
FIG. 27 is an exploded view of the bar assembly detached from the grip handles.
Figure 28:
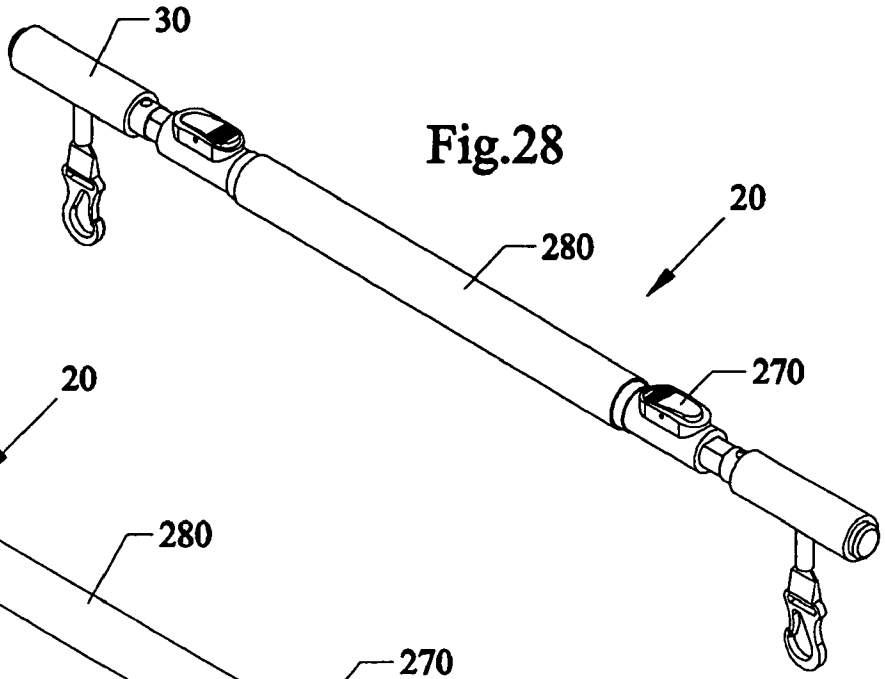
FIG. 28 is a perspective view of the FIG. 26 bar assembly with retracted handles.
Figure 29:
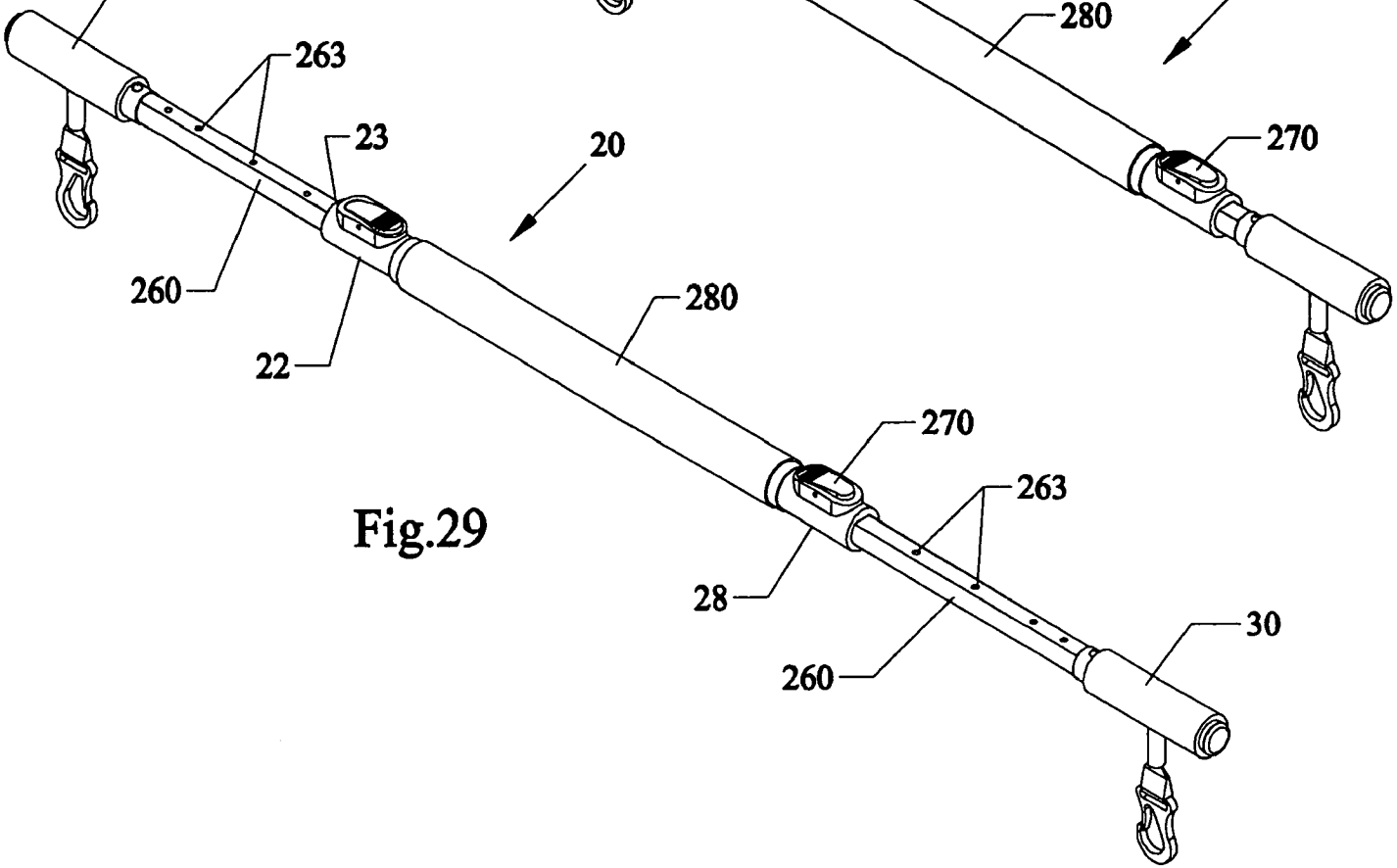
FIG. 29 is a perspective view of the FIG. 26 bar assembly with extended handles.
Figure 30:
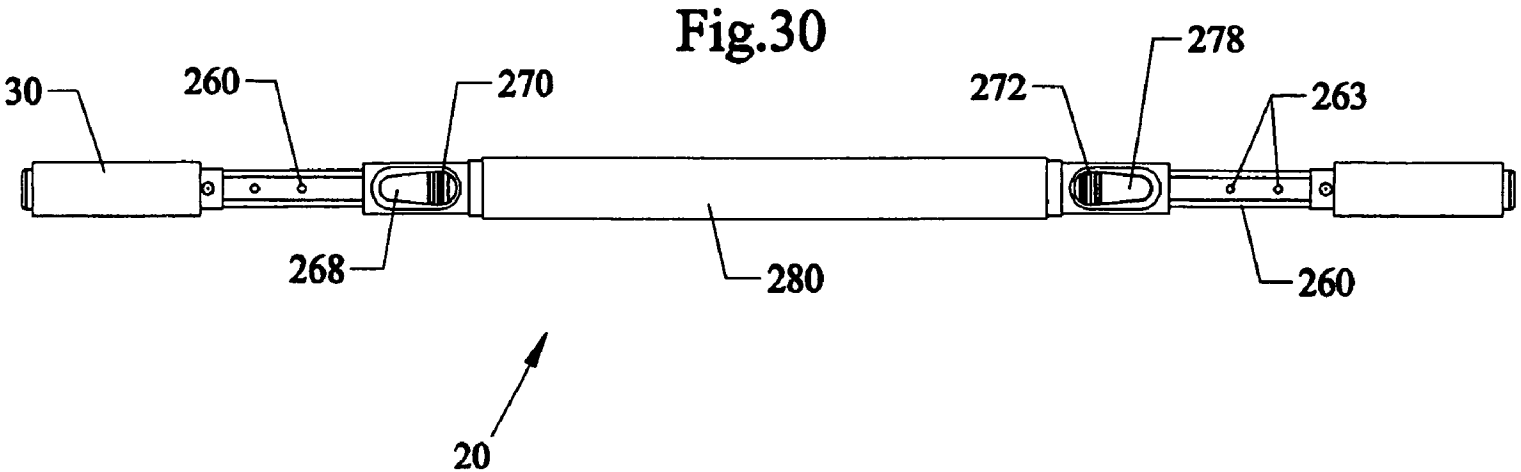
FIG. 30 is a top view of the bar assembly with handles of FIG. 26.
Figure 31:
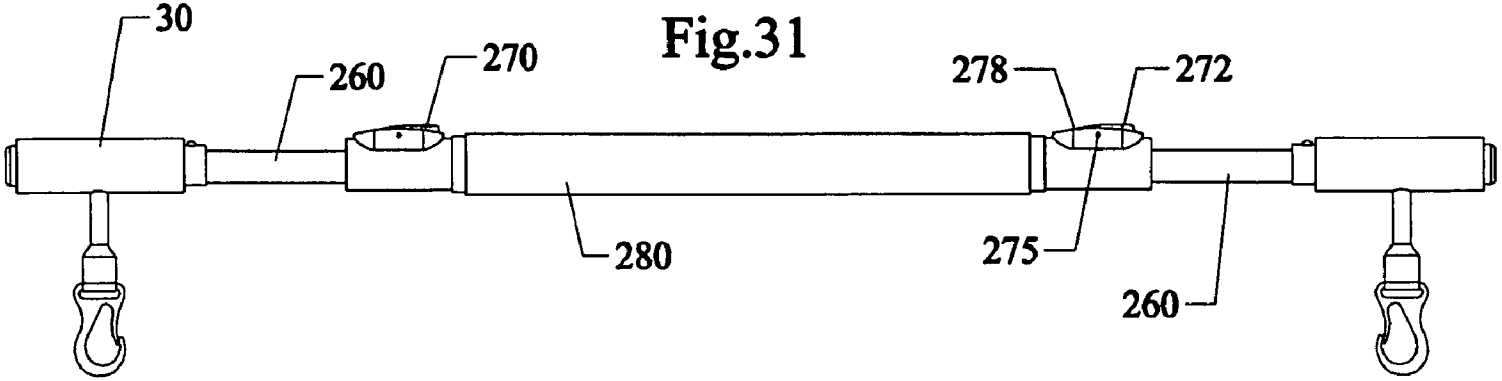
FIG. 31 is a front view of the bar assembly with handles of FIG. 26.
Figure 32:
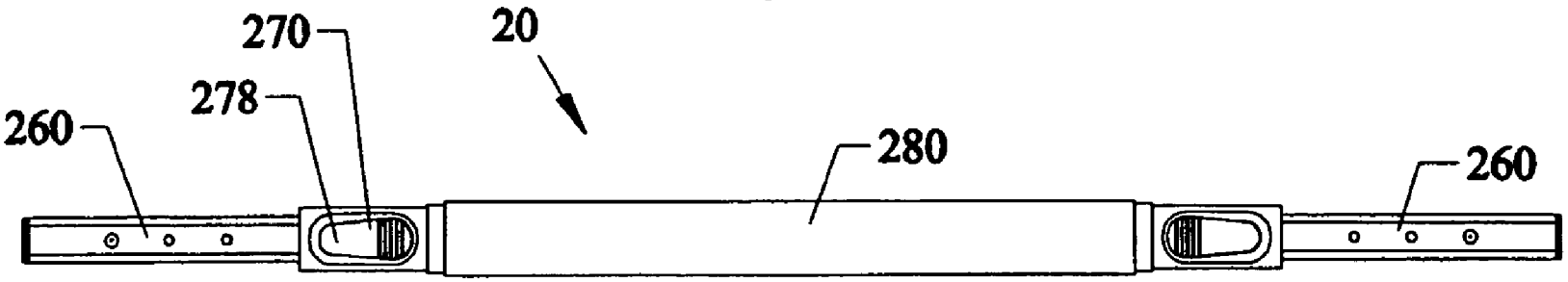
FIG. 32 is a top view of the bar assembly of FIG. 26 without handles.
Figure 33:
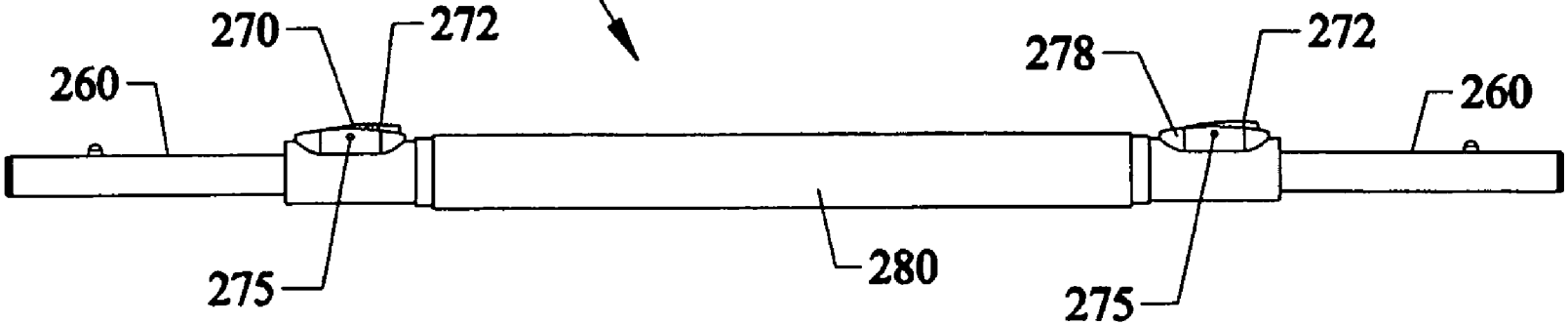
FIG. 33 is a front view of the bar assembly of FIG. 26 without handles.
Figure 35:
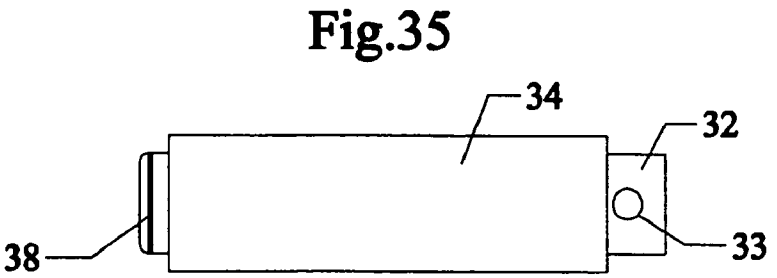
FIG. 35 is a top view of the handle of FIG. 35.
Figure 36:
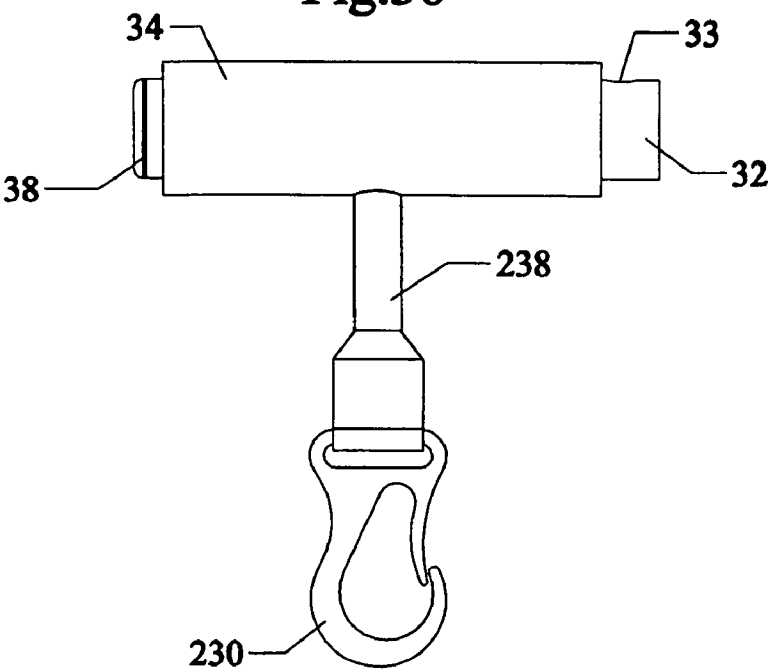
FIG. 36 is a front view of the handle of FIG. 35.
Figure 34:
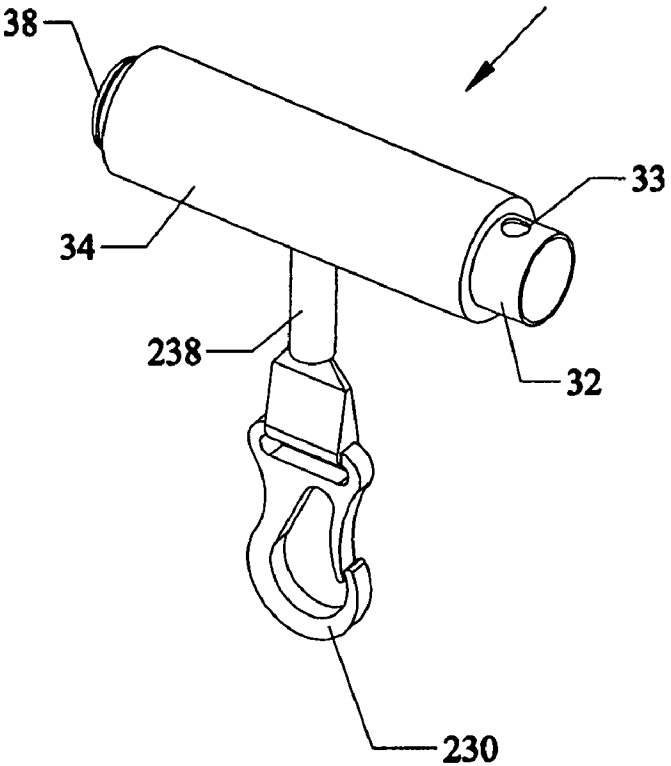
FIG. 34 is a perspective view of a handle used with the bar assembly of FIGS. 24-33.

FIG. 24 is a perspective view of the accessory bar assembly 20 with extendable bar ends 260 that can be used with the apparatus 10 of the preceding figures. FIG. 25 is an exploded view of bar assembly 20 with extendable bar ends 260 of FIG. 24. FIG. 26 is a perspective view of the bar assembly 20 of FIG. 24 with attached handles 30. FIG. 27 is an exploded view of the bar assembly 20 detached from the handles 30. FIG. 28 is a perspective view of the FIG. 26 bar assembly 20 with retracted handles 30. FIG. 29 is a perspective view of the FIG. 26 bar assembly with extended handles 30. FIG. 30 is a top view of the bar assembly with handles of FIG. 26. FIG. 31 is a front view of the bar assembly 20 with handles 30 of FIG. 26. FIG. 32 is a top view of the bar assembly 20 of FIG. 26 without handles 30. FIG. 33 is a front view of the bar assembly 20 of FIG. 26 without handles 30. FIG. 34 is a perspective view of a handle 30 used with the bar assembly 20 of FIGS. 24-33. FIG. 35 is a top view of the handle 30 of FIG. 35. FIG. 36 is a front view of the handle 30 of FIG. 35.

Referring to FIGS. 24-35, bar assembly 20 can include a grip tube 280 that freely rotates about a fixed inner tube 25, so that a user can grip the grip tube 280 and lift and lower the bar assembly 20 while the inner tube 25 with exposed outer ends 22, 28 remains fixed. The inner tube 25 can have a left exposed outer end 22 with flat topped cylindrical opening 23 that allows a left flat topped extendable bar 260 to slide in and out therefrom. The inner tube 25 can also have a right exposed outer end 28 with flat topped cylindrical opening 29 that allows a right flat topped extendable bar 260 to slide in and out therefrom. A pair of pivotable spring biased bar latches 270 on the bar assembly 20 can each have a raised surface pressportion 272 that presses against a lower spring so that a latch portion 278 with lower protruding pin (not shown) can engage anyone of a row of increment adjustment holes 263 in the flat upper surface of extendable bar 26. The bar latches 270 can allow for inner ends of each of the bars 260 to be retracted within side openings 23 and 29 of outer ends 22 and 28 of inner tube 25.

Handles 30 with belt 238 attached fastening hooks 230 can have hollow pipe ends 32 with upper holes 33. The hollow pipe ends 32 can slide about outer ends 266 of extendable bars 260 so as to allow for depressible spring loaded pins 267 on the bars 260 to pass into and lock with holes 33 so that handles 30 can be locked with bar assembly 20. A gripping surface tube 34 can be wrapped about the pipe 32, and the opposite end of the pipe 32 can have a cap 38.

Storage Capability

Figure 37:
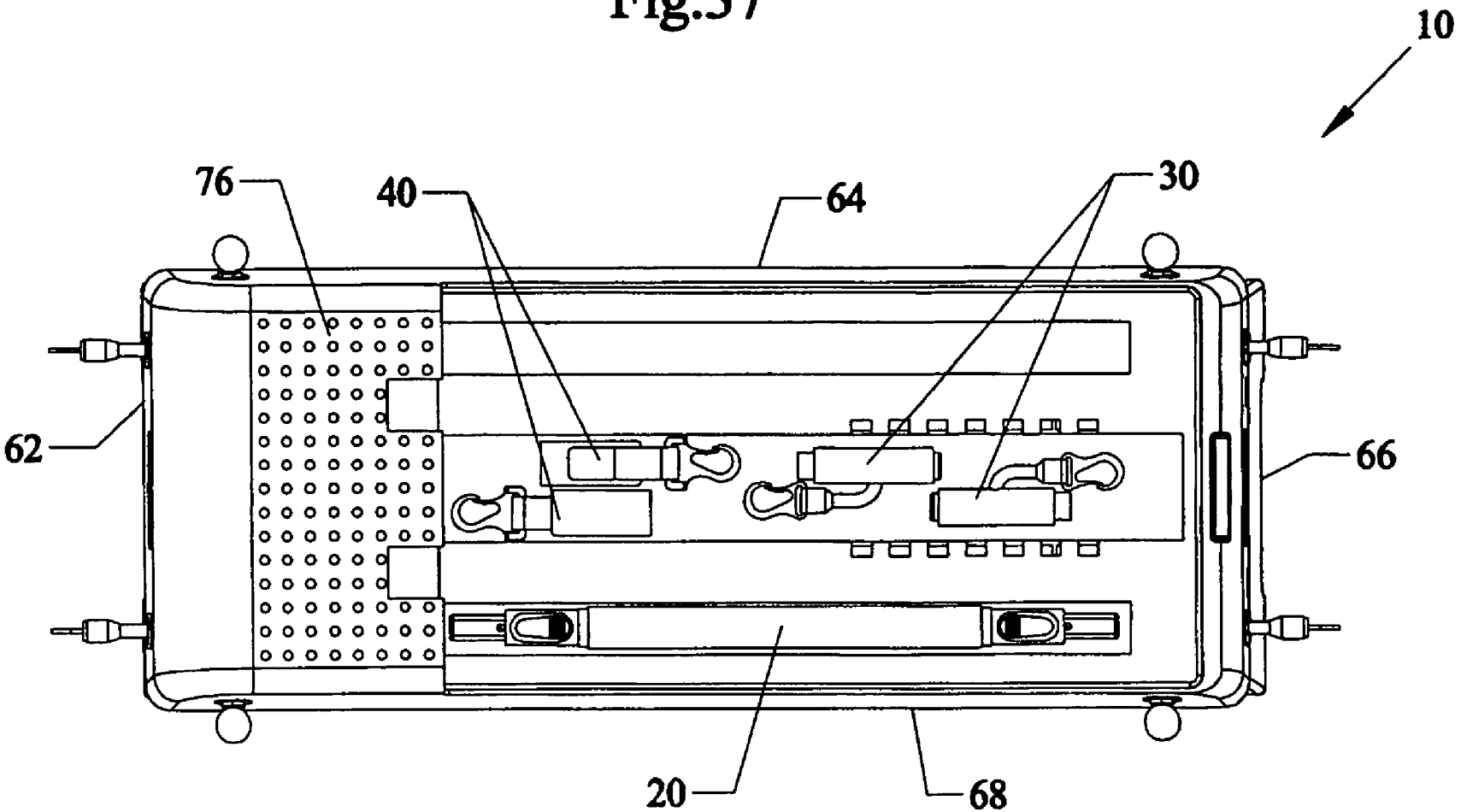
FIG. 37 is a top view of apparatus of FIGS. 1-23 with Backrest/Storage Lid removed to show storage of the handles, bars and leg straps

FIG. 37 is a top view of apparatus of FIGS. 1-23 with Backrest/Storage Lid 70 shown in the previous figures having been removed to show storage of the handles 30 and straps 40 and bar assembly 20.

Referring to FIGS. 1, 15, 22 and 37, the raisable lid 70 can open up to three longitudinal compartments located about the parallel stabilizer beams 90 so as to be able to store separate components such as but not limited to the pair of handles 30, pair of straps 40 and bar assembly 20 therein, when these components are not being used and/or when the apparatus 10 is being moved.

Leg Straps

Figure 39:
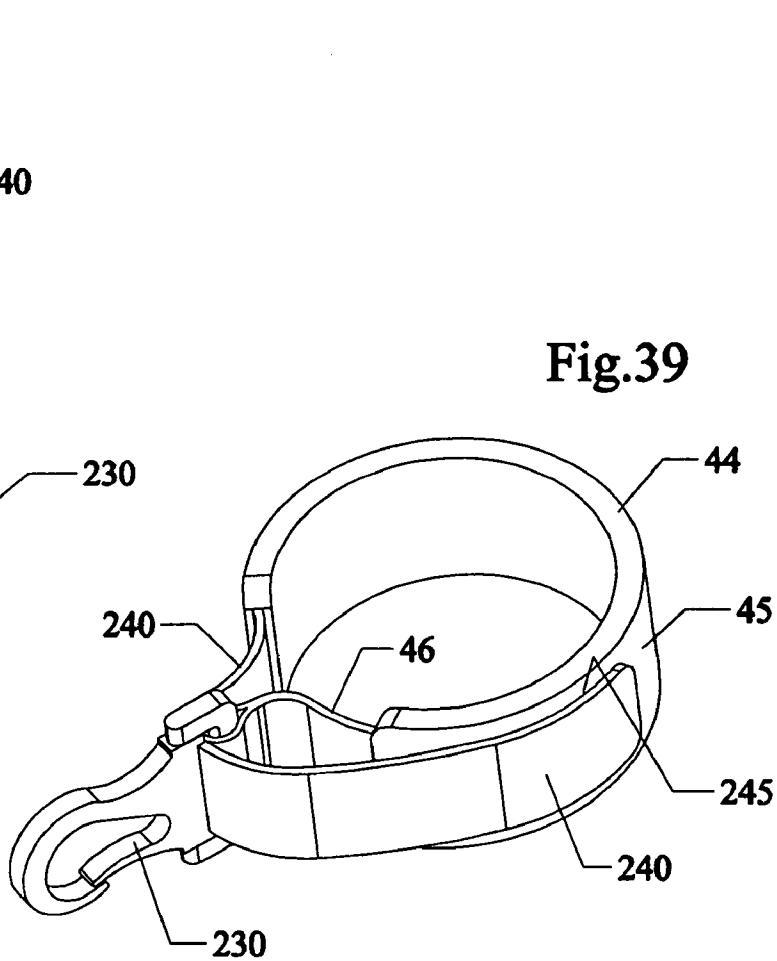
FIG. 39 is a side perspective view of the strap of FIG. 38.
Figure 38:
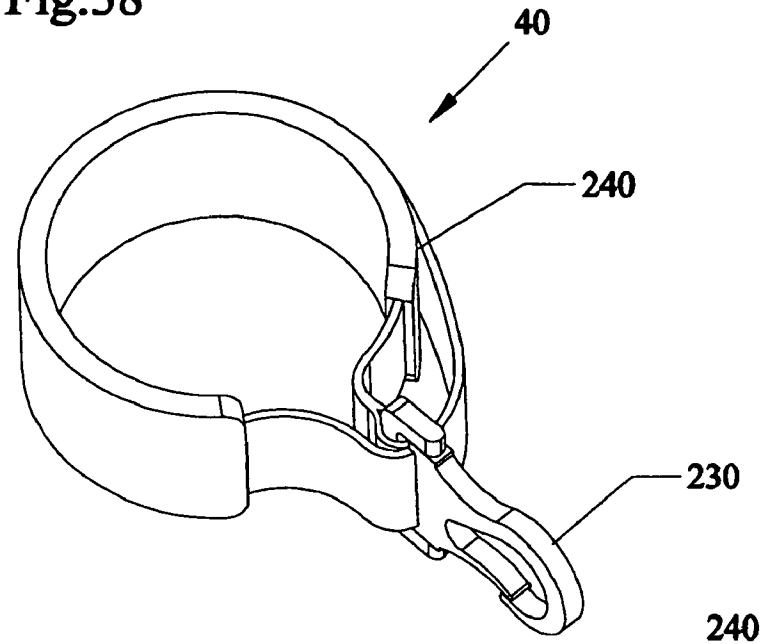
FIG. 38 is a front perspective view of the optional leg strap that can be used with the apparatus.
Figure 41:
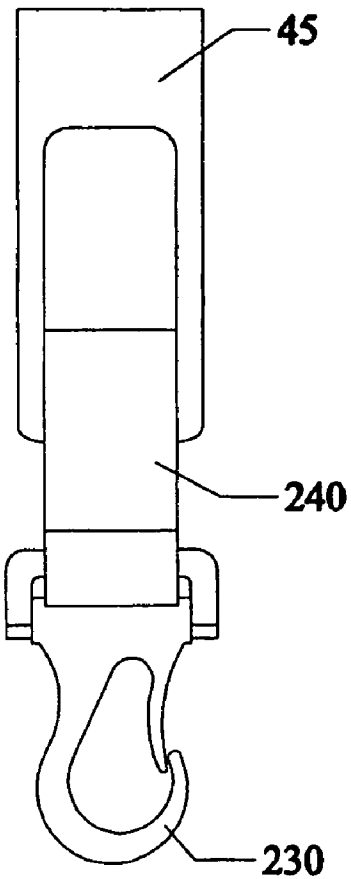
FIG. 41 is a side view of the strap of FIG. 38.
Figure 40:
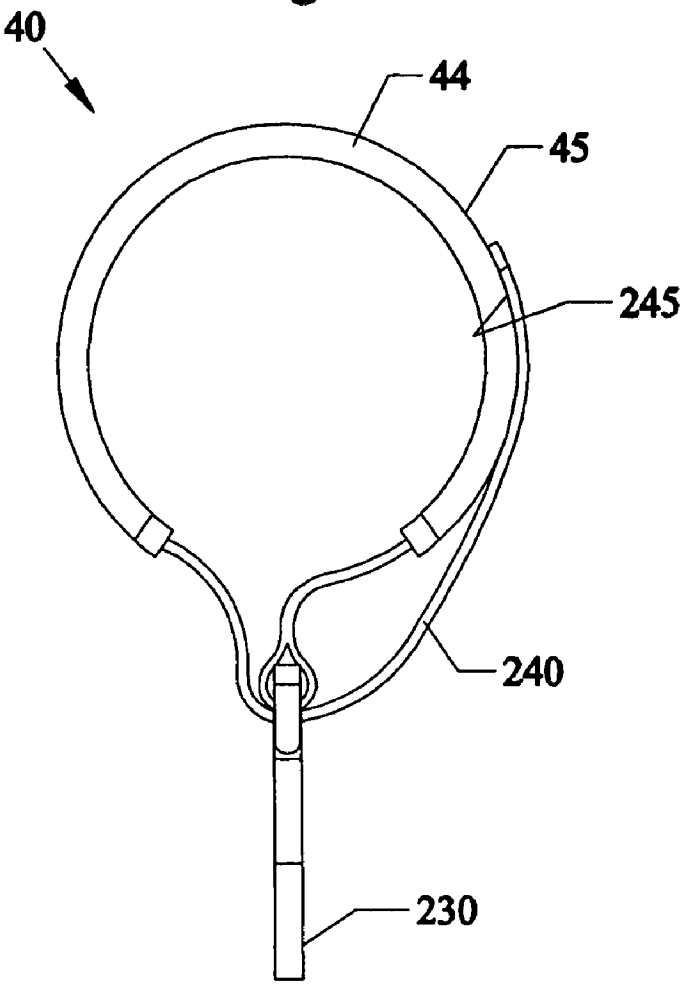
FIG. 40 is a top view of the strap of FIG. 38.

FIG. 38 is a front perspective view of the optional leg strap 40 that can be used with the apparatus 10. FIG. 39 is a side perspective view of the strap 40 of FIG. 38. FIG. 40 is a top view of the strap 40 of FIG. 38. FIG. 41 is a side view of the strap 40 of FIG. 38. Referring to FIGS. 38-41, the straps 40 can have a main horseshoe portion 44 with one end 46 that is fixed to loop end 236 of the fastening hook 230. The other end of the horseshoe portion 44 can have a fastening strap 240 such as a Velcro® strap with hook and loop surface portion 245 that can lock with hook and loop surface 45 on the outer perimeter of the horseshoe portion 44 of the strap 40. Pulling the fastening strap 240 through the loop end 236 of the fastening hook 230 adjusts the diameter of the strap 40 to fit about different sized legs and/or ankles of the user. The straps 40 can be used with the leg exercises shown and described in relation to FIGS. 58-59 which will be described later.

Wheel Hub Assembly Operation

Figure 42:
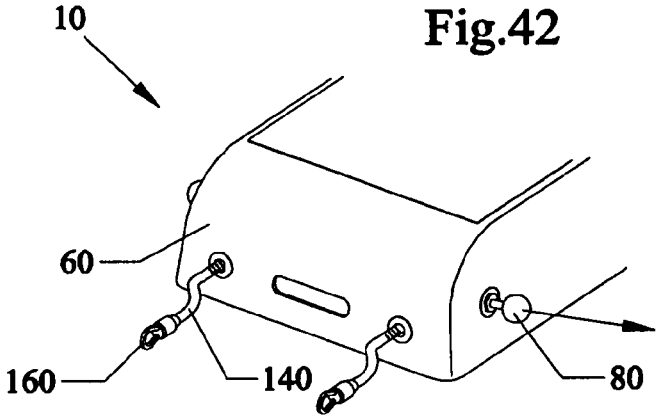
FIG. 42 is a perspective view of the resistance band length being adjusted to the platform.
Figure 43:
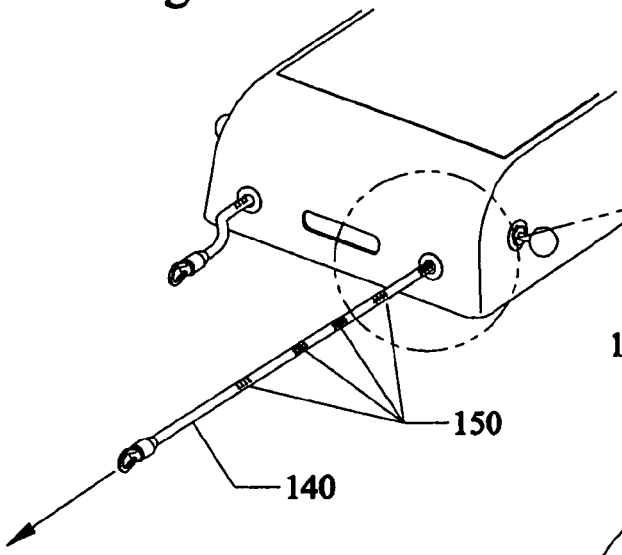
FIG. 43 is a perspective view of FIG. 42 showing band markings on the resistance band.
Figure 43A:
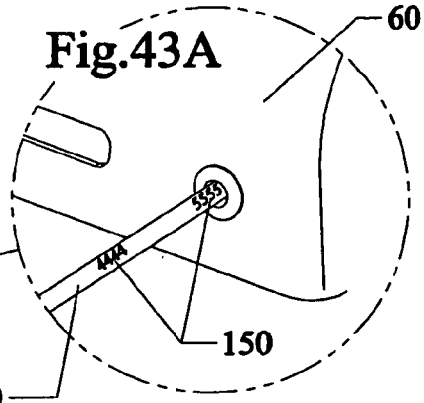
FIG. 43A is an enlarged portion of markings on the resistance band of FIG. 43.
Figure 44:
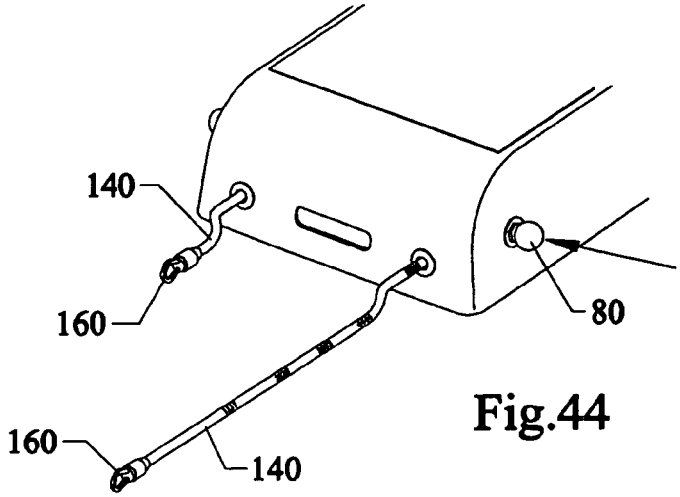
FIG. 44 is another view of the platform of FIG. 42 with a locked in length resistance band.
Figure 45:
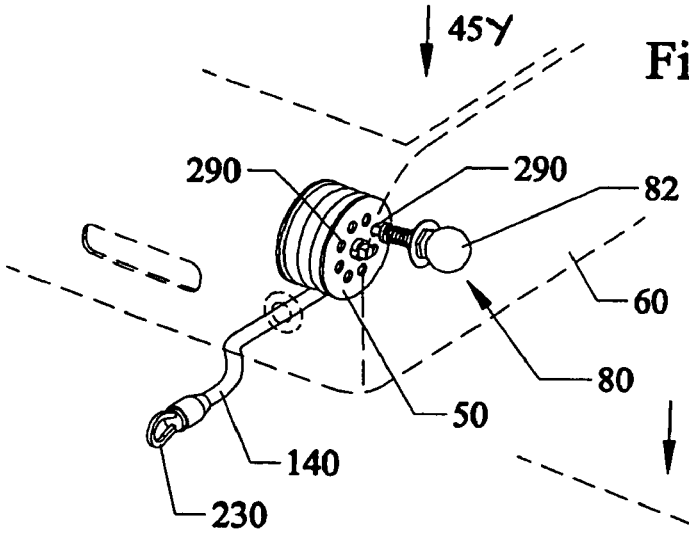
FIG. 45 is a partial inside view of the tension assembly with locked in length band.
Figure 46:
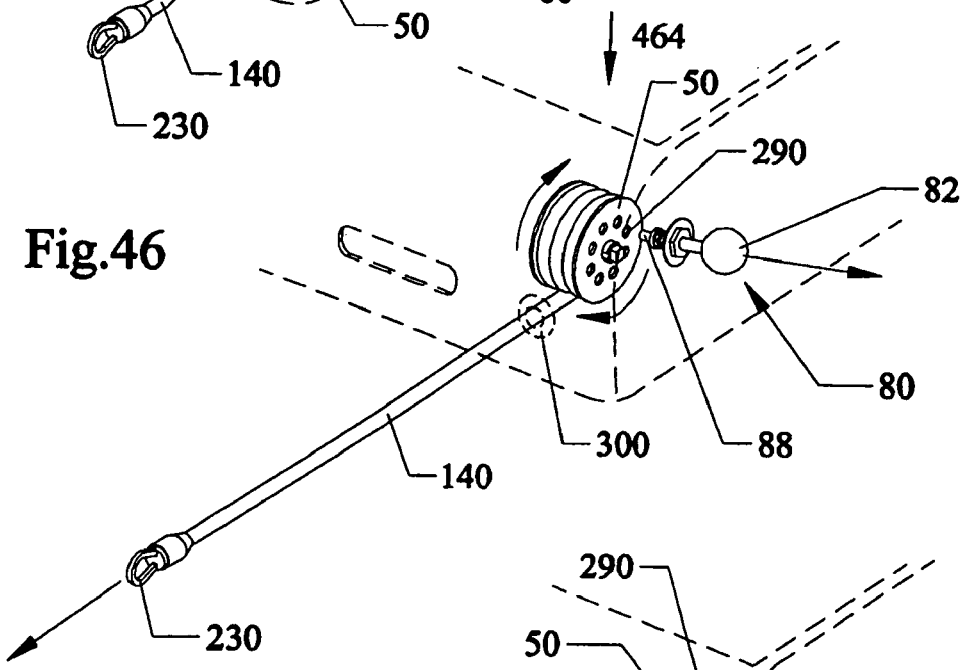
FIG. 46 is another view of FIG. 45 with the plunger retracted to allow band lengthening.
Figure 47:
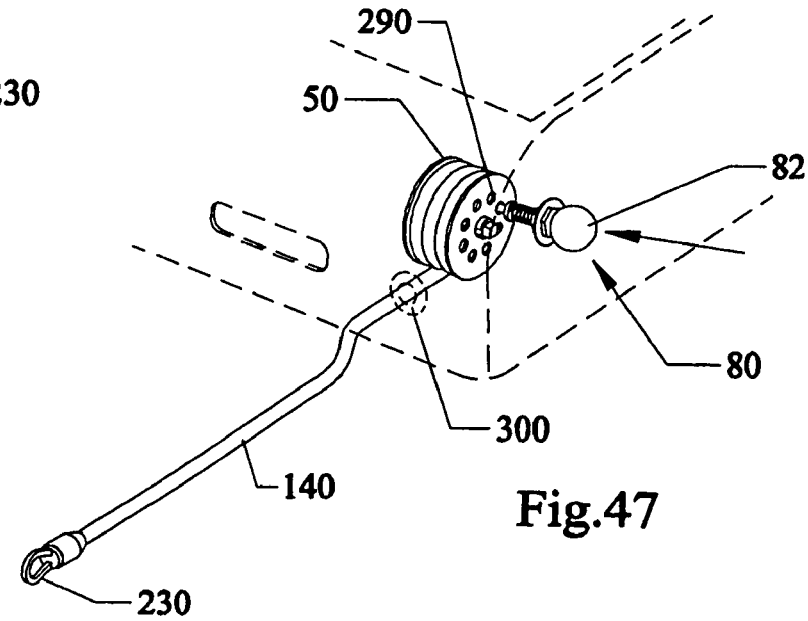
FIG. 47 is another view of FIG. 45 with the band locked into an extended length.
Figure 45A:
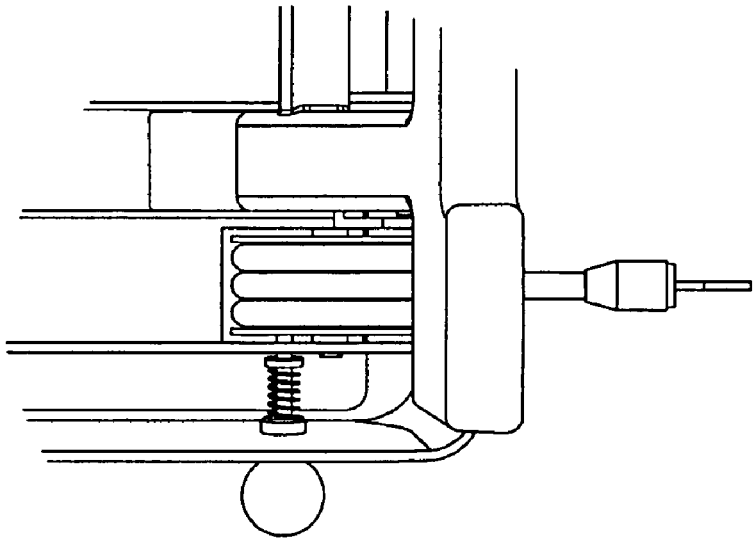
Figure 46A:
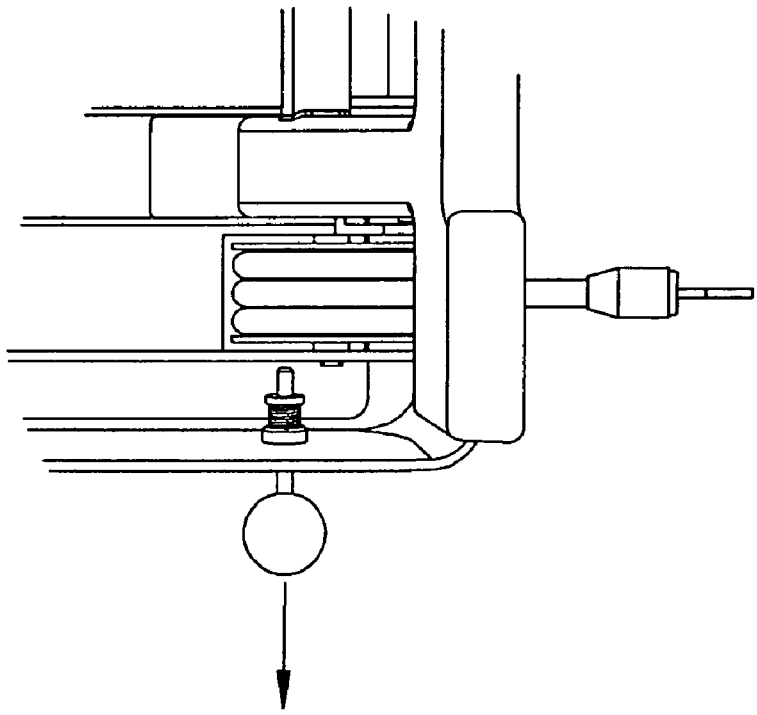
FIG. 46A is a top view of FIG. 46 along arrow 46Y of the spring plunger being pulled out.
Figure 48:
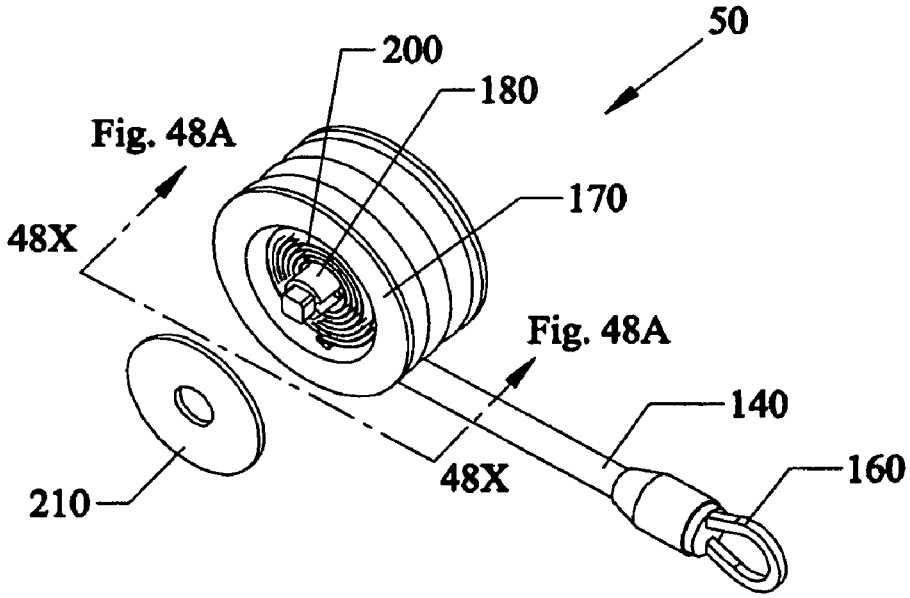
FIG. 48 is an enlarged perspective view of the tension assembly of FIGS. 45-47 with spring cover removed.
Figure 49:
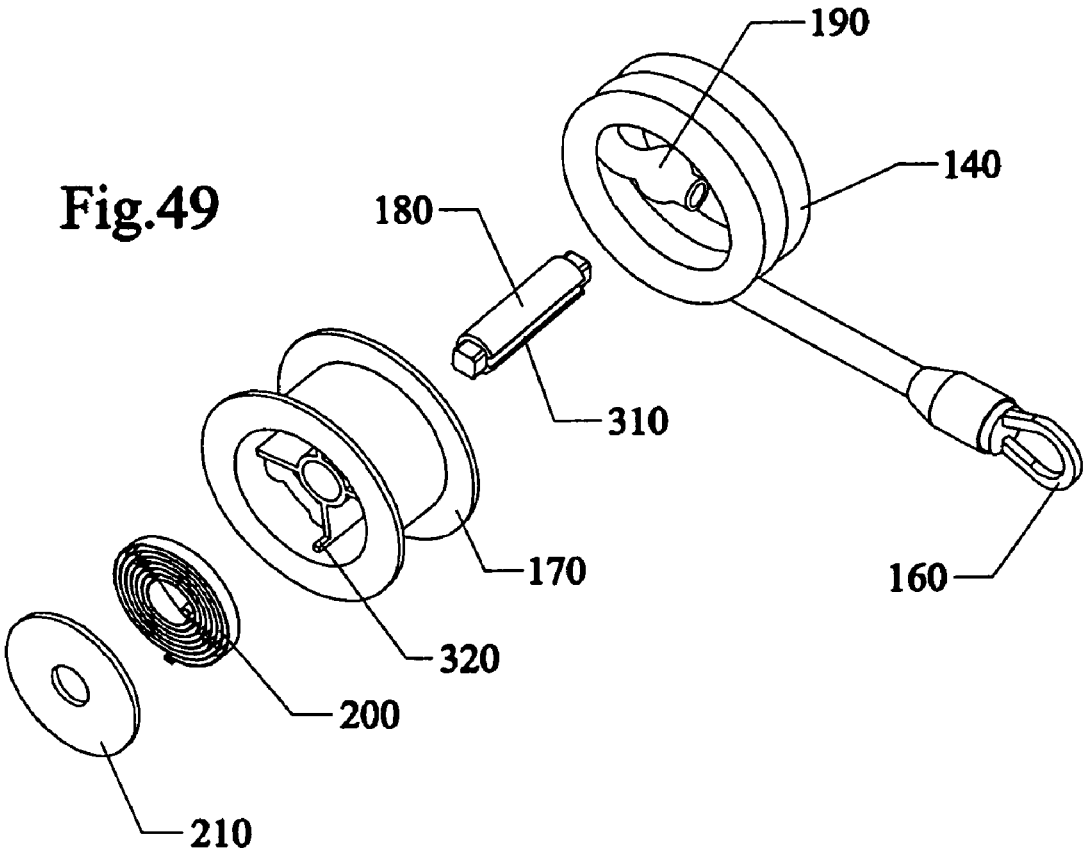
FIG. 49 is an exploded view of the parts of the tension assembly of FIG. 48.
Figure 48A:
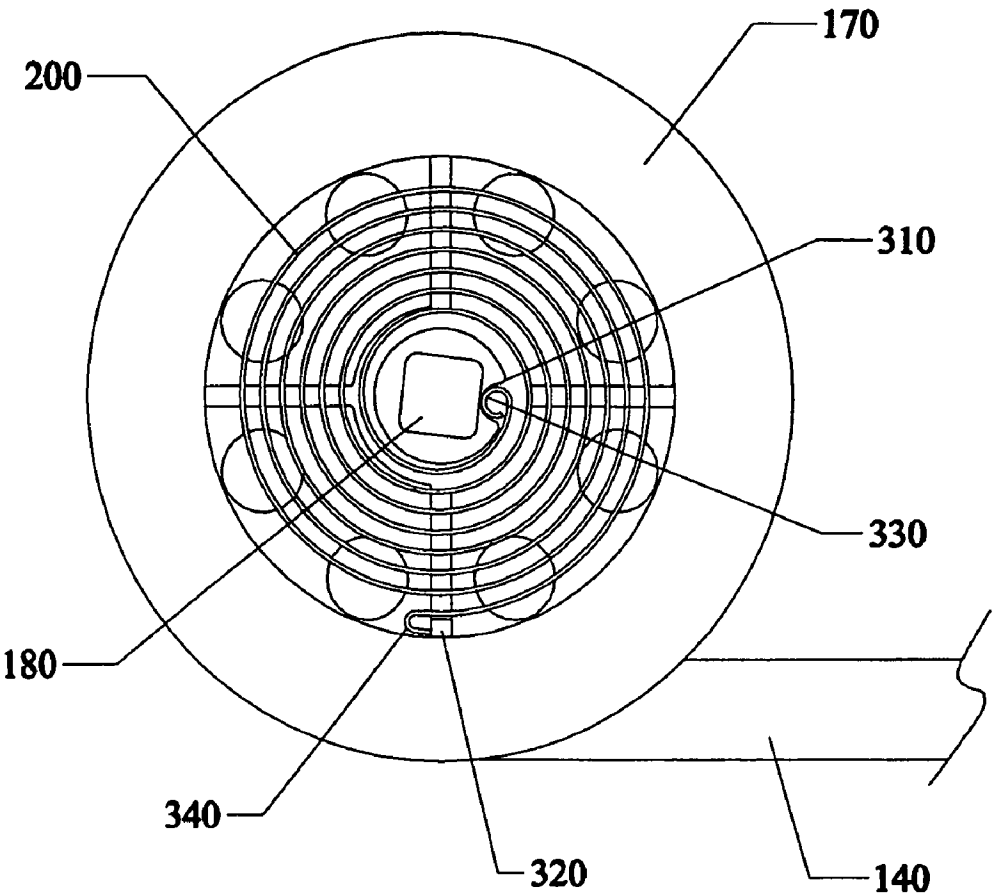
FIG. 48A is a partial side view of the tension assembly of FIG. 48 along arrow 48X.

FIG. 42 is a perspective view of the resistance band 140 length being adjusted to the platform 10. FIG. 43 is a perspective view of FIG. 42 showing band markings 150 on the resistance band 140. FIG. 43A is an enlarged portion of markings 150 on the resistance band of FIG. 43. FIG. 44 is another view of the platform 10 of FIG. 42 with a locked in length resistance band 140. FIG. 45 is a partial inside view of the tension assembly 50 with locked in length band 140. FIG. 45A is a top view of FIG. 45 along arrow 45Y with spring plunger 80 locked in. FIG. 46 is another view of FIG. 45 with the plunger 80 retracted to allow band 140 to be lengthened. FIG. 46A is a top view of FIG. 46 along arrow 46Y of the handle 82 of the spring plunger 80 being pulled out. FIG. 47 is another view of FIG. 45 with the resistance band 140 locked into an extended length. FIG. 48 is an enlarged perspective view of the tension assembly 50 of FIGS. 45-47 with spring cover 210 removed. FIG. 48A is a partial side view of the tension assembly 50 of FIG. 48 along arrow 48X. Here, the hub 170 has the coil spring is about an axle 180 inside the hub 170, and is held in place by a coil spring retaining slot 310 about a knuckle 330 on the coil spring 200, and a coil spring tab 340 held in place by a coil spring retaining tab 320 on hub 170. FIG. 49 is an exploded view of the parts of the tension assembly 50 of FIG. 48.

Figure 63:
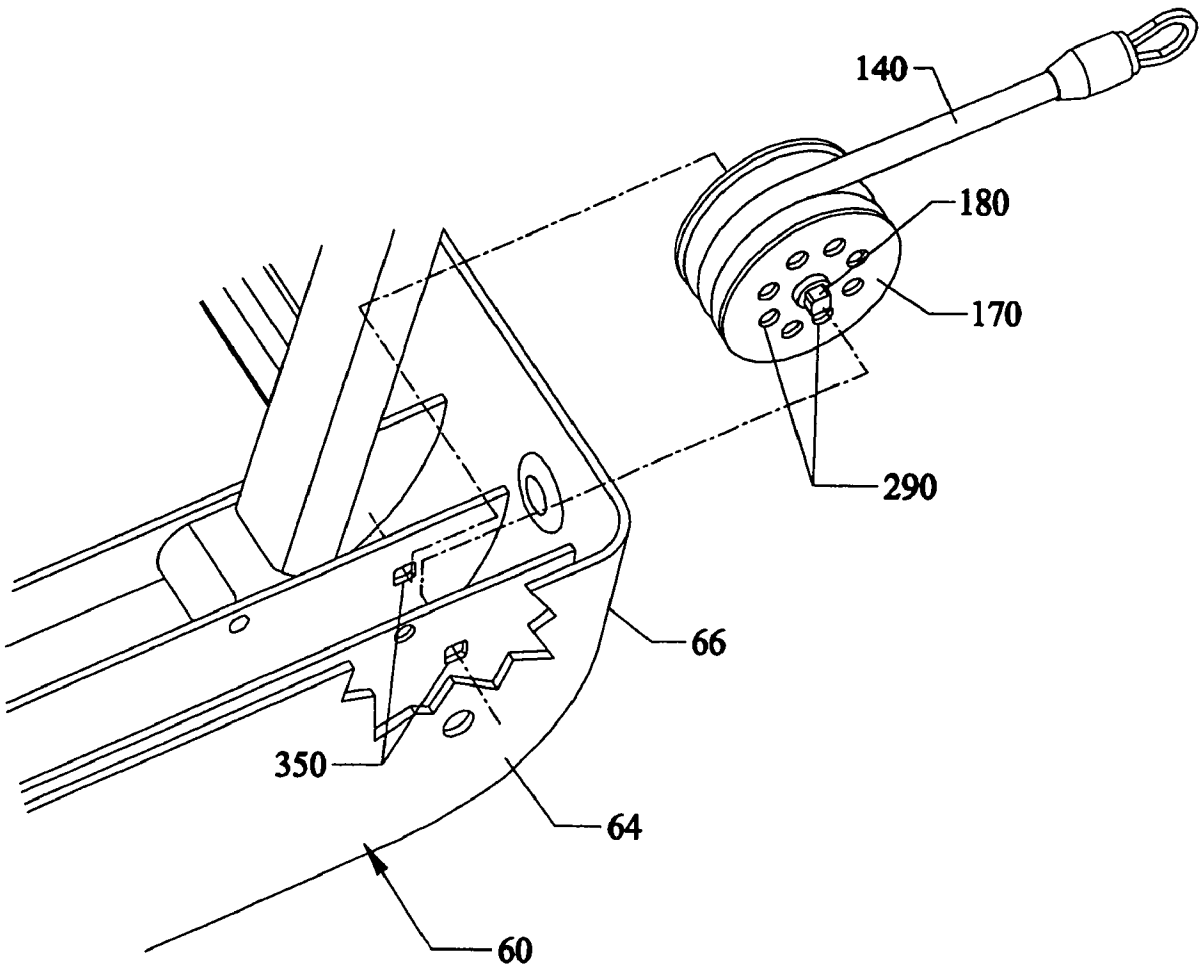
FIG. 63 shows the hub assembly being assembled to the platform base.
Figure 64:
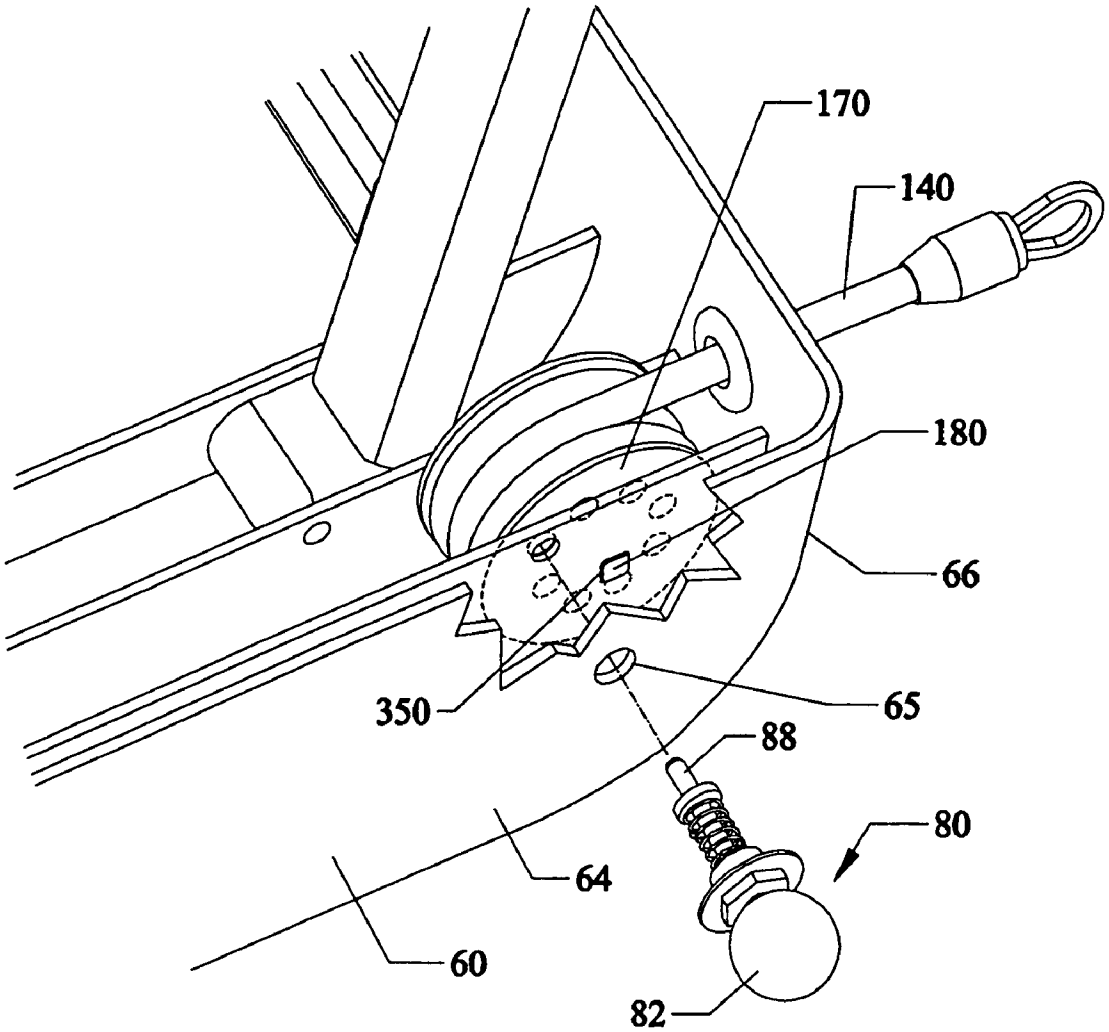
FIG. 64 shows the spring plunger being attached to the hub assembly on the platform base.
Figure 65:
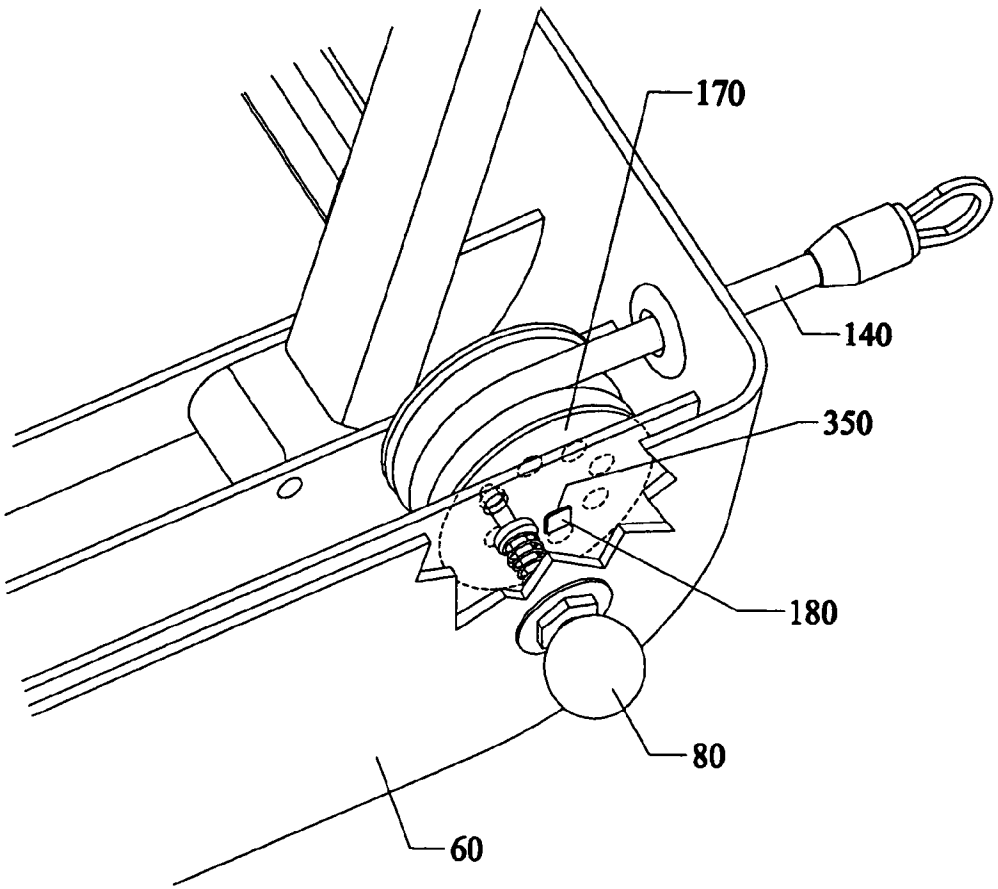
FIG. 65 shows the hub axle fitting in the platform base side wall.
Figure 66:
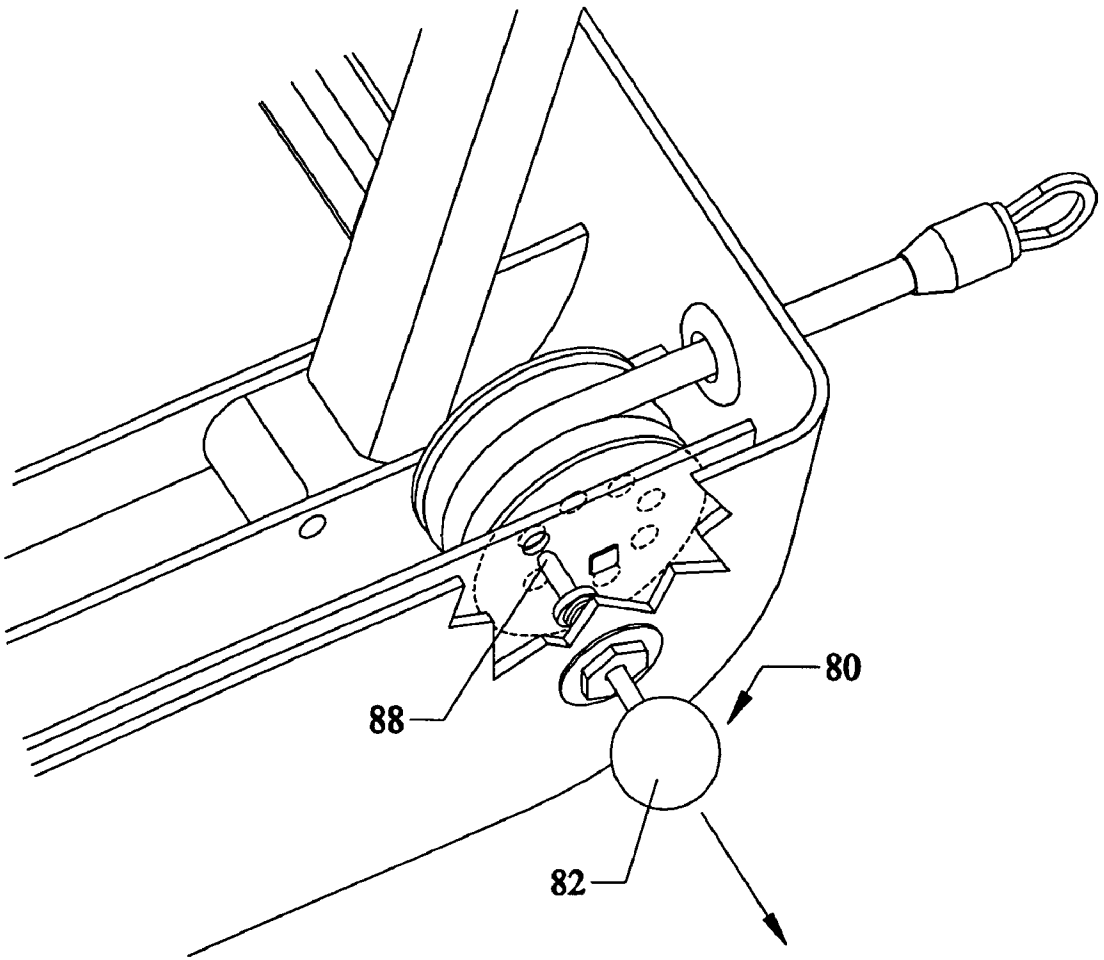
FIG. 66 shows the spring plunger being pulled out from the hub assembly.
Figure 67:
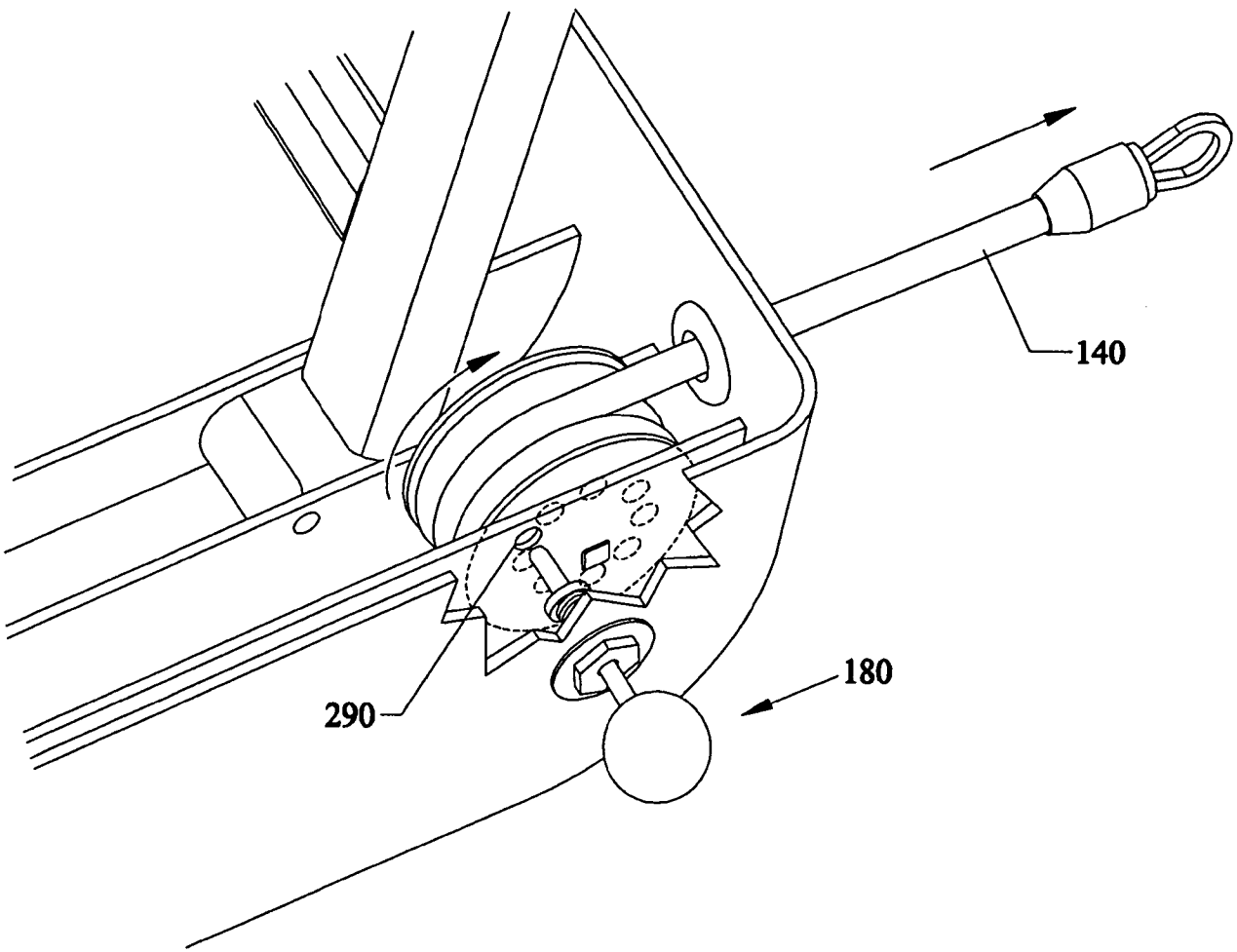
FIG. 67 shows the resistance band being pulled out from the hub assembly of FIG. 66.
Figure 68:
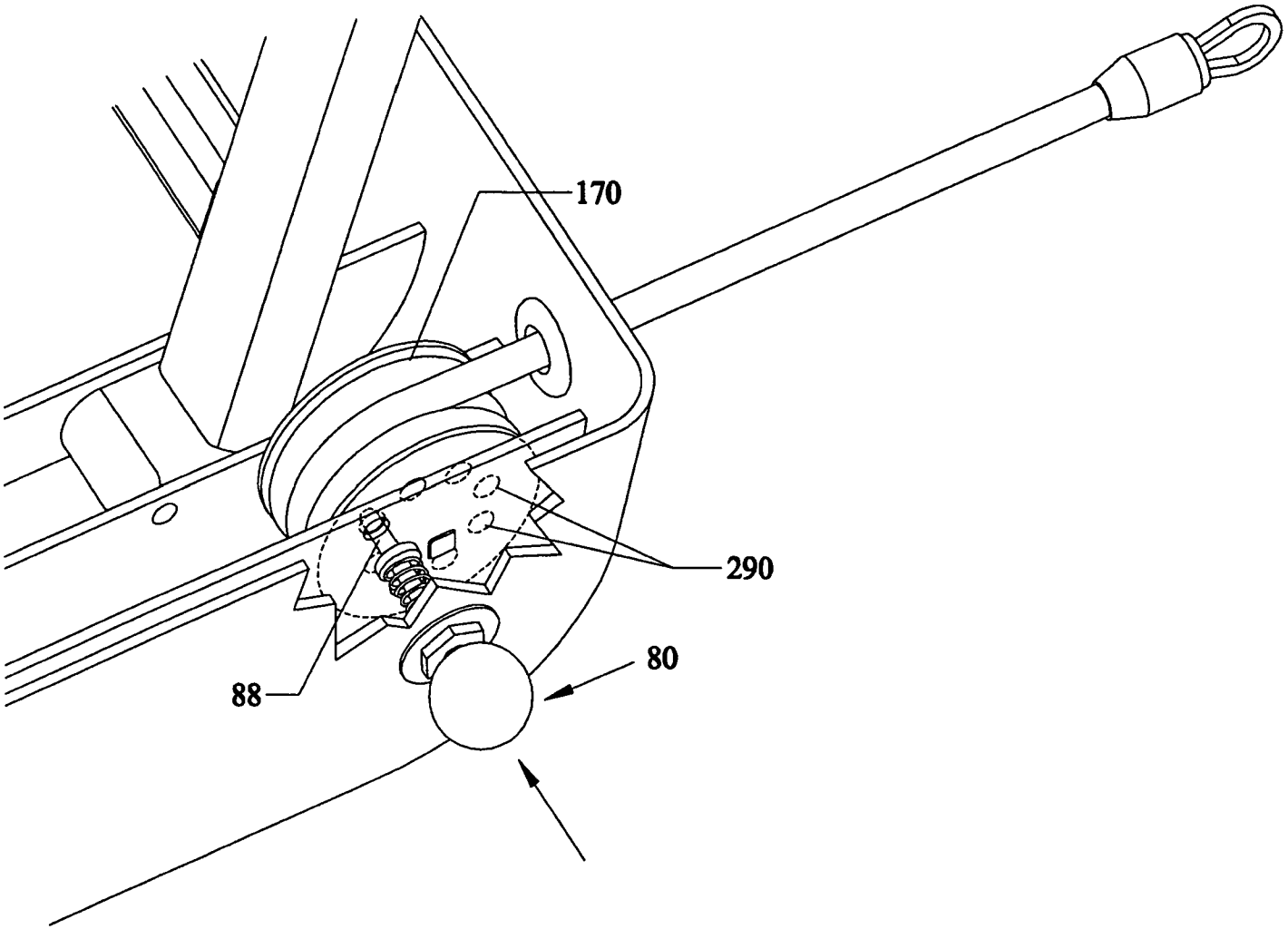
FIG. 68 shows the spring plunger locking the hub into position with the band pulled out.

FIG. 63 shows the hub assembly 170 being assembled to the platform base 60. FIG. 64 shows the spring plunger 80 being attached into a hole 65 the sidewall 64 on the platform base 60. FIG. 65 shows the square end of hub axle 180 fitting into a cut-out 350 in a base wall 352 inside of the platform base 60. The square ends of hub axle 180 can be spring loaded so that the ends can be pushed inward against an inner spring (not shown) so that hub 170 is mounted in place, and the axle ends then can expand to snap into square cut-outs 350. The snap in hub assembly 170 can be easily installed to the base 60 without extra tools or separate fasteners, such as screws, and the like, at any time during the manufacturing process of unit. FIG. 66 shows the handle 82 of the spring plunger 80 being pulled out from the hub assembly 170. FIG. 67 shows the resistance band 140 being pulled out from the hub assembly 170 of FIG. 66. FIG. 68 shows the spring plunger 180 locking the hub 170 into position with the band 140 having been pulled out.

Referring to FIGS. 42-49, and 63-68 each resistance band 140 can have markings 150 such as indicia being numbers, colors, etc. that allow the user to visually see selected incremental points on the length of each band 140 to determine desired resistance levels. The lengths of each of the resistance bands can be adjusted so that the longer the length of the resistance bands the less resistance (less force) the user gets during exercises. Likewise, the shorter the length of each of the resistance bands 140 the more resistance (more force) occurs during the exercises. The longer the band lengths the easier it is to stretch the bands 140 (less resistance). The shorter the band lengths the harder it is to stretch the bands 140 (more resistance).

Referring to FIGS. 42-49, and 63-68, when the user wishes to change the length of the resistance bands 140 to accommodate for different exercises and/or levels of either negative or positive resistance, the user simply pulls out the ball handle 82 of the spring biased plunger 80 out of the locked position so that the protruding tip 88 disengages from the hub lock holes 290. At the same time the user needs to be pulling out the fastening loop 160 located at ends of each resistance band 140, out from the egress hole 300 until the selected level of resistance is reached by visual identification of the strength markings 150 imprinted on the resistance bands 140.

As the user is pulling out the resistance bands 140 the coil spring 200 inside the hub 170 increases tension by winding up. When a selected level is achieved, the user simply releases ball handle 82 on the spring loaded plunger 80 which will then automatically lock the selected level by pushing tip end 88 into one of the hub lock holes 290. Upon completion of an exercise, the user again simply pulls out the ball handle 82 of the spring loaded plunger 80 out of the locked position from one the holes of the hub lock holes 290 and the resistance band(s) 140 will automatically return to a starting wound up position, by the releasing of tension by unwinding of the coil spring 200 located within the hub housing 170 cap 210 which rotates about the axle 180.

Changeable Resistance Bands

FIG. 50 is a perspective view of hub 170 with resistance band 140 to be installed. FIG. 51 is another view of the hub 170 of FIG. 50 with an installed resistance band 140. FIG. 52 is still another view of the hub 170 of FIGS. 50-51 with installed band 140.

Referring to FIGS. 50-52, the novel invention allows for removing resistance bands 140 so that different lengths of bands can be substituted, different types of bands, colors can be used, as well as replacing worn out bands and the like. The bands 140 can have an enlarged retension ball end 190 which allows the for band 140 to be easily attached to the hub 170 by passing the enlarged end 190 through the larger opening of a keyhole shaped slot 220 on the reel portion of the hub 170 and locking the band 140 to the hub 170 by sliding the enlarged end 190 behind the narrower opening of the keyhole slot 220. Removing the band 140 when desired can be accomplished by reversing these steps.

Description of Exercises

The following descriptions below represent exercises from the main six muscle groups, ARMS, LEGS, BACK, SHOULDERS, CHEST, ABDOMINALS. Each muscle group has a subgroup in which multiple variations are possible in which the present invention also provides means to accomplish, this list is only an example of the many exercises possible with the present invention and is only meant to demonstrate the inventions versatility. The list of exercises is not intended to be an exhaustive list of the exercises capable of being performed; they are not necessarily in any order of any exercise regime and should not be construed as such. These are illustrative and not restrictive or limiting, and will be apparent to one who is practiced and skilled in the art.

Figure 53:
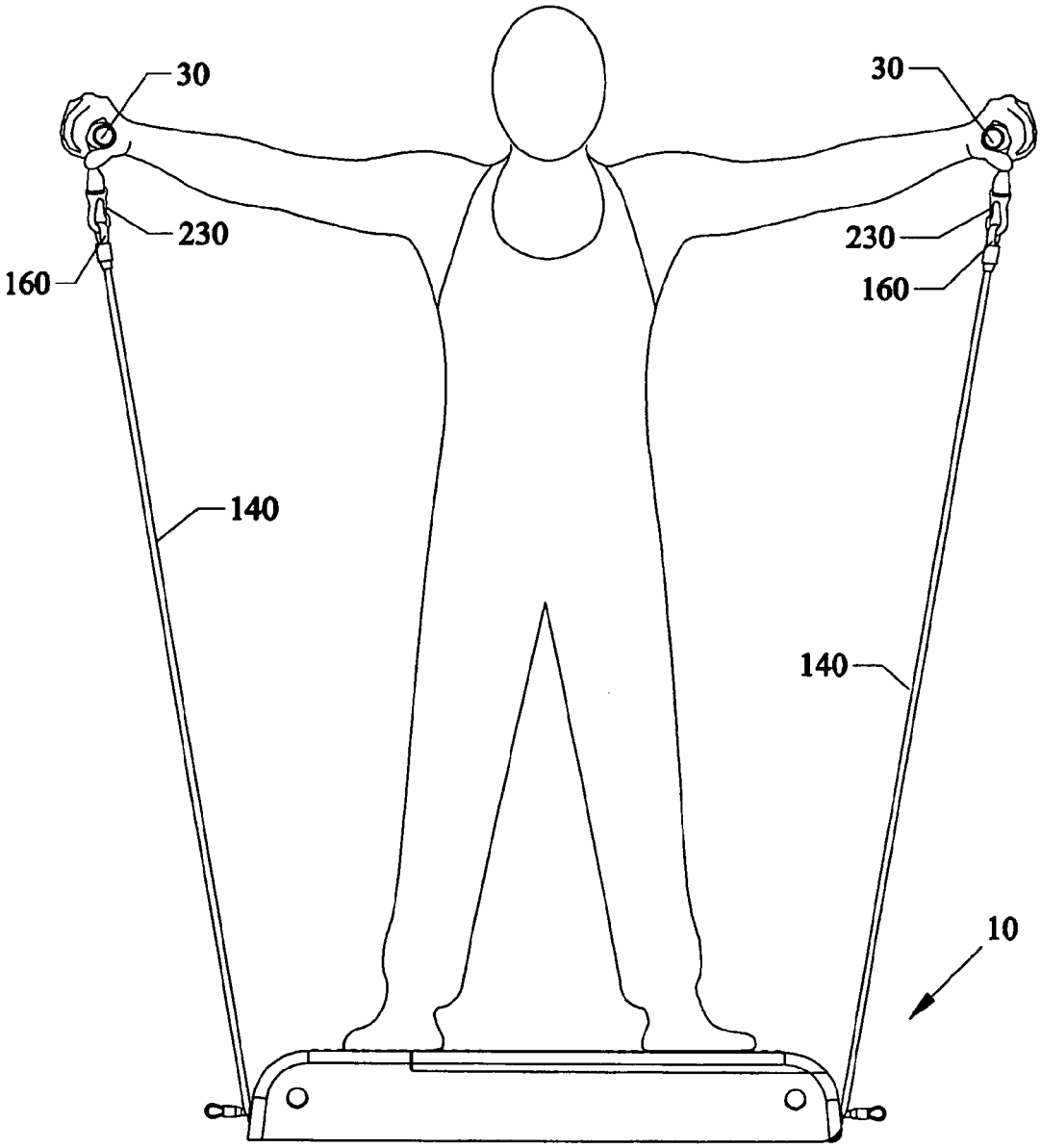
FIG. 53 shows a user doing "Side Lateral Raises" using single grip handles standing on the apparatus platform.

Lateral Raises:

FIG. 53 shows a user doing "Side Lateral Raises" using single grip handles 30 standing on the apparatus platform 10. FIG. 53 is an illustration of the user standing in a vertical position atop the unit in folded down position grasping onto separate handles 230 connected by fastening hooks 230 to resistive elements 140. The user then selects resistance level using the selectable plunger pin (80-88 previously shown), then raises arms from side simultaneously or one arm at a time to shoulder height, thus engaging the selected positive resistive force, then returning arms down with a negative resistance force.

Figure 54:
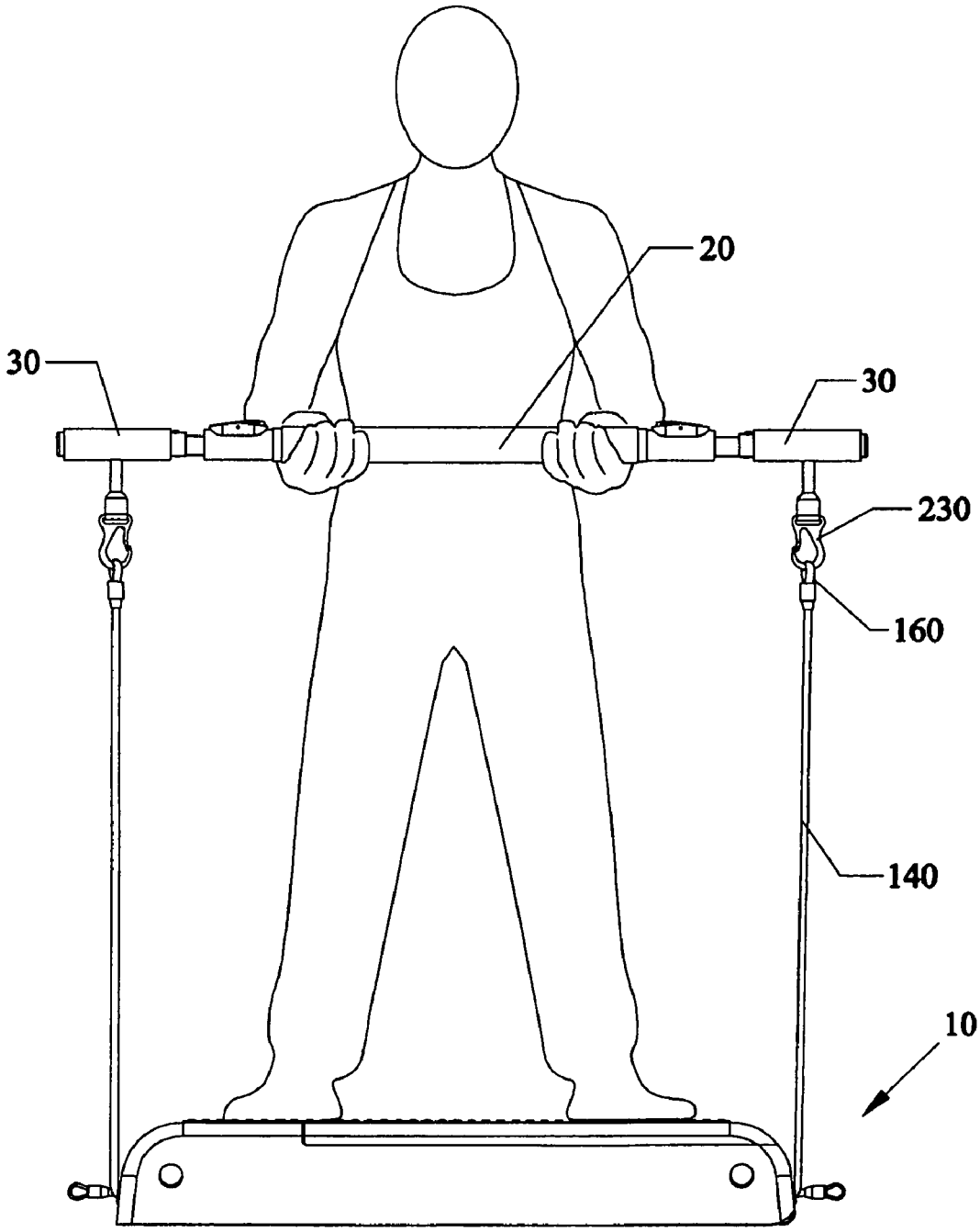
FIG. 54 shows a user doing "Bicep Curls" using bar attachment standing on the apparatus platform.

Bicep Curls:

FIG. 54 shows a user doing "Bicep Curls" using bar attachment standing on the apparatus platform 10. FIG. 54 is an illustration of the user standing in a vertical position atop the unit in folded down position. With handles 30 attached and locked onto the extension bar 20, the user then grasps the rotational padded portion of the bar with an underhand grip, with arms extended down from the sides, the user then curls the rotatable tube about bar 20 upwards and initiates the selected resistance force until arms are even with biceps, then returns bar to starting position. All during any exercise using the extension bar 20 the handles 30 remain in a fixed position due to the rotational padded portion of the bar 20. This keeps the resistive elements 140 from being wound up.

Figure 55:
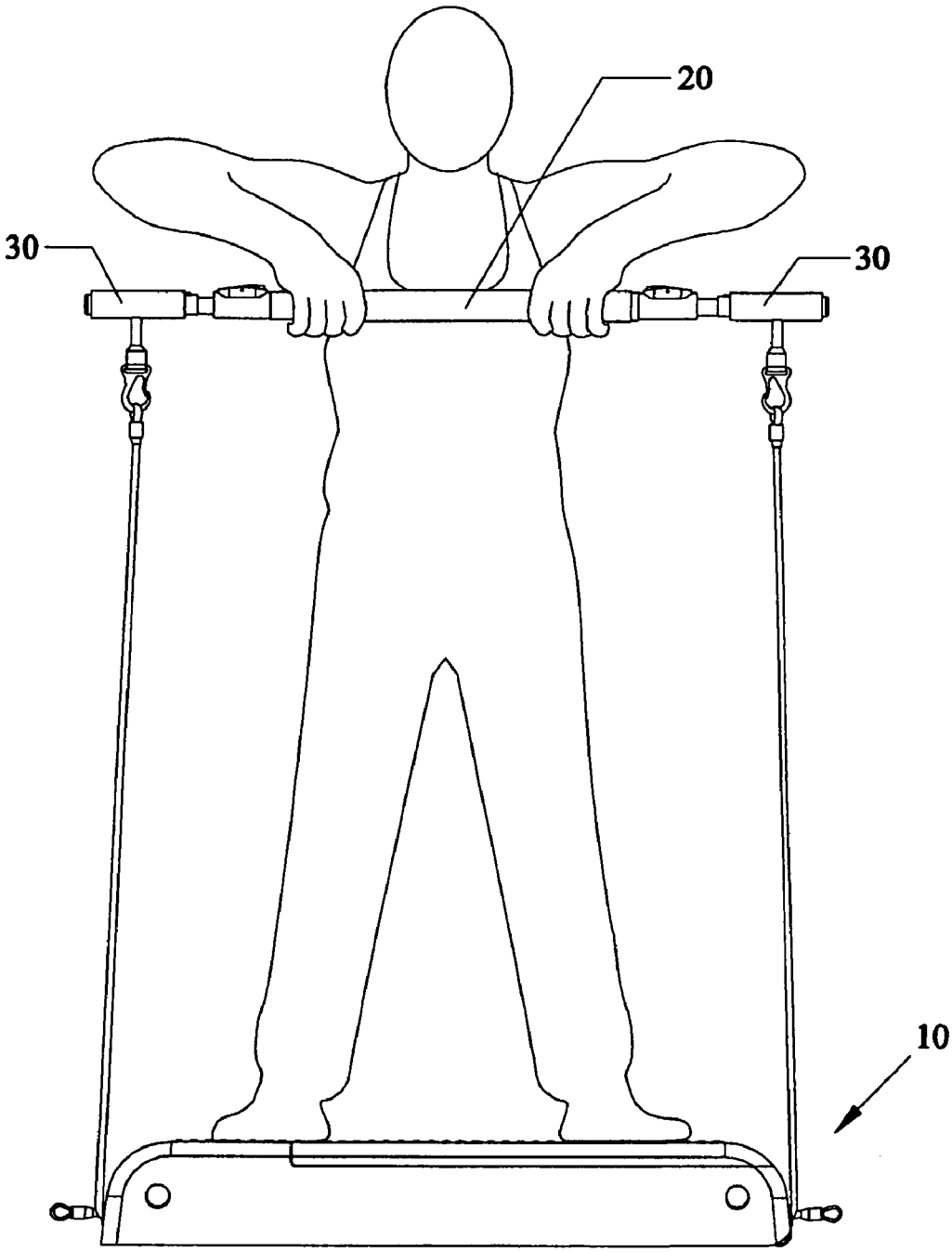
FIG. 55 shows a user doing "Upright Rows" using bar attachment standing on top of the apparatus platform.

Upright Rows:

FIG. 55 shows a user doing "Upright Rows" using bar attachment standing on top of the apparatus platform 10. FIG. 55 is an illustration of user standing in a vertical position atop the unit with the legs in a folded down position. With handles 30 attached and locked onto the extension bar 20, the user then secures the bar 20 with an over handed grip, then raises bar 20 until it reaches under chin, then returns to starting position.

Figure 56:
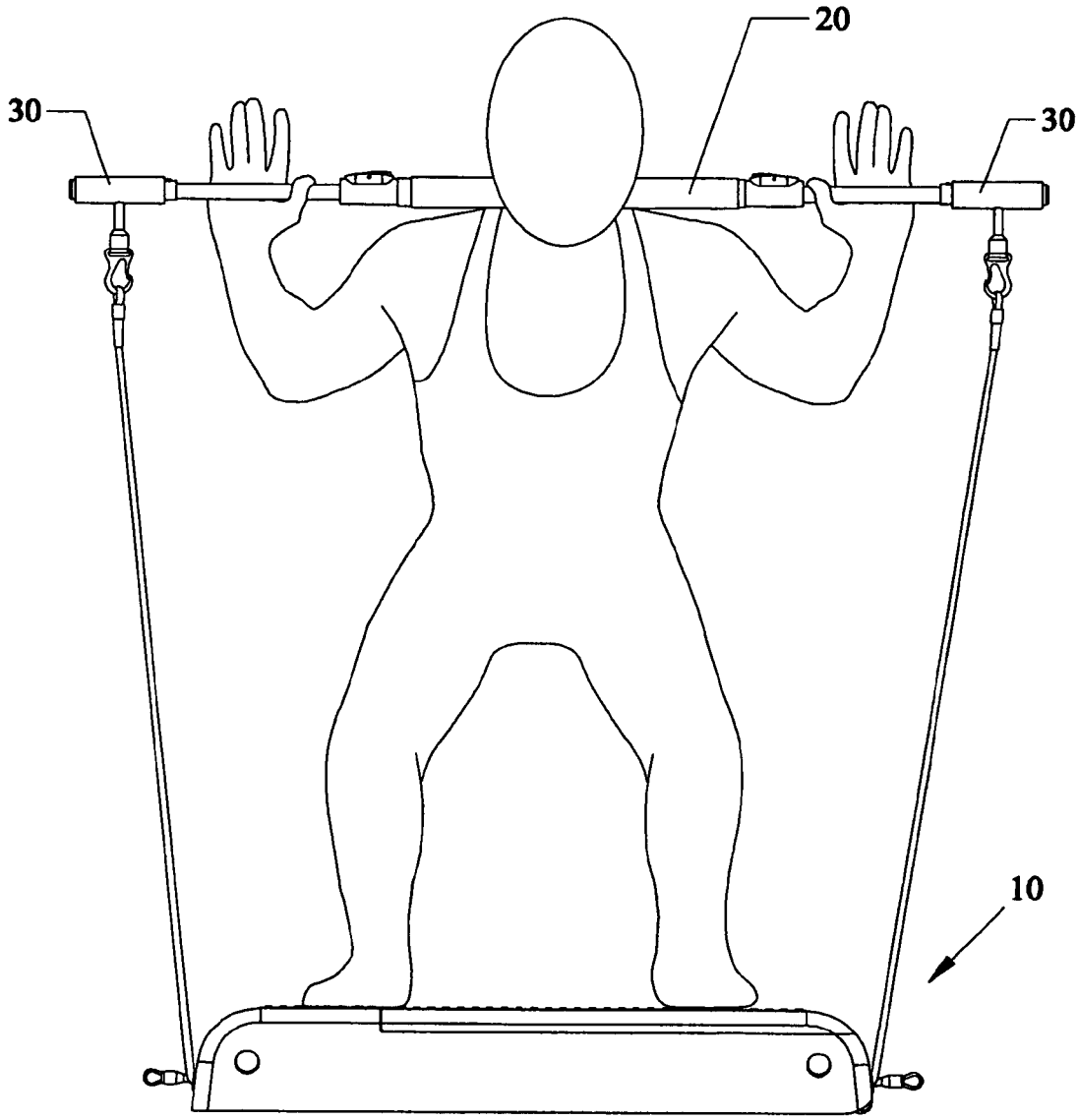
FIG. 56 shows a user doing "Squats" using bar extended standing on top of the apparatus platform.

Squats:

FIG. 56 shows a user doing "Squats" using bar extended standing on top of the apparatus platform. FIG. 56 is an illustration of the user positioned in a squatting position atop the unit with the legs in folded down position. With handles 30 attached onto the extension bar 20, the bar 20 is extended to a selectable locked position on both sides to accommodate space to secure hands. The user then raises himself upwards to almost a vertical position with knees only slightly bent then returns to starting position.

Figure 57:
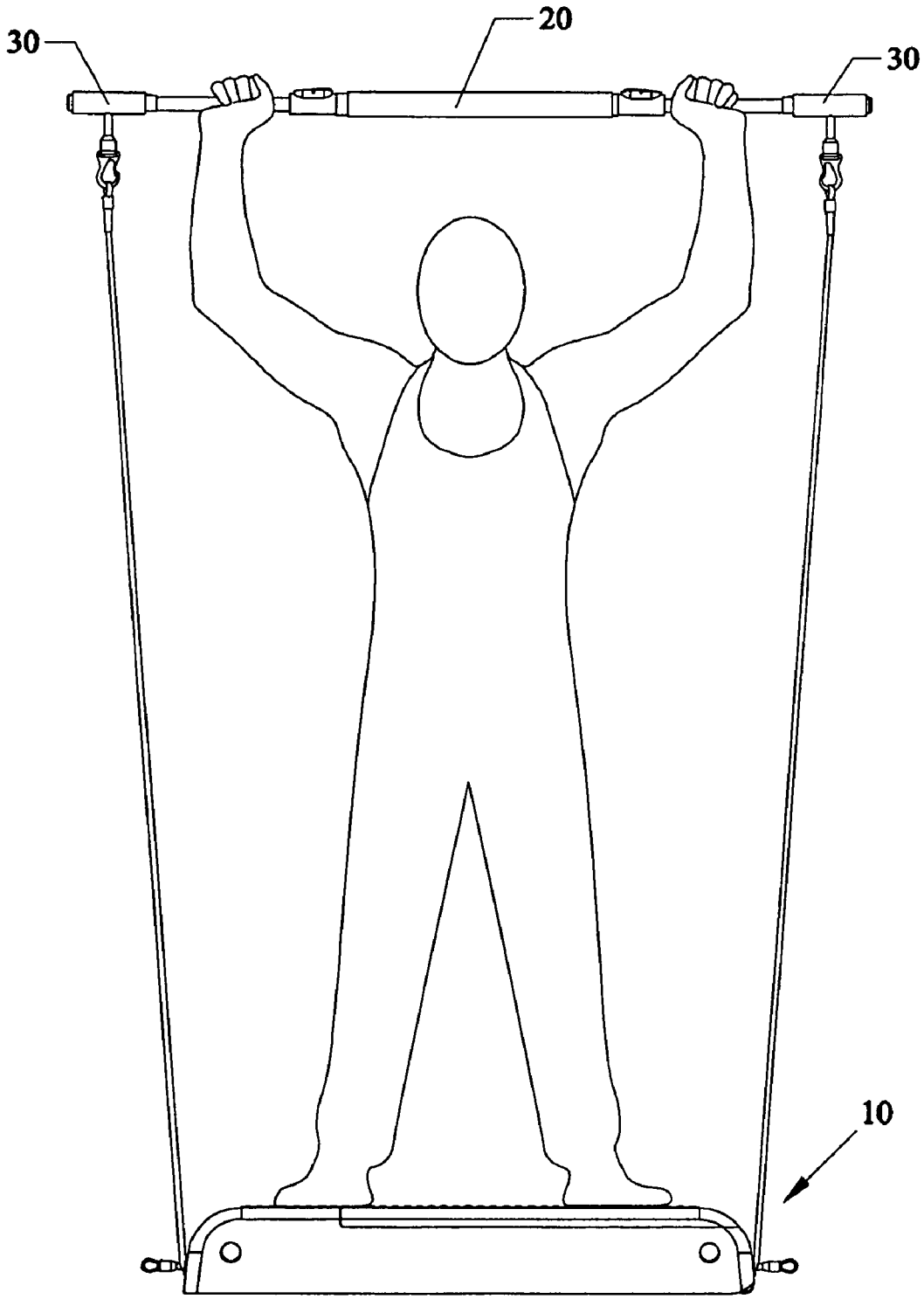
FIG. 57 shows a user doing "Shoulder Raises" using bar extended standing on top of the apparatus platform.

Shoulder Raises:

FIG. 57 shows a user doing "Shoulder Raises" using bar extended standing on top of the apparatus platform 10. FIG. 57 is an illustration of the user standing vertical atop the unit with the legs in a folded down position. The handles 30 are attached and locked onto the extension bar 20, and the bar 20 is extended out to a selectively locked position on both sides to accommodate space to secure hands. The user then raises the bar 20 from behind the neck upwards to a full overhead extension, then returns to the starting position.

Figure 58:
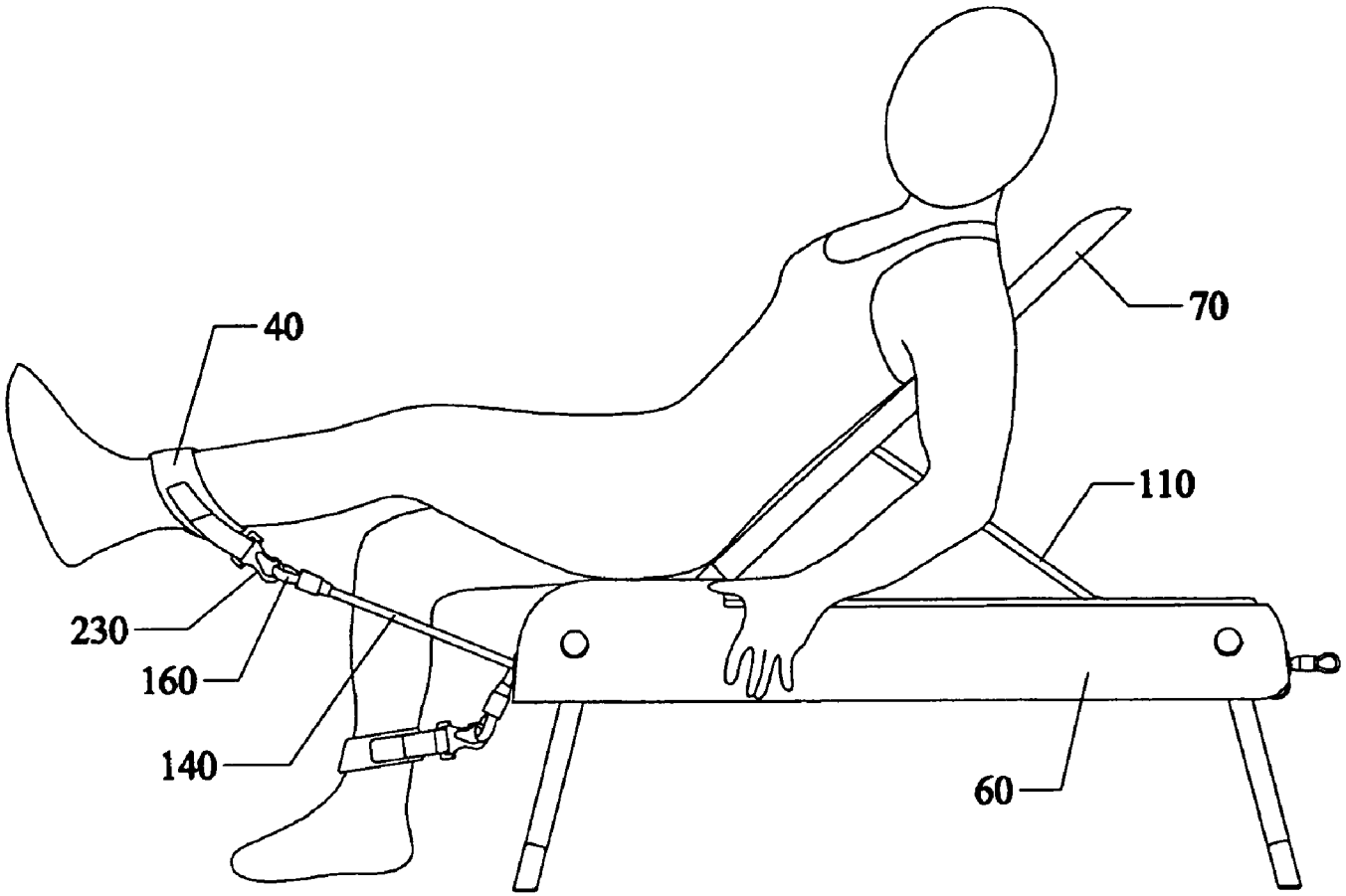
FIG. 58 shows a user doing "Leg Extensions" using ankle attachments sitting on top of the apparatus in an inclined bench position.

Leg Extensions:

FIG. 58 shows a user doing "Leg Extensions" using ankle attachments 40 sitting on top of the apparatus in an inclined bench position. FIG. 58 is an illustration of the user sitting in an inclined position atop the unit in the bench position. With the storage cover 110 opened and selectively adjusted and locked into the inclined position by bar 110, the user then connects the ankle attachments 40 to the resistance elements 140 with fastening hooks 230. After selecting the level of resistance, the user then extends legs out horizontally till they are level with the knees, and then returns to starting position.

Figure 59:
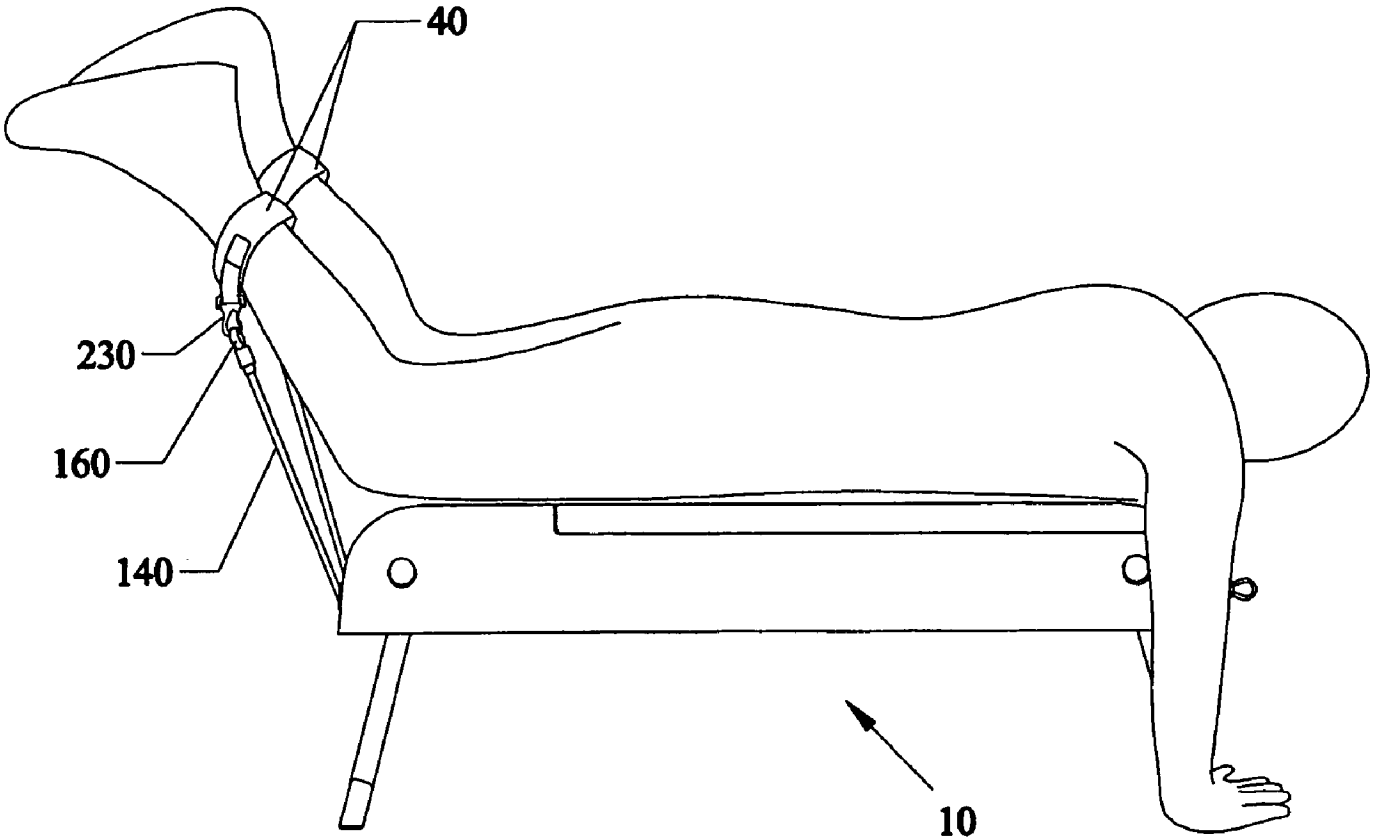
FIG. 59 shows a user doing "Leg Curls" using ankle attachments laying face down on top of apparatus in bench position.

Leg Curls:

FIG. 59 shows a user doing "Leg Curls" using ankle attachments 40 laying face down on top of apparatus 10 in a bench position with legs extending outward. FIG. 59 is an illustration of the user laying face down horizontally on the unit in the bench position. After connecting the ankle attachments 40 to the resistive elements 140 by the fasteners 230/160, the user then engages the resistance force by curling their feet and ankles toward the buttocks, and then returns to starting position.

Figure 60:
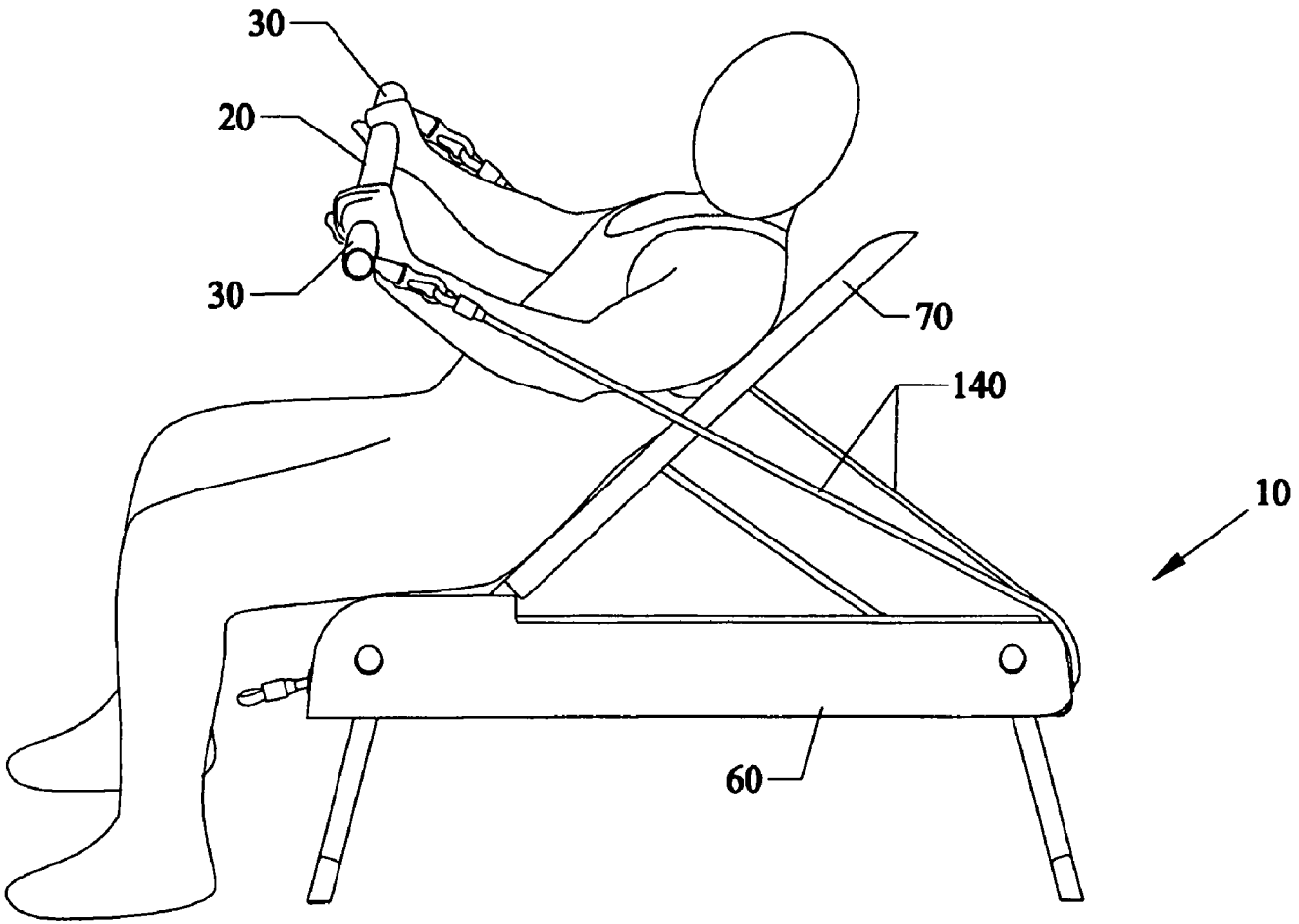
FIG. 60 shows a user doing a "Bench Press" using extended bar attachment sitting on the bench in an inclined position.

Bench Press:

FIG. 60 shows a user doing a "Bench Press" using extended bar attachment 20 sitting on the bench 10 with expanded out legs in an inclined position. FIG. 60 is an illustration of the user sitting in an inclined position atop the unit in the bench position. With the storage cover 70 opened and selectively adjusted and locked into the inclined position, the handles 30 are attached to the extension bar 20 in a locked position. The user then proceeds to push the bar 20 away from torso to fully extended arms, and then returns the bar 20 back in a controlled motion.

Figure 61:
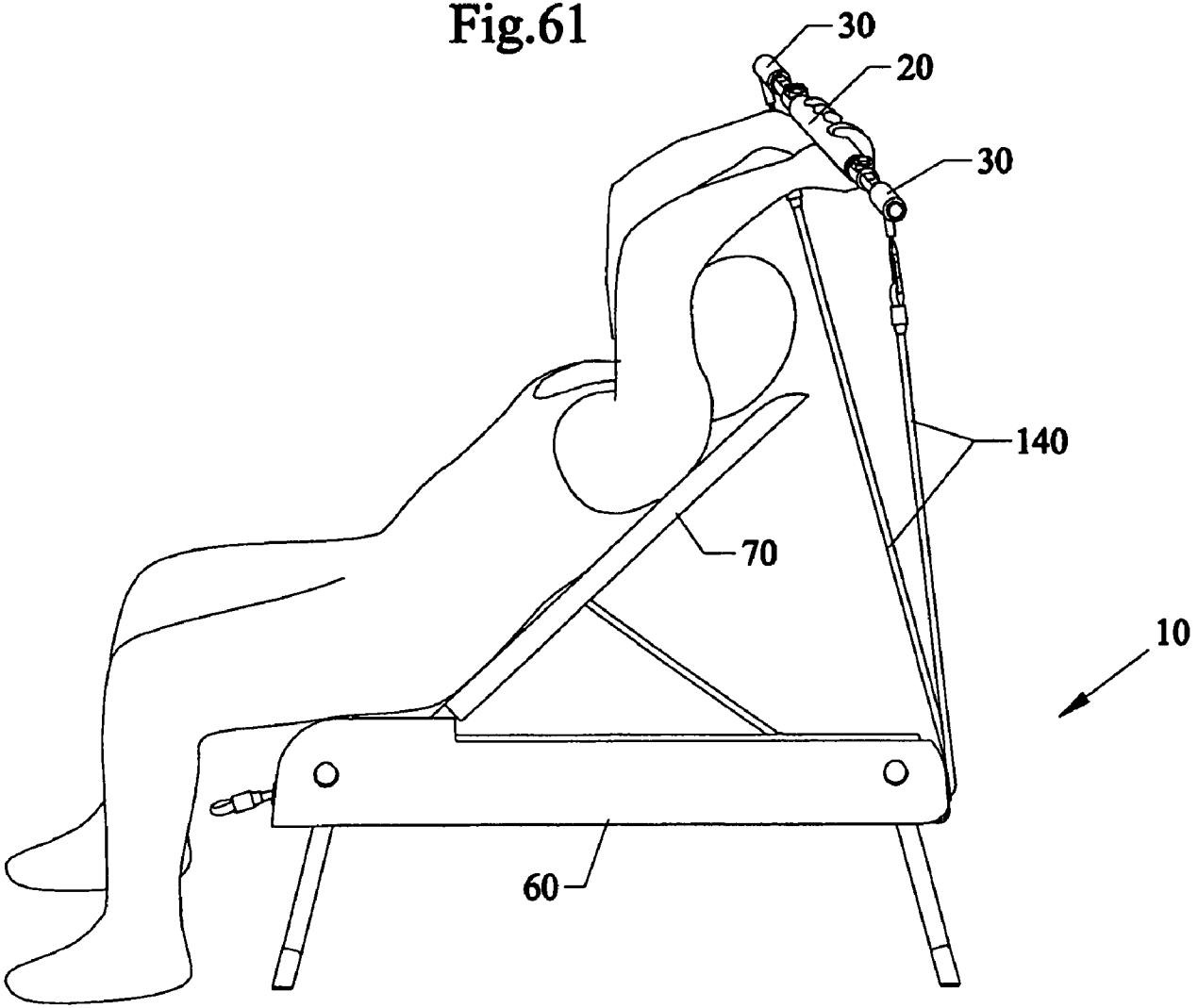
FIG. 61 shows a user doing "Tricep Extensions" using bar attachment sitting on the bench in an inclined position.

Tricep Extensions:

FIG. 61 shows a user doing "Tricep Extensions" using bar attachment 20 sitting on the bench 10 in an inclined position. FIG. 61 is an illustration of the user sitting in an inclined position atop the unit in the bench position. With the storage cover 70 opened and selectively adjusted and locked into the inclined position, the handles 30 are attached to the extension bar 20 in a locked position. The user then proceeds to extend their arms up while keeping elbows in a fixed position, then returns to starting position.

Figure 62:
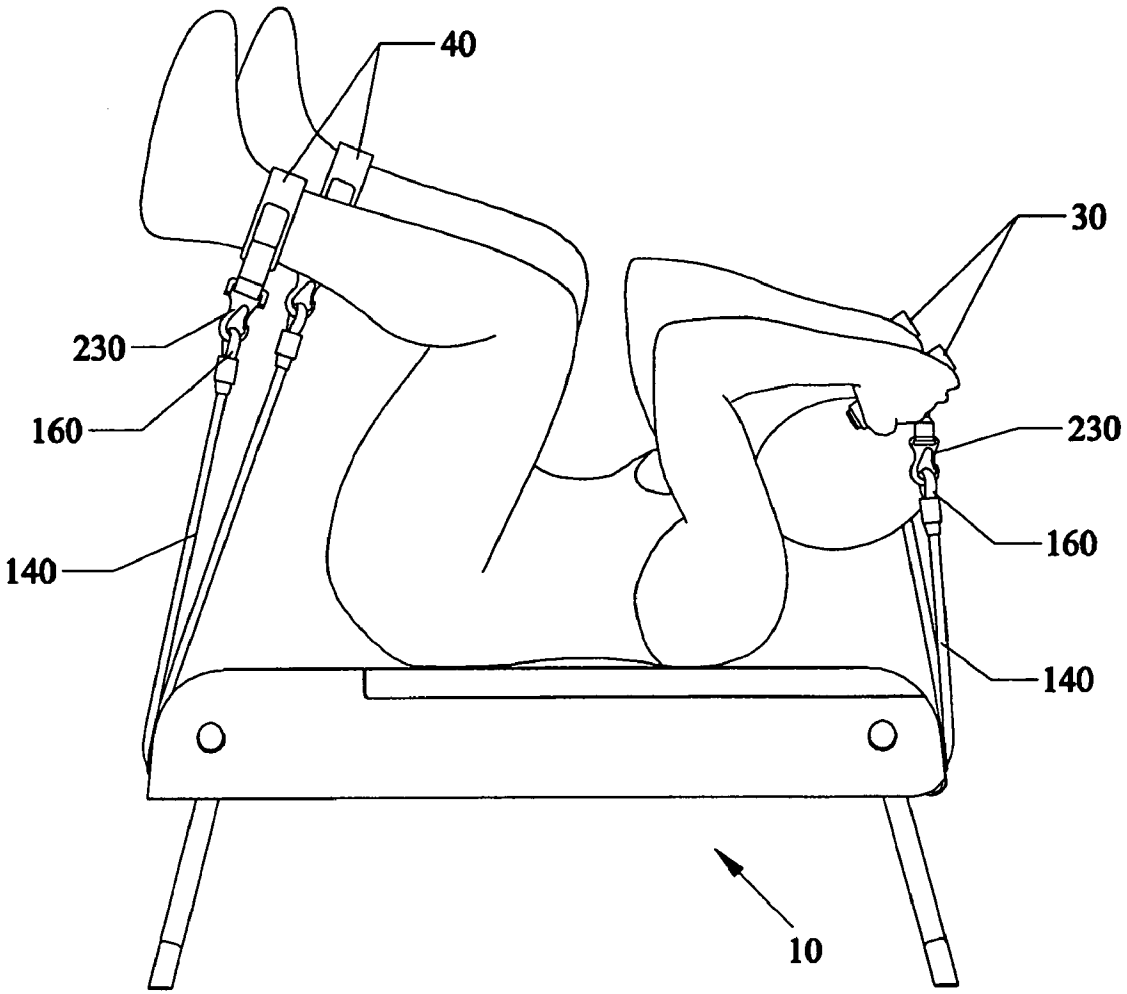
FIG. 62 shows a user doing "Abdominal Crunch" using both handle and ankle attachments laying face up on top of the unit in bench position.

Abdominal Crunch:

FIG. 62 shows a user doing "Abdominal Crunch" using both handle and ankle attachments 30, 40 laying face up on top of the unit 10 in a bench position. FIG. 62 is an illustration of the user laying face up on unit 10 in the bench position. With the ankle attachments 40 secured and hands grasping handles 30, the user assumes the crunch position trying to meet elbows to knees by pulling against the different pairs of resistive elements 140. Afterward, the user returns in a controlled method to the starting position.

As previously described other types of exercises can be achieved with the novel invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable, convertible and multifunction exercise apparatus, comprising: a rectangular platform having a front end, a rear end, a left side and a right side; an elongated elastic band having a proximate end and an outer end; a spring biased rotatable wheel for attaching the proximate end of the elongated elastic band to the rectangular platform, the spring biased rotatable wheel for selectively controlling the length of at least one elongated elastic band, the spring biased rotatable wheel which allows the proximate end of the elastic band to easily roll up thereon, so that pulling out the elastic band pulls against a spring; a spring loaded plunger for locking the wheel in a fixed position; and a plurality of slots about a side wall of the wheel for allowing an internal end of the plunger to be positioned therein, wherein each of the slots allows for a different length of the elastic band to be extended out from the platform.

2. The portable, convertible and multifunction exercise apparatus of claim 1, wherein the elongated elastic band includes:

a pair of parallel elongated resistive bands extending from the platform.

3. The portable, convertible and multifunction exercise apparatus of claim 2, wherein the elongated elastic band includes:

a second pair of parallel elongated resistive bands extending from the platform, the second pair being on an opposite side of the platform from the first pair.

4. The portable, convertible and multifunction exercise apparatus of claim 1, further comprising:

a central tubular member having a rotatable exterior surface portion;

a left member having a left band attachment portion, the left member extending from a left end of the central tubular member, the left attachment portion being removable attachable to a left elongated resilient band that is also attached to a portion inside of the platform;

a right member having a right band attachment portion, the right member extending from a right end of the central tubular member, the right attachment portion being removably attachable to a right elongated resilient band that is also attached to another portion inside of the platform, wherein the central tubular member being rotatable relative to the left member and the right member.

5. The portable, convertible and multifunction exercise apparatus of claim 1, wherein the platform further includes:

an elongated member having extendable ends, wherein each of the extendable ends are connected to elastic bands that are connected to the platform.

6. The portable, convertible and multifunction exercise apparatus of claim 1, wherein the platform includes:

foldable legs for converting the platform from a stepper to bench.

7. The portable, convertible and multifunction exercise apparatus of claim 1, wherein the platform further includes:

an interior storage compartment for storing accessory items inside the platform.

8. The portable, convertible and multifunction exercise apparatus of claim 1, wherein the platform further includes:

a raisable lid which converts the platform to an inclined chair.

9. The portable, convertible and multifunction exercise apparatus of claim 1, wherein the platform further includes:

wheels for allowing the platform to be portable.

10. A portable, convertible and multifunction exercise apparatus, comprising:

a rectangular platform having a front end, a rear end, a left side and a right side;

at least one pair of elongated resistive bands, each of the resistive bands having a proximate end and an outer end; and at least one pair of effective length adjusting members, each of the effective length adjusting members for attaching the proximate ends of the elongated resistive members to the rectangular platform, the effective length adjusting members for selectively controlling the effective length of the elongated resistive bands, each of the effective length adjusting members includes:

a rotatable wheel which allows the proximate end of the elongated band to roll up or roll out thereon; and a plunger for locking the wheel in a fixed position; and a plurality of slots about a side wall of the wheel for allowing an internal end of the plunger to be positioned therein, wherein each of the slots allows for a different length of each band to be extended out from the platform;

at least one pair of foldable legs for converting the platform from a stepper to a bench;

an interior storage compartment for storing accessory items inside the platform; and a raisable lid which converts the platform from the bench to an inclined chair.

11. The portable, convertible and multifunction exercise apparatus of claim 10, wherein each rotatable wheel includes:

a spring for biasing the wheel to roll up the band on the wheel.

12. The portable, convertible and multifunction exercise apparatus of claim 10, wherein each rotatable wheel includes:

a keyhole slot having a large opening adjacent to a narrow opening, the large opening for allowing an enlarged portion on the proximate end of the band to be inserted and locked in place when being slid into the narrow opening, the keyhole slot allowing for the band to be easily removed and replaced.

13. The portable, convertible and multifunction exercise apparatus of claim 10, further comprising:

a central tubular member having a rotatable exterior surface portion;

a left member having a left band attachment portion, the left member extending from a left end of the central tubular member, the left attachment portion being removable attachable to a left elongated resilient band that is also attached to a portion inside of the platform;

a right member having a right band attachment portion, the right member extending from a right end of the central tubular member, the right attachment portion being removably attachable to a right elongated resilient band that is also attached to another portion inside of the platform, wherein the central tubular member being rotatable relative to the left member and the right member.

14. The portable, convertible and multifunction exercise apparatus of claim 10, wherein the platform further includes:

an elongated member having extendable ends, wherein each of the extendable ends are connected to elastic bands that are connected to the platform.

15. A portable, convertible and multifunction exercise apparatus, comprising: a rectangular platform having a front end, a rear end, a left side and a right side; an elongated resistive band having a proximate end and an outer end; and a spring biased rotatable wheel which allows the proximate end of the elongated band to easily roll up thereon, so that pulling out the elongated resistive band pulls against a spring, the spring biased rotatable wheel for attaching the proximate end of the elongated resistive member to the rectangular platform, the spring biased rotatable wheel for selectively controlling the length of at least one elongated resistive band; and wherein the spring biased rotatable wheel includes a keyhole slot, the keyhole slot having a large opening adjacent to a narrow opening, the large opening for allowing an enlarged portion on the proximate end of the elongated resistive band to be inserted and locked in place when being slid into the narrow opening, the keyhole slot allowing for the elongated resistive band to be easily removed and replaced.

* * * * *